US007165765B2

(12) United States Patent
Sonoda et al.

(10) Patent No.: US 7,165,765 B2
(45) Date of Patent: Jan. 23, 2007

(54) SHEET FEEDING APPARATUS AND RECORDING APPARATUS

(75) Inventors: Shinya Sonoda, Yokohama (JP); Nozomu Nishiberi, Yokohama (JP); Masaya Simmachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 10/449,079

(22) Filed: Jun. 2, 2003

(65) Prior Publication Data

US 2004/0041331 A1 Mar. 4, 2004

(30) Foreign Application Priority Data

Jun. 7, 2002 (JP) ..... 2002-166626
Aug. 16, 2002 (JP) ..... 2002-237432
Aug. 30, 2002 (JP) ..... 2002-253560

(51) Int. Cl.
*B65H 3/52* (2006.01)

(52) U.S. Cl. ..... 271/122; 271/125

(58) Field of Classification Search ..... 271/121, 271/124, 125, 126, 127, 122, 10.13
See application file for complete search history.

(56) References Cited

U.S. PATENT DOCUMENTS 4,025,187 A 5/1977 Taylor et al. ..... 355/14
4,627,607 A * 12/1986 Ishii ..... 271/122
4,822,023 A * 4/1989 Miyoshi ..... 271/118
4,844,638 A * 7/1989 Kagami et al. ..... 400/636
4,852,868 A * 8/1989 Fukui et al. ..... 271/122
5,129,642 A 7/1992 Svyatsky et al. ..... 271/10
5,316,285 A * 5/1994 Olson et al. ..... 271/122
5,386,983 A * 2/1995 Ando ..... 271/118
5,648,807 A 7/1997 Saito et al. ..... 347/102
5,655,762 A * 8/1997 Yergenson ..... 271/121
5,697,603 A 12/1997 Kato ..... 271/114
5,725,208 A 3/1998 Miyauchi ..... 271/10.09
5,738,453 A 4/1998 Tsuburaya et al. ..... 400/624
5,882,004 A * 3/1999 Padget ..... 271/119
5,899,613 A 5/1999 Koike et al. ..... 399/384
5,901,951 A 5/1999 Yamaguchi ..... 271/10.11
5,902,058 A 5/1999 Koike et al. ..... 400/578

(Continued)

FOREIGN PATENT DOCUMENTS

EP 0 271 844 6/1988

(Continued)

OTHER PUBLICATIONS

European Search Report dated May 31, 2005, issued in corresponding European patent application No. EP 03 01 2792, forwarded in a Communication dated Jun. 8, 2005.

*Primary Examiner*—Patrick Mackey
*Assistant Examiner*—Matthew J. Kohner
(74) *Attorney, Agent, or Firm*—Fitzpatrick, Cella, Harper & Scinto

(57) ABSTRACT

A sheet feeding apparatus for separating and feeding a plurality of sheets stacked on a sheet stacking portion one by one includes feeding means for feeding the plurality of sheets stacked on the sheet stacking portion, separation means for separating the sheets one by one by contacting to the sheets, returning means for returning the sheets to the sheet stacking portion, and separation force switching means for switching between generation and release of a separation force of the separation means. During a feeding operation, the feeding operation is switchable between a separating mode in which the separation force for a sheet is generated by the separation means and a conveying mode in which the separation force is released.

20 Claims, 34 Drawing Sheets

U.S. PATENT DOCUMENTS

| | | | | |
|---|---|---|---|---|
| 5,947,465 | A | 9/1999 | Kato et al. | 271/10.11 |
| 5,984,300 | A | 11/1999 | Nishiberi | 271/171 |
| 5,996,990 | A * | 12/1999 | Kawashima | 271/122 |
| 6,000,689 | A * | 12/1999 | Furuki et al. | 271/10.11 |
| 6,059,281 | A | 5/2000 | Nakamura et al. | 271/119 |
| 6,142,467 | A | 11/2000 | Funada | 271/246 |
| 6,217,017 | B1 | 4/2001 | Yamazaki | 271/121 |
| 6,224,052 | B1 | 5/2001 | Nagano | 271/127 |
| 6,331,002 | B1 | 12/2001 | Yoshino et al. | 271/117 |
| 6,378,858 | B1 * | 4/2002 | Suga | 271/10.01 |
| 6,382,857 | B1 | 5/2002 | Yanagi et al. | 400/636 |
| 6,467,767 | B1 * | 10/2002 | Yano | 271/122 |
| 6,536,759 | B1 * | 3/2003 | Takada | 271/125 |
| 6,547,237 | B1 * | 4/2003 | Sugino et al. | 271/119 |
| 6,824,132 | B1 * | 11/2004 | Asai et al. | 271/125 |
| 6,877,738 | B1 * | 4/2005 | Sonoda et al. | 271/121 |
| 6,896,253 | B1 * | 5/2005 | Hanabusa | 271/117 |
| 2001/0030763 | A1 | 10/2001 | NIshiberi et al. | 358/1.12 |
| 2002/0171193 | A1 | 11/2002 | Asai et al. | 271/121 |

FOREIGN PATENT DOCUMENTS

| | | |
|---|---|---|
| EP | 0 466 171 A2 | 1/1992 |
| EP | 0 495 109 A1 | 7/1992 |
| EP | 0 529 538 A1 | 3/1993 |
| EP | 0 888 989 A2 | 1/1999 |
| EP | 1 053 961 A2 | 11/2000 |
| EP | 1 215 147 A2 | 6/2002 |
| JP | 7-137872 | 5/1995 |
| JP | 7-206198 | 8/1995 |
| JP | 10-181904 | 7/1998 |
| JP | 11-190410 | 7/1999 |
| JP | 11-193141 | 7/1999 |
| JP | 2001-302019 | 10/2001 |

* cited by examiner

SHEET FEEDING APPARATUS AND RECORDING APPARATUS

FIELD OF THE INVENTION AND RELATED ART

The present invention relates to a sheet feeding apparatus, which picks a plurality of sheets stacked on a sheet stacking potion out of the sheet stacking portion, and conveys the sheets one by one, and relates to a recording apparatus for recording an image on a sheet.

Particularly, the present invention relates to a sheet feeding apparatus and a recording apparatus in order to prevent a so-called double feeding such that a plurality of sheets are feed in stacked state in one feeding operation and also relates to a sheet feeding apparatus capable of switching feeding modes depending on specifications of sheets used.

As a sheet feeding apparatus for feeding a sheet such as a recording sheet or a film, such a structure provided with a separating mechanism for separating a plurality of stacked sheets or a double feeding preventing mechanism for preventing the double feeding of sheets have generally been employed conventionally.

As this type of the separating mechanism, those of a frictional plate type wherein separation is performed based on a difference in coefficient of friction among a feed roller, a sheet and a frictional plate and of a retard roller type wherein a torque limiter is provided to a sheet roller which is abutted to a feed roller, and a sheet is separated by a resisting force generated by the torque limiter and a coefficient of friction of the sheet roller, having, e.g., been known.

FIG. 33 shows a conventional sheet feeding apparatus provided with a separating mechanism of the retard roller type. The conventional sheet feeding apparatus is, as shown in FIG. 33, provided with a sheet roller 311 and is abutted to the feed roller 311 by an unshown arging means. Sheets to be fed are stacked on a pressure plate 316 and are abutted to the feed roller 311 by the pressure plate 316. On the conveyance path of the sheet, a conveyance roller 313 and a driven roller 314 for urging the sheet against the conveyance roller 313 are disposed opposite to each other downstream from the feed roller 311 and the sheet roller 312 in a sheet feeding direction.

As representative examples of the double feed preventing mechanism, in addition to the retard roller type wherein the sheet roller is forcedly rotated reversely in terms of the sheet feeding direction, a returning lever type wherein a returning lever is actuated for each feeding operation of a predetermined number of sheets to forcedly return a leading end of the sheets in terms of the sheet feeding direction to a predetermined position is employed.

An example of the returning layer type is disclosed in Japanese Laid-Open Patent Application No. (Hei) 10-1881904 in which a bidirectional rotation control type for performing a feeding operation by rotating a driving source in a forward direction and or returning the sheet to a predetermined position by rotating the driving source in a reverse direction to actuate the returning roller.

Further, in the conventional sheet feeding apparatuses provided with a pressure plate for generating an abutting force for abutting the sheet to the feed roller, most of them employ a structure in which the pressure plate is rotatably supported. Such a pressure roller is designed so that a height of its rotational center is smaller than almost half of a height of a maximum stacked surface of sheets (topmost sheet surface) hen a maximum stacking amount of the sheets are stacked on a sheet feeding portion.

Then, the sheet fed by the feeding apparatus is conveyed to a nip portion forward between the conveyance roller 313 and the driven roller 314 by the feed roller. In some cases, the sheet is, after being adjusted so that its leading end is in parallel with a main scanning direction of a recording head (not shown) (hereinafter, referred to as "registration"), conveyed to a recording portion where recording on the sheet is performed by the recording head.

Incidentally, in the above-mentioned conventional sheet feeding apparatuses, irrespective of the separation types a resisting force is applied to the sheet by the separating means at all times during a period until the leading end of the sheet reaches the recording portion of a reading apparatus, i.e., at all times during the feeding operation. In other words, a separating force is continuously applied to the sheet by the separating means at all times during the feeding operation.

For this reason, e.g., in the case where a coefficient of friction is lowered by attachment of dust such as paper powder to the feed roller, a sliding of the sheet relative to the feed roller during the feeding operation is caused to occur, thus leading to feeding failure in some cases. Further, by the friction between the sheets, a flaw on the surface of, e.g., glossy paper is inadvantageously caused to occur.

Further, in the case of using the separation roller having the torque limiter as the separating mechanism, a clutch shaft and a clutch spring included in the torque limiter are continuously placed in a sliding state at all times during the feeding operation, so that the clutch shaft is liable to be worn. For this reason, a metal shaft is oftenly used as the clutch shaft to result in an increase in production costs.

Further, in order to actuate the mechanism for preventing the double feeding of the sheets, there are some constrains. For example, in the retarding roller-type double feeding preventing mechanism, it is necessary to use a torque limiter or retaining an appropriate releasing torque and the roller is required to be reversely rotated at all times during the feeding operation. As a result, the mechanism becomes complicated, thus leading to increases in size and production costs of the entire apparatus. Further, such a double feeding preventing mechanism also applies an undesired resisting force to the conveyed sheet in come cases.

Further, in the bidirectional rotation control-type double feeding preventing mechanism using the returning lever, an undesired resisting force is applied to the sheet in some cases by contact of the returning lever with the sheet during the conveyance operation. Further, the operation of the returning lever is performed after a sequence of the feeding operation is completed, so that it is necessary to ensure an operating time for the returning lever, in addition to the time for the feeding operation. As a result, an apparatus operating time tends to be prolonged.

Further, in the bidirectional rotation control-type double feeding preventing mechanism using the returning lever, an undesired resisting force is applied to the sheet in some cases by contact of the returning lever with the sheet during the conveyance operation. Further, the operation of the returning lever is performed after a sequence of the feeding operation is completed, so that it is necessary to ensure an operating time for the returning lever, in addition to the time for the feeding operation. As a result, an apparatus operating time tends to be prolonged.

Further, in order to decrease the resisting force at the time of the operation of the returning lever, the feed roller is required to be formed to have a substantially D character-shaped cross-section by cutting, so that a conveyance length of the sheet is determined by an outer diameter of the feed roller. As a result, in the case of a longer distance between a feeding portion and a recording portion, the outer diameter of the feeding roller has to be increased, thus leading to a large-size apparatus as a whole.

In the case where the (full) length of the pressure plate 315 is decreased or the outer diameter of the feed roller 311 is decreased in the conventional sheet feeding apparatus shown in FIG. 33, a lower end of the pressure plate 316 abuts to the upstream side of the feeding roller 311 in the sheet feeding direction. For this reason, an angle a2 of approach formed between an entering direction of the sheet which enters the feed roller 311 and the sheet stacking surface becomes large. As a result, the feeding direction of the sheet is positionally deviated away from the recording portion in some cases. Further, a gap d2 between the lower end of the pressure roller 316 and a sheet leading end reference portion 315*a* when the pressure roller 316 is moved toward the direction closer to the feed roller 311 is largely changed, and in the gap d2, the fed sheet undesirably enters in some cases. Accordingly, in the conventional feeding apparatus, it is relatively difficult to reduce the size of the entire feeding apparatus by decreasing the outer diameter of the feed roller 311 or the length of the pressure roller 316.

On the other hand, it is necessary to provide selectable modes and structures of registration in order to meet various sheet materials and recording modes (e.g., draft printing, photographic-quality printing, etc.). For example, registration is required to bring the sheet into parallelism with a recording image. On the other hand, in order to convey a thick paper such as an envelope, it is necessary to adopt a registration-less mode for conveying the sheet to the conveyance roller which is rotated normally in advance.

In order to realize two modes with respect to registration including the registration mode and the registration-less mode, it is possible to employ a simple structural mechanism such that a driving source of the feed roller and a driving source of the conveyance roller are separated from each other. However, on the other hand, the production cost is increased. Further, in the case where a common driving source is used to the feed roller and the conveyance roller, a complicated mechanism is required, thus resulting in problems such that it leads to an unstable factor in terms of quality and that a time required for recording is prolonged due to a time required for switching between drive of the feed roller and drive of the conveyance roller.

Further, apart from the registration, e.g., when a spittle paper such as glossy paper or ink jet paper, a deterioration in image quality is caused by a load on the conveyance roller. For this reason, in the case of conveying the special paper, a mechanism for reducing the load on the conveyance roller is required, so that provision of such a mechanism complicates the driving mechanism.

SUMMARY OF THE INVENTION

An object of the present invention is to provide a sheet feeding apparatus capable of reducing an undesirable resisting force applied to a sheet by switching between a separating operation and a conveying operation during sheet feeding while ensuring a stability of separating and feeding operation, of arbitrarily setting an available conveyance length of a sheet, and of downsizing an entire apparatus.

Another object of the present invention is to provide a sheet feeding apparatus capable of switching between a registration mode and a registration-less mode by a simple and inexpensive mechanism.

Another object of the present invention is to provide a sheet feeding apparatus capable of reducing a load on a conveyance roller at the time of conveying a special paper.

Another object of the present invention is to provide a recording apparatus provided with the sheet feeding apparatus described above.

Another object of the present invention is to provide a series of drive gears capable of reducing a load on a conveyance roller at the time of conveying a special paper.

According to a first aspect of the present invention, there is provided a sheet feeding apparatus for separating and feeding a plurality of sheets stacked on a sheet stacking portion one by one, comprising:

feeding means for feeding the plurality of sheets stacked on the sheet stacking portion, separation means for separating the sheets one by one by contacting to the sheets, returning means for returning the sheets to the sheet stacking portion, and separation force switching means for switching between generation and release of a separation force of the separation means, wherein during a feeding operation, the feeding operation in switchable between a separating mode in which the separation force for a sheet is generated by the separation means and a conveying mode in which the separation force is released.

According to a second aspect of the present invention, there is provided a feeding apparatus for separating and feeding a plurality of sheets stacked on a sheet stacking portion one by one, comprising:

feeding means for feeding the plurality of sheets stacked on the sheet stacking portion, separation means for separating the sheets one by one by contacting to the sheets, separation force switching means for switching between a generation mode and a release mode of a separation force of the separation means, and separation means holding member for holding the separation means and causing the separation means to be pressed against and moved away from the feeding means, wherein the apparatus is provided with a first feeding mode for feeding the sheets in the release state of the separation force and a second feeding mode for feeding the sheets by moving the separation means away from the feeding means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 32 is a flowchart showing a sequence at the time of paper-on.

DETAILED DESCRIPTION OF THE PREFERRED EMBODIMENTS

Hereinafter, specific embodiments of the recording apparatus according to the present invention will be described with reference to the drawings.

A recording apparatus used in this embodiment is a serial-type ink-jet printer in accordance with an ink-jet recording scheme, particularly, wherein a recording head provided with a means for generating thermal energy as energy used for ejecting liquid ink is mounted and a scheme of creating a change in state of ink by the thermal energy is adopted.

By the use of this recording scheme, resultant characters and images to be recorded have high density and high definition. Particularly, in this embodiment, ink is ejected by utilizing a pressure by bubbles generated at the time of film boiling by heating ink with a heat generating resistor as a means for generating the thermal energy. However, a method of ejecting the ink is not limited to one using the heat generating resistor but may be, e.g., one using an electro-thermal transducer, such as a piezoelectric element, to impart mechanical vibration to ink and ejecting the ink by utilizing a pressure based on the vibration.

Further, in the ink-jet recording apparatus according to the present invention, for convenience, it is possible to use recording paper or a film as a sheet on which information such as characters or images is recorded.

Figure 1:
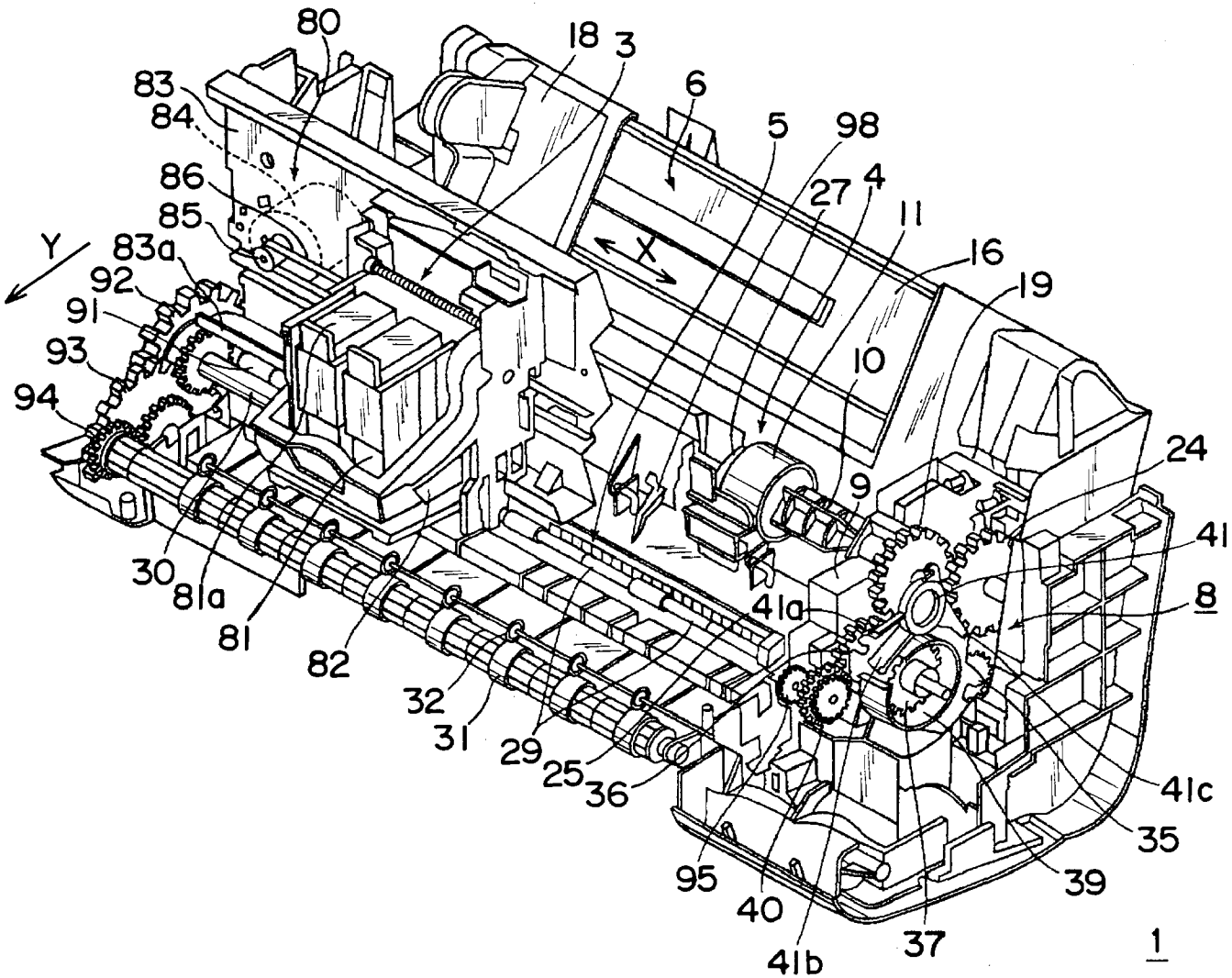
FIG. 1 is a partly exploded perspective view of an embodiment of a recording apparatus according to the present invention.
Figure 2:
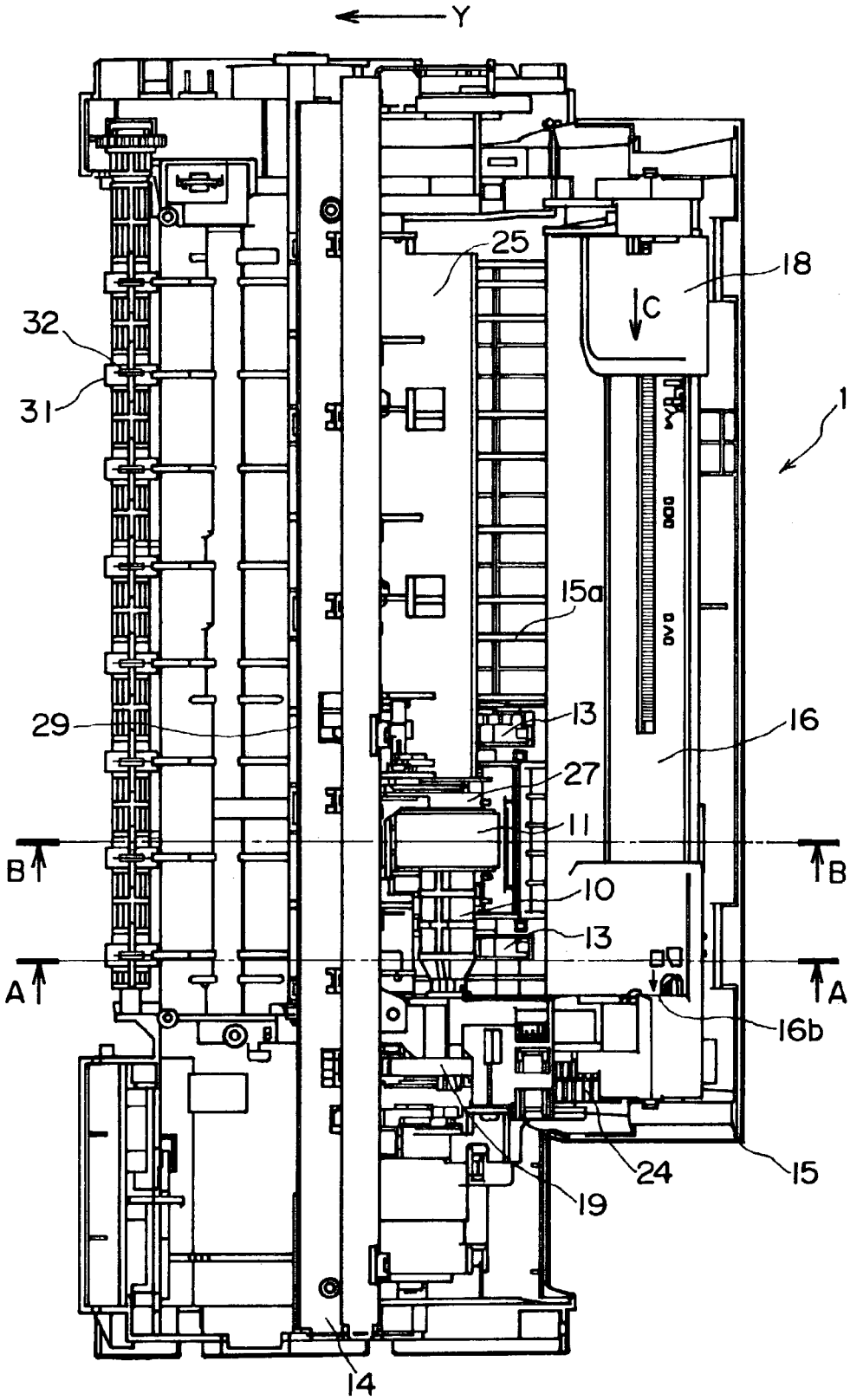
FIG. 2 is a plan view of the recording apparatus of FIG. 1.
Figure 3:
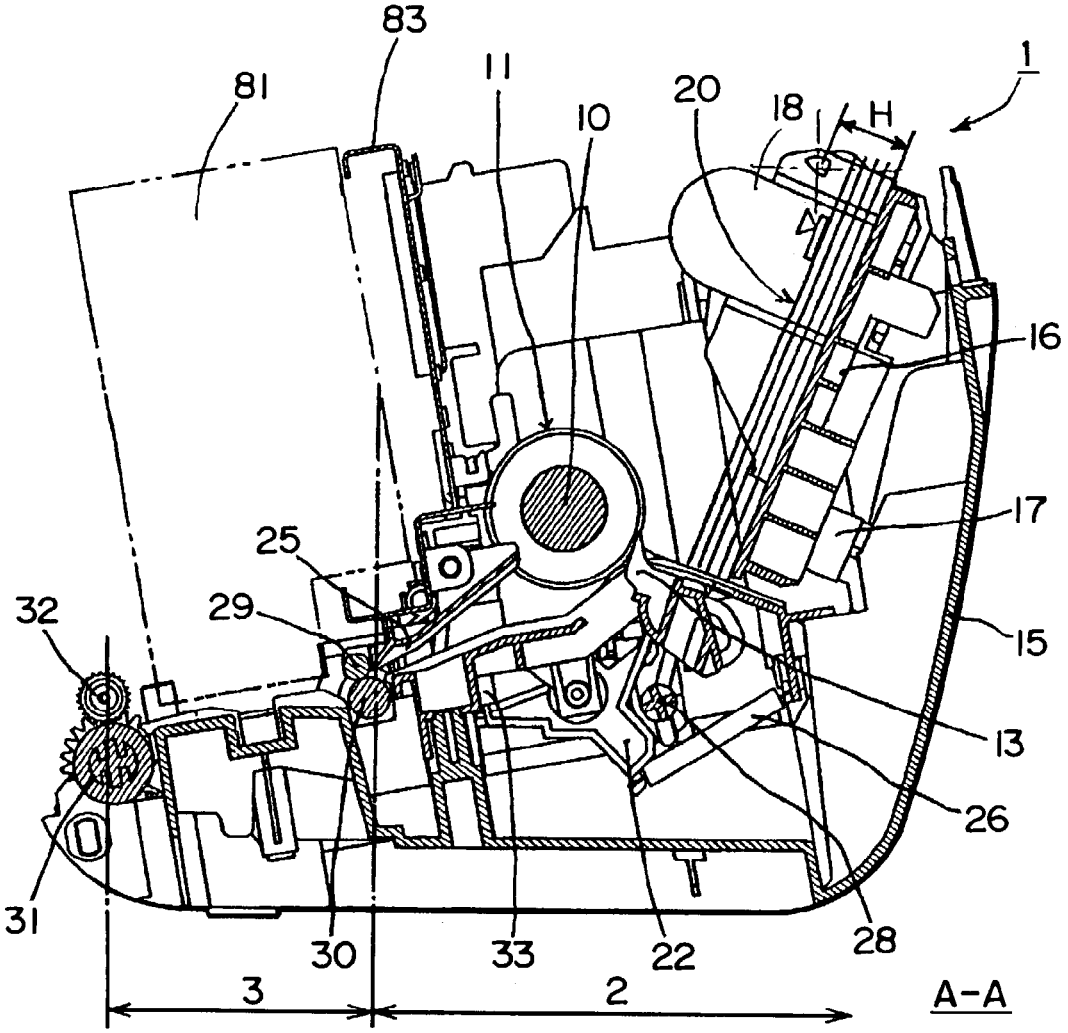
FIGS. 3 and 4 are sectional views for illustrating the principal part of the recording apparatus taken along A—A line and B—B line, respectively, shown in FIG. 2.
Figure 4:
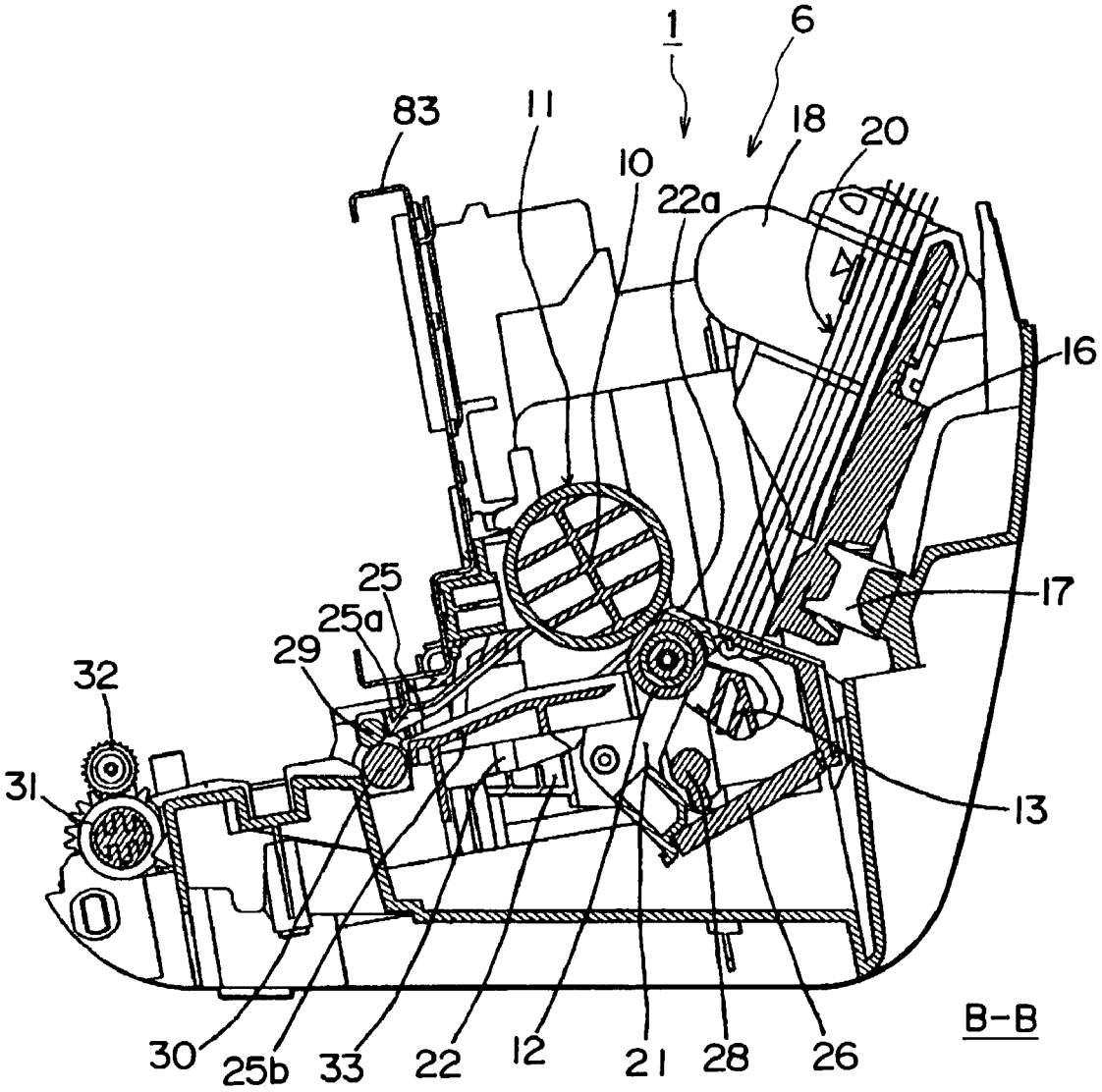
Figure 5:
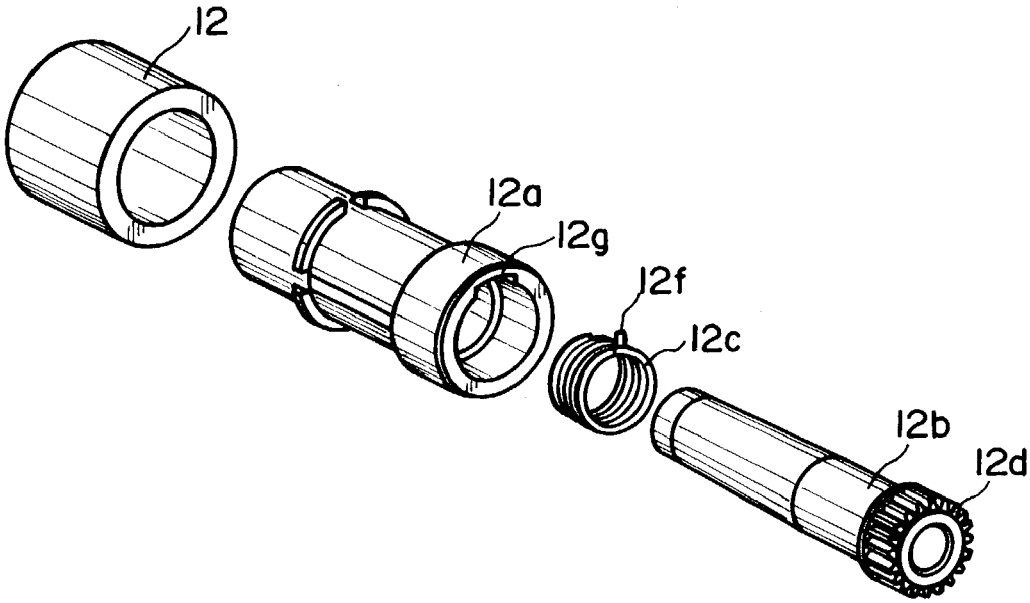
FIG. 5 is an exploded perspective view of a separation roller.
Figure 6:
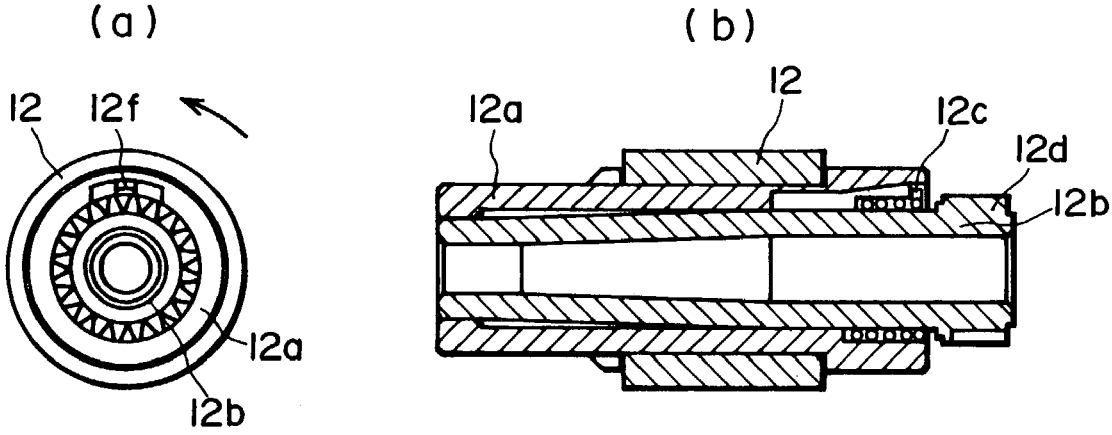
FIG. 6(*a*) is a front view of the separation roller and FIG. 6(*b*) is a cross-sectional view of the separation roller.
Figure 7:
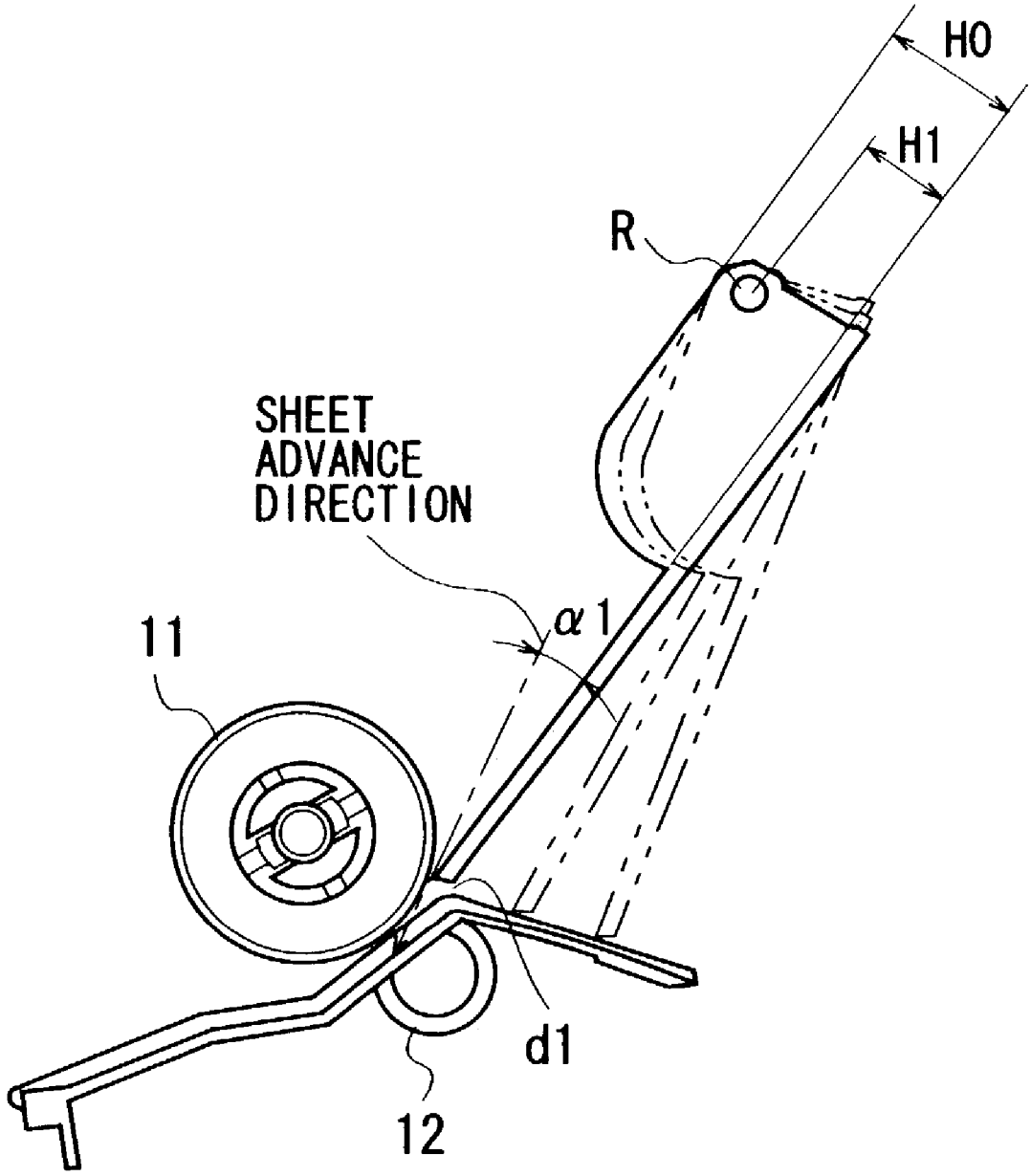
FIG. 7 is a schematic view for illustrating an operation of a pressure plate according to an embodiment of the present invention.
Figure 8:
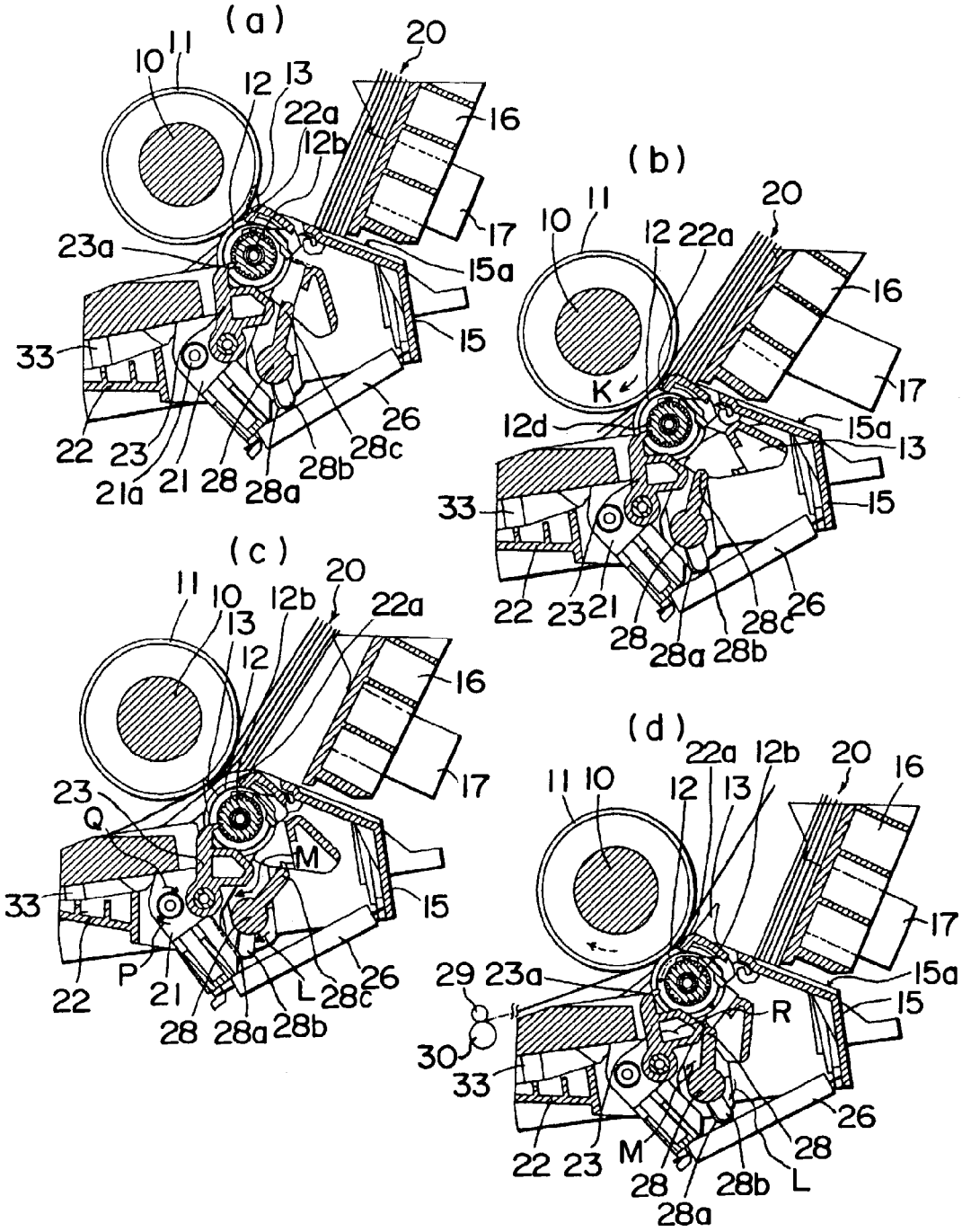
FIG. 8 includes views for illustrating an operation of a sheet feeding portion.
Figure 17:
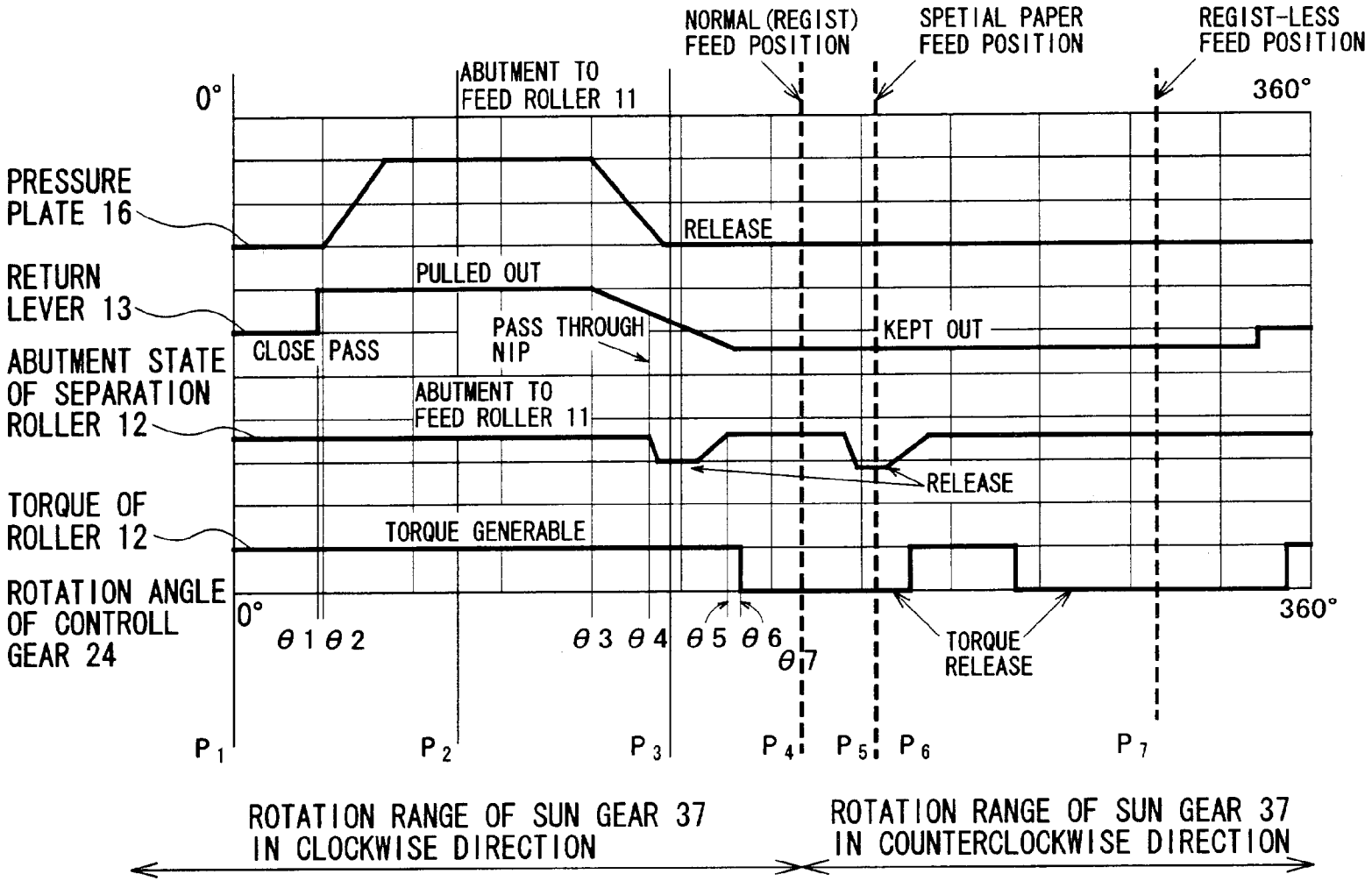
FIG. 17 is a timing chart for illustrating an operation of the sheet feeding portion.

FIG. 1 is a perspective view of the entire recording apparatus; FIG. 2 is a plan view of the recording apparatus; FIG. 3 is A—A sectional view, of the recording apparatus shown in FIG. 2, for illustrating the principal part of the recording apparatus; FIG. 4 is B—B sectional view for illustrating the principal part of the recording apparatus; FIG. 5 is an exploded perspective view of a separation roller; FIG. 6(*a*) is a plan view of the separation roller and FIG. 6(*b*) is a sectional view of the separation roller; FIG. 17 is a timing chart on the basis of cam phase of a control cam; FIG. 8 includes sectional views for illustrating operations of separating and feeding a sheet; and FIG. 7 is a schematic view for illustrating an operation of a pressure plate.

As shown in FIGS. 1, 2 and 3, a recording apparatus 1 includes a recording portion (means) 3 for recording a character or an image on a sheet 2, a feeding portion 4 for feeding the sheet 2 toward the recording portion 3, and a conveying portion (means) for conveying the sheet 2 fed from the feeding portion 3 to the recording portion 3.

1 (Recording Portion)

The recording portion 3 includes, as shown in FIG. 1, a recording head 81 for recording, e.g., an image on the sheet 2, a carriage 82 for supporting the recording head 81, and a moving mechanism 80 for transporting the carriage 82.

1-1 (Recording Head)

The recording head 81 is disposed at a position facing a conveyance path of the sheet 2. At a position opposite to the sheet conveyance path, nozzles for ejecting ink is disposed (not shown). The recording head 81 includes an electrical resistor for generating thermal energy for ejecting supplied ink. The recording head 81 ejects the ink by utilizing the thermal energy applied by the electrical resistor, e.g., by utilizing film boiling.

1-2 (Carriage)

The carriage 82 includes, as shown in FIG. 1, a tank portion 81*a* for accommodating ink. The tank portion 81*a* is provided with a respective accommodating portions, each partitioned by a partition wall, in which four color inks of, e.g., yellow, cyan, magenta and black are contained. The carriage 82 further includes an ink supply path for supplying the inks from the respective accommodating portions to the recording head 81. Through the ink supply path, the respective accommodating portions communicate with the recording head 81. The carriage 82 further includes a sliding portion movably supported by the moving mechanism 80. One end of the carriage 82 is engaged with a timing belt 86, described later of the moving mechanism 80.

1-3 (Moving Mechanism)

As shown in FIG. 1, the moving mechanism 80 includes a carriage motor 84 for causing the carriage 82 to scan in a direction of an arrow in FIG. 1, a carriage pulley 85 rotationally driven by the carriage moor 84, a timing belt 86 driven by the carriage pulley 85, and an unshown supporting pulley for supporting the timing belt 86 so as to be freely driven.

The carriage motor 84 is fixed by secured to a chassis 83, and the carriage pulley 85 is fixed to a rotating pulley 85 and the supporting pulley are respectively provided with a gear portion (not shown) to be engaged with the timing belt 86, and is rotatably supported through a spindle fixed to the chassis 83.

The timing belt 86 is provided with the gear portion at its inner peripheral surface, and the gear portion is engaged with the gear portion of the carriage pulley 85 so that the timing belt extends over the carriage pulley 85 and the supporting pulley. Further, the timing belt 86 is engaged with one end portion of the carriage 82 and is integrally moved together with the carriage 82. further, the chassis 83 is provided with a guide rail 83*a*, for movably supporting the carriage 82 in the direction of the arrow X, with which the sliding portion of the carriage 82 is engaged.

The thus constituted moving mechanism 80 rotates the carriage pulley 85 by driving rotationally the carriage motor 84, and drives the timing belt 86 by the rotation of the carriage pulley 85. By driving the timing belt 86, the carriage 82 is moved to the arrow X direction, thereby to move the recording head 81 in its main scanning direction to effect recording.

2 (Feeding Portion)

The feeding portion 4 includes a sheet stacking (holding) portion 6 on which a plurality of sheets 2 are stacked, a separation/feeding mechanism 7 for separating the sheets 2 from the sheet stacking portion 6 one by one, and a driving mechanism 8 for driving the separation feeding mechanism.

2-1 (Sheet Stacking Portion)

The sheet stacking portion 6 includes a base 15 and a pressure plate 16 rotatably mounted to the base 15, and the plurality of sheets 2 are stacked on the pressure plate 16. The pressure plate 16 is attached to the base 15 so that it forms an inclined surface with respect to an apparatus mounting horizontal surface. Accordingly, the sheets 2 stacked on the sheet stacking portion 6 is in an inclined state, so that the sheets 2 are supplied with a force downwardly by gravity. As a result, a leading end of the sheets 2 abuts obliquely against a sheet leading end alignment reference portion 15*a*. By such an oblique stacking of the sheets, it is possible to reduce not only a mounting area of the sheet stacking portion 6 but also the size of the entire recording apparatus. Incidentally, in this embodiment, the sheet leading end alignment reference portion 15*a* is made up of a plurality of parallel ribs in order to reduce a load at the time of sheet feeding.

On the pressure plate 16, a sheet conveyance reference portion 16*b* for regulating one of two sides of the stacked sheets 2 is disposed so as to project from the pressure plate, and a side guide 18 is disposed for regulating the other side of the sheets 2. The side guide 18 is slidably attached to the pressure plate 16 a widthwise direction of the sheets 2, i.e., a direction of an arrow X shown in FIG. 2, perpendicular to the conveyance direction of the sheets 2, i.e., a direction of an arrow Y shown in FIG. 2. As a result, in combination with the sheet conveyance reference portion 16*b*, the side guide 18 is disposed so that they can regulate both sides of the sheets having an arbitrary width within a predetermined range.

The pressure plate 16 has a rotation center R at its upper end portion, and is pressed against the feed roller 11 by a pressure plate spring 17 as shown in FIGS. 3 and 4 and, at the same time, regulated by a control cam 34 constituting the driving mechanism 8 described later. More specifically, the pressure plate 16 is rotationally pressed toward the feed roller 11 by the pressure plate spring 17 when the regulation of the control cam 34 is removed, and is forced to pivot in the direction to move away from the feed roller 11. This operation of the pressure plate 16 will be described hereinafter in detail.

Further, the rotation center R of the pressure plate 16 is, as shown in FIGS. 3 and 7, disposed at a position away from the sheet stacking surface by a height H1 in a substantially vertical direction with respect to the sheet stacking surface. The height H1 of the rotation center R is set to satisfy the following relationship: $H1 \geqq H0 \times (1/2)$, wherein H0 represents a height of maximum sheet stacking surface of the pressure plate 16. In other wards, the rotation center R of the pressure plate 16 is located at a height H1 which is not less than approximately half of the height H0 of the maximum sheet stacking surface. In this embodiment, the height H1 is set to be about 11 mm.

By disposing the rotation center R at such a height H1, as shown in FIG. 7, the position of a contact point where the lower end of the pressure plate 16 contacts the feed roller 11 is deviated toward the downstream side of the conveyance direction of the sheet 2. For this reason, the pressure plate 16 can set a smaller angle $\alpha 1$ of approach formed between a sheet feeding direction that the sheet 2 enters the feed roller 11 and an extension direction of the sheet stacking surface. Further, the pressure plate 16 is prevented from largely changing a gap between its lower end and the sheet leading end alignment reference portion 15*a* when the lower end of the pressure plate 16 is moved in a direction closer to the feed roller 11, thus being capable of stably feeding the sheets 2.

Figure 33:
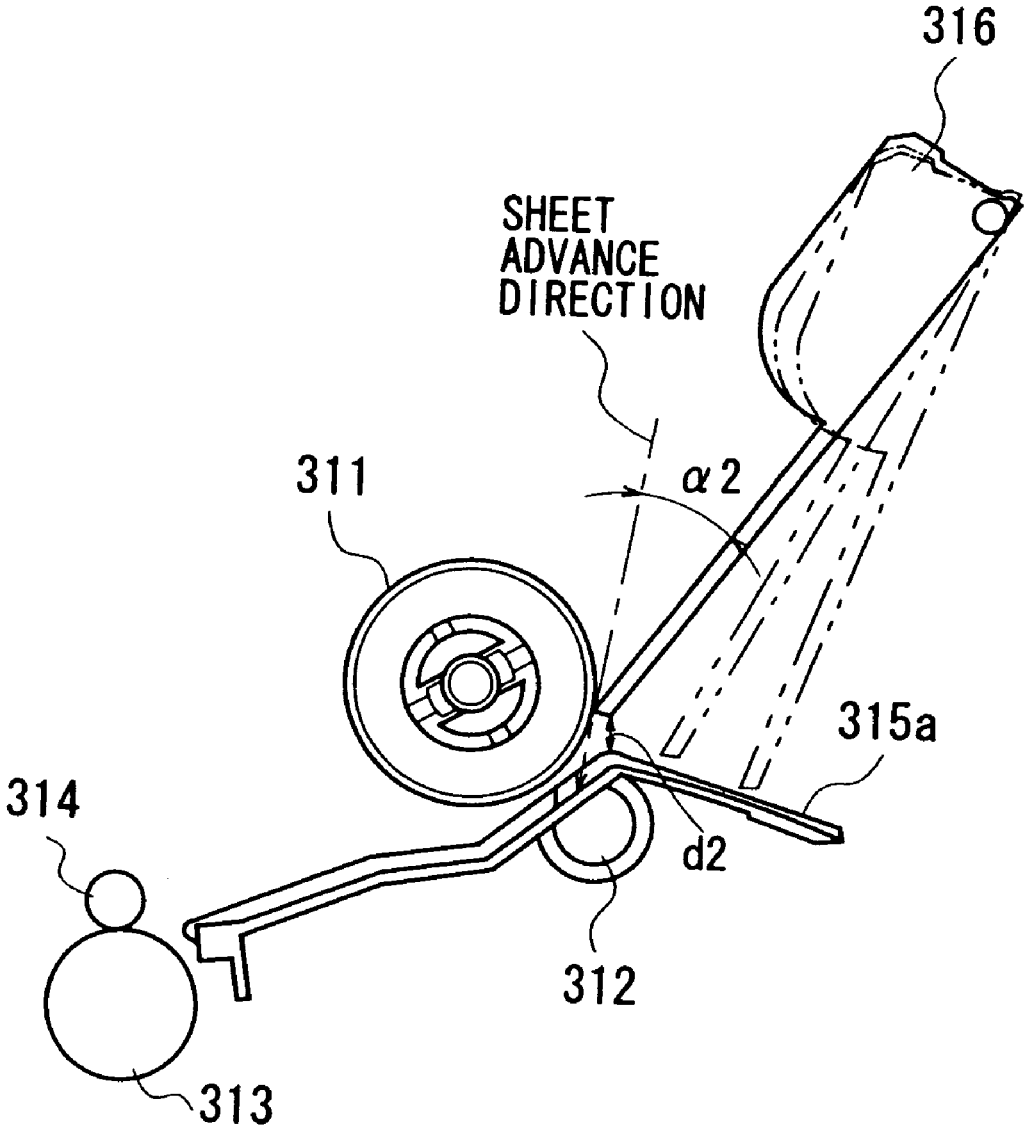
FIG. 33 PRIOR ART
FIG. 33 is a schematic view showing a conventional retarding roller-type separating and feeding mechanism.

When a positional relationship between the pressure plate 16 and the feed roller 11 in this embodiment shown in FIG. 7 is compared with that between the pressure plate 116 and the feed roller 111 of the conventional feeding apparatus shown in FIG. 33 illustrated at the same scale as FIG. 7, it is clear that there are differences therebetween in terms of the abutting position of the pressure plate 16 to the feed roller 11, the approach angle $\alpha 1$ of the sheet 2, an the gap d1 between the lower end portion of the pressure plate 11 and the sheet leading end alignment reference portion 15*a*. More specifically, the feeding portion 4 in this embodiment satisfies the relationships: $\alpha 1 > \alpha 2$ and $d1 > d2$ when compared with the conventional feeding apparatus, thus remarkably reduce the sheet approach angle $\alpha 1$ and the gap d1 of the pressure plate lower end portion with the sheet leading end alignment reference portion. These results are move effectively attained in the case where the full (total) length of the pressure plate 16 is relatively short and the outer diameter of the feed roller 11 is relatively small. The feeding portion 4 in this embodiment is designed so that the pressure plate 16 has a full length of about 90 mm and the feed roller 11 has a relatively small outer diameter of about 30 mm, thus sufficiently achieving the above-mentioned results.

2-2 (Separation/Feeding Mechanism)

Next, the structure of the separation/feeding mechanism 7 will be described. The separation/feeding mechanism 7 includes the feed roller 11 for feeding the sheets 2 stacked on the sheet stacking portion 6, a separation roller 12 for separating the sheets 2 fed by the feed roller 11 one by one by contacting to the sheets 2, a returning lever 13 of returning the sheets 2 to the sheet stacking portion 6, and a preliminary regulation portion 22*a* as a preliminary regulating member for regulating the number of sheets 2 which reaches a separation portion.

The feed roller 11 is, as described above, pressed against the stack of the sheets which are under the pressure generated by the pressure plate 16 and rotationally driven to feed the topmost sheet 2 of the stacked sheets 2 by frictional force, so that the feed roller 11 may preferably be formed of a rubber such as EPDM (ethylenepropyleneterpolymer) having a relatively high coefficient of friction, urethane foam, etc.

The feed roller 11 is provided with a feeding shaft which is rotatably supported by a bearing 27 and is provided a feed roller gear 19 at one end thereof. To the feed roller gear 19, a driving force is transmitted from a driving power source described later. The feed roller gear 19 is engaged with a control gear 24 described later. To the control gear 24, in addition to the driving force inputted into the feed roller (shaft) gear 19, another driving force is independently transmitted from an unshown driving force transmission means.

The separation roller 12 as separation means feeds the sheets 2 one by one by separating the sheets 2 when the plurality of sheets 2 enter the nip portion between the feed roller 11 and the separation roller 12.

Generally, the frictional force between the feed roller 11 an the topmost sheet 2 is larger than that the topmost sheet 2 and a sheet 2 immediately under the topmost sheet 2 in many cases, so that only the topmost sheet 2 is advanced. However, there are times when two or more sheets 2 are pulled out at the same time by the feed roller 111. This phenomenon occurs, for example, when two or more sheets 2, the edges of which have been burred while they were cut, are pressed against the feed roller 11, when two or more sheets 2 adhering to each other due to the presence of static electricity are pressed against the feed roller 11, or when two or more sheets 2 which are very large in coefficient of friction, are pressed against the feed roller 11.

As shown in FIG. 4, the separation roller 12 is kept pressed on the feed roller 11 so that it contacts the feed roller 11, on the downstream side with respect to the point at which a sheet 2 comes into contact with the feed roller 11 for the first time, in terms of the sheet conveyance direction. The surface of the separation roller 12 is formed of a rubber, urethane foam, etc., so as to have a coefficient of friction which substantially equal to that of the feed roller 11.

Herein, referring to FIGS. 5 and 6, the structure of the separation roller 12 will be described. As shown in FIG. 5, the separation roller 12 is fixed to a clutch cylinder 12*a*, in which a clutch shaft 12*b* is rotatably held, with a clutch spring 12*c* tightly wound around the clutch shaft 12*b*, as shown in FIG. 6. The one end of the clutch spring 12*c* is anchored to the clutch cylinder 12*a*. The clutch spring 12*c* is formed of a metal coil spring. The clutch shaft 12*b* is constituted by a molded member. A gear portion 12*d* is integrally formed at one end of the clutch shaft 12*b*.

With the provision of the above described structural arrangement, as the separation roller 12 and clutch cylinder 12*a* are rotated in the direction indicated by an arrow in FIG. 6(*a*), without allowing the clutch shaft 12*b* to rotate, the clutch spring 12*c* fitted around the clutch shaft 12*b* is unwound in the direction to be loosened from the clutch shaft 12*b*. Thus, as the separation roller 12 and clutch cylinder 12*a* are rotated at a certain angle (predetermined angle), the clutch spring 12*c* loses its grip on the clutch shaft 12*b*, and rotates around the clutch shaft 12*b*. In other words, the above described structural arrangement provides a predetermined amount of braking torque.

In this embodiment, it becomes possible to effect on-off control of the torque limiter by performing the fixation of the clutch shaft 12*b* and release of the fixation. As a separation force switching mean for switching generation of a separating force of the separation roller 12 and removal of the separating force, a release cam 28 and a lock lever 23 are provided as described later. The separation roller 12 is rotatably supported by a separation roller holder 21, that is, a sheet separating means holding member, with the interposition of clutch cylinder 12*a* and clutch shaft 12*b*. It is kept pressed on the feed roller 11 by a separation roller spring 26. The separation roller holder 21 is provided with the separation roller 12 and the lock lever 23 which are rotatably attached to the separation roller holder around the rotation center 21*a*.

According to the above structured separation/feeding mechanism 7, when there is no sheet 2 between the feed roller 11 and separation roller 12, the separation roller 12 is rotated by the rotation of the feed roller 11, as shown in FIG. 8(*a*).

The friction between the feed roller 11 and the sheet 2, and the friction between the sheet 2 and separation roller 12, are greater than the braking torque of the torque limiter of the separation roller 12. Therefore, as shown in FIG. 8(*b*), when a single sheet enters between the feed roller 11 and separation roller 12, the sheet is advanced by the feed roller 11 while rotating the separation roller 12. However, as two sheets enter between the feed roller 11 and separation roller 12, the friction between the feed roller 11 and the sheet 2 next to the feed roller 11 is greater than the friction between the two sheets 2, and the friction between the sheet next to the separation roller 12 is greater than the friction between the two sheets 2. Therefore, as the feed roller 11 is rotated, the sheet next to the feed roller 11 slides on the sheet next to the separation roller 12. As a result, as shown in FIGS. 8(*c*) and 8(*d*), only the sheet next to the feed roller 11 is advanced by the feed roller 11, while the sheet next to the separation roller 12 remains with the separation roller 12, which remains stationary. For this reason, in addition to the separation roller 12, the separation/feeding mechanism 7 is provided with a returning lever 13 for preventing double feeding, i.e., preventing two or more recording sheets from being fed into the recording apparatus all at once. More specifically, as described above, when two sheets 2 enter the nipping portion between the feed roller 11 and separation roller 12, they can be separated. However, sometimes, three or more sheets 2 enter between the feed roller 11 and separation roller 12, or one or more sheets enter between the feed roller 11 and separation roller 12 while the bottom sheet 2, that is, the sheet 2 next to the separation roller 12, of the two sheets 2 having entered between the feed roller 11 and separation roller 12 during the preceding rotation of the feed roller 11 is still in the adjacencies of the nipping portion between the feed roller 11 and 12 after the first sheet, that is, the sheet next to the feed roller 11, has been successfully fed. In these cases, it is possible that two or more sheets 2 are fed into the recording apparatus all at once. In order to prevent this accident, the sheet feeding apparatus is provided with the returning lever 13 for preventing this accident. In the recording apparatus in this embodiment, the returning lever 13 prevents the leading end of a recording sheet from accidentally entering beyond a predetermined point in a sheet feeding apparatus, by being moved into the sheet path while sheets 2 are placed in the sheet stacking portion, or while the recording apparatus is on standby. The sheet returning lever 13 is pulled out of the sheet conveyance path immediately after the beginning of a sheet feeding operation, and is kept out of the sheet conveyance path during the sheet feeding operation. Thus, the sheet returning lever 13 does not interfere with the advance of a sheet 2.

As soon as a sheet separating operation ends, the (sheet) returning lever 13 is made to begin to return the subsequent sheets 2 in the separation nip.

After returning the sheets 2, the returning lever 13 is once rotated out of the sheet conveyance path. Then, it is moved to the standby position after it is confirmed that the trailing end of the sheet 2 has passed the recording apparatus 1.

As shown in FIG. 8(*b*), the preliminary regulation portion 22*a* forms a nip with the feed roller 11 at a position upstream from the separation portion, so that the number of sheets 2 entering the separation portion is regulated to be several sheets. The preliminary regulation portion 22*a* is provided to a preregulation member holder 22 which is attached to the base 15 so that it is rotatable about the rotation center 21*a* about which the separation roller holder 21 is also rotatable. The preregulation member holder 22 is pressed by a preregulation member holder spring 33, and is located so that a part thereof is stroked against the base 15.

Further, the separation/feeding mechanism 7 is, as shown in FIGS. 4 and 8(*a*), provided with the release cam for rotating the lock lever 24, the separation roller holder 21 and the preregulation member holder 22, respectively. The release cam 28 includes a preregulation member holder working portion 28*a*, a separation roller working portion 28*b* and a lock lever working portion 28*c*.

[Recording Portion]

The structure of the recording portion 3 will be described.

In the recording portion 3, the sheet 20 is sandwiched between a conveyance roller 30 as sheet conveyance means and a pinch roller 29 and between a discharge roller 31 and a spur-shaped wheel 32, and is conveyed intermittently in a sub-scanning direction. A plurality in a sub-scanning direction. A plurality of pinch rollers 29 are attached to a pinch roller holder 25 which presses the pinch rollers 29 against the conveyance roller 30 by an unshown pressing means. The conveyance roller 30 has a larger holding (pressing) force of sheet than the discharge roller 31, thus dominating an amount of sheet conveyance. The discharge roller 31 imparts a tension to the sheet 20 by increasing a sheet feeding amount compared with conveyance roller 30.

The recording head 81 is slidable along the chassis 83 in the main scanning direction (perpendicular to the sheet conveyance direction) and records an image having a predetermined width (a width of nozzle of the recording head) by ejecting ink droplet toward the sheet 2 while being moved. By alternately repeating the intermittent conveyance by the conveyance roller 30 and the image recording at the predetermined width by the recording head 81, an image is recorded on the entire sheet 2.

[Operation of Sheet Feeding Apparatus]

The separation/feeding and conveyance operations of sheets in the sheet feeding apparatus of the recording apparatus having the above-mentioned structure.

FIG. 17 is a timing chart for explaining the operations of the sheet feeding apparatus and FIGS. 8(*a*) to 8(*d*) are views for explaining the operations of the sheet feeding apparatus.

FIG. 17 illustrates positions of the pressure plate 16, the returning leer 13 and the separation roller 12, and a state of the torque limiter of the separation roller 12. Further, the horizontal axis in FIG. 7 represents a rotation angle (angular phase) of a control gear 24.

(Standby State)

In FIG. 17, the angle of 0 deg. of the control gear 24 represents a standby state. In the standby state, as shown in FIGS. 17 and 8(*a*), the pressure plate 16 is held at a position apart from the feed roller 11 having a circular cross-section, so that a sufficient spacing for stacking the plurality of sheets 20 is ensured between the feed roller 11 and the pressure plate 16. The feed roller 11 and is capable of generating a torque. The torque generable state of the separation roller 12 is created by, as shown in FIG. 8(*a*), fitting a tip of the lock lever 23 into a gear portion 12*d* provided to the clutch shaft 12*b* at its end.

The sheets 20 are on standby in such a state that they are supported by the sheet leading end alignment reference portion 15*a* at their leading end and also supported by the pressure plate 16 at their rear surface.

(Separating Operation)

A process from the start of sheet feeding to deliver the sheets 20 to the recording portion will be described based on the rotation angle of the control gear 24. The feeding operation of the sheet feeding apparatus according to the present invention is classified into two operations including the separating operation and the conveying operation. First, the separating operation will be described.

The separation operation is shown by angles θ1 to θ5 of the control gear 24 in FIG. 17 and shown in FIGS. 8(*b*) and 8(*c*). Referring to these figures, the sheet feeding is started and, when the feed roller 11 starts to rotate in a direction of an arrow K shown in FIG. 8(*b*), the separation roller 12 is driven by the rotation of the feed roller 11, so that a torque of the clutch spring 12*c* in the separation roller 12 is increased to a predetermined value. When the control gear 24 is rotated up to the angle θ1 shown in FIG. 17 by the rotation of the feed roller 11, the returning lever 13 is placed in an open state as shown in FIG. 8(*b*) by the action of an unshown control cam provided to the control gear 24 to ensure the sheet conveyance path. Transmission of the driving force to the control gear 24 is performed by an unshown driving power source via a feeding shaft gear 19.

When the control gear 24 is further rotated up to the angle θ2 shown in FIG. 17, by the action of the unshown control cam provided to the control gear 24, fixation of the pressure plate 16 is released and the tacked sheets 20 are pressed toward the feed roller 11 direction. When the topmost sheet contacts the feed roller 11 and the feed roller 11 is rotated, the sheet feeding is started.

At this time, by the friction between the sheets, a plurality of sheets including not only the topmost sheet but also subsequent sheet(s) under the topmost sheets are fed in some cases. At that time, by the action of the spacing forward between the preliminary regulation portion 22*a* and the feed roller 11, the number of sheets passing through the spacing is first regulated to be several sheets.

When the sheet feeding is further continued, the plurality of sheets reaches the separation portion comprising the nip between the feed roller 11 and the separation roller 12. Even if the separation roller 12 is tried to be rotated with the advance of the sheets in the counterclockwise direction in such a state that the lock lever 23 is fitted into the clutch shaft 12*b* as shown in FIG. 8(*b*), the clutch cylinder 12*a* (FIG. 5) is rotated but the rotation of the clutch shaft 12*b* is blocked by the lock lever 23. As a result, by the action of the above-mentioned clutch spring 12*c*, a torque required for separating the sheets 20 is generated, thus separating the sheets 20.

When the control gear 24 is rotated up to the angle θ3 shown in FIG. 17, the spacing operation of the pressure plate 16 is stated and substantially at the same time, the returning lever 13 also starts to rotate toward the double feeding preventing position.

When the control gear 24 is rotated up to the angle θ4, by the action of the unshown control cam provided to the control gear 24, the release cam 28 is rotated in a direction of an arrow L shown in FIG. 8(*c*), so that the preregulation member holder working surface 28*a* firstly starts to contact the preregulation member holder 22, thus rotating the holder 22 in a direction of an arrow P shown in FIG. 8(*c*).

The preliminary regulation portion 22*a*regulates the entrance of the sheets 20 into the separating portion until then, so that a plurality of sheets 20 enter the gap formed between the feed roller 11 and the preliminary regulation portion 22*a* in some cases, thus sometimes requiring a large force at the time of returning the sheets 20 by the returning lever 13 due to the nipping force at the gap. In order to remove the force, in the present invention, an operation such that the preliminary regulation portion 22*a* is moved toward a direction apart from the feed roller 11 to enlarge the gap is performed. By the operation for removing the sheet nipping force, it becomes possible to reduce a force required for the subsequent sheet returning operation by the returning lever 13.

On the other hand, by the action of the unshown control cam provided to the control gear 24, the tip of the returning leer 13 passes through the nip between the feed roller 11 and the separation roller 12 to start the returning operation of the subsequent sheets located at the separation nip to the sheet stacking portion 1. Immediately thereafter, the release cam is further rotated in a direction of an arrow L shown in FIG. 8(*c*) by the action of the unshown control cam, so that the separation roller holder working surface 28*b* starts to contact the separation roller holder 21, thus rotating the separation roller holder 21, thus rotating the separation roller holder 21 including the separation roller 12 in a direction of an arrow P shown in FIG. 8(*c*).

More specifically, when the sheet returning operation is performed by the returning lever 13, firstly, the regulation effect of the preliminary regulation portion 22*a* is removed and then the separation roller holder 21 is released at the time when the tip of the returning lever 13 passes through the nip. That is, the returning operation is performed in a state that all the mechanism portions which are capable of being resistive members to the returning operation are released. As a result, it is possible to apply a minimum separating force for sheet separation, so that the returning lever 13 can also be readily actuated by a smaller force. Thereafter, all the leading ends of the sheets except for the currently feeding sheet is conveyed back to the sheet leading end alignment reference portion 15*a* in the opposite direction.

Then, the sheet feeding operation further proceeds and during the control gear 24 is rotated up to the angle θ5 shown in FIG. 17, the pressure plate 16 is moved away from the feed roller 11 and then is returned to the same position as the standby state. Then, when the control gear 24 is rotated up to the angle θ5, the sheet returning operation is almost completed and the release cam 28 is rotated in the direction of an arrow M shown in FIG. 8(*c*) by the action of the unshown control cam provided to the control gear 24, so that the preregulation member holder 22 and the separation roller holder 21 which have been released by the release cam 28 are rotated in a direction of an arrow Q shown in FIG. 8(*c*) to be returned to their original positions before the releasing operation, respectively.

After the completion of the sheet returning operation, the returning lever 13 is not moved to the original standby position but moved to a position where the returning lever 13 is further rotated. As a result, it becomes possible to prevent a phenomenon that the returning lever 13 contacts to accidentally apply a resistive force to the sheets. Consequently, good recording results are achieved. As described above, the separating operation is performed. However, at this stage, the sheet 20 is not yet delivered to the recording portion 3.

(Conveying Operation)

Next, the conveying operation will be described.

The angle θ6 and θ7 shown in FIG. 17 and FIG. 8(*d*) are to illustrate the conveying operation.

WHen the control gar 24 is rotated up to the angle θ6 shown in FIG. 17, the release cam 28 is rotated in the direction of an arrow M shown in FIG. 8(*d*) by the action of the unshown control cam provided to the control gear 24, so that firstly a lock lever working surface 28*c* contacts the lock lever 28 to rotate the lock lever 28 in a direction of an arrow R shown in FIG. 8(*d*). As a result, the tip of the lock lever 28 which has been fitted into the gear portion of the clutch shaft 12*b* up to that time, is released from the gear portion, thus allowing free rotation of the clutch shaft 12*b*.

In such a state that the clutch shaft 12*b* can rotate freely, a releasing force for releasing the clutch spring 12*c* is not generated even if the separation roller 12 and the clutch shaft 12*a* are rotated, so that the clutch shaft 12*a* loses its function as the torque limiter. For this reason, the separation roller 12 is changed to a roller which is rotated with no torque by the rotation of the feed roller 11.

When the control gear 24 is rotated up to the angle θ7 shown in FIG. 17 by further rotating the feed roller 11, i this embodiment, an unshown tooth-less portion provided to a gear portion of the control gar 24 is located at a position opposite to a feeding shaft gear 19, so that engagement of the feeding shaft gear 19 connected to a feeding shaft 10 provided with the feed roller 11, with the gears of the control gear 24 are out of mesh. As a result, a driving force is transmitted from the driving power supply to the feeding shaft gear 19, a rotating force is transmitted to the feed roller 11 connected to the feeding shaft gear 19, thus allowing the sheet conveyance. However, the driving force is not transmitted to the control gear 24, so that the mechanism portions such as the returning lever 13 and the pressure plate 16 are not actuated at all from that time on.

More specifically, during a period from the start of conveyance operation to the transmission of the driving force to the feeding shaft gear 19, the sheet feeding apparatus is designed to permit the sheet conveyance operation. As a result, a sheet conveyance length by the sheet feeding apparatus becomes actually infinite, thus achieving an effect of arbitrarily setting a distance between the separation/feeding portion 2 and the recording portion 3. Accordingly, if the outer diameter of the feed roller 11 is set to be smaller, it is possible to realize size reduction of the sheet feeding apparatus and the recording apparatus in combination. As described above, the conveying operation is performed.

(Operations After Sheet Feeding)

In this embodiment, after the feeding operation is completed and the leading end of the sheet is delivered to the recording portion 3 while being sandwiched between the conveyance roller 30 and the pinch roller 29. At the same time, the driving force transmission from the driving power supply to the feeding shaft gear 19 is interrupted, the feeding shaft 10, to which the feeding shaft gear 19 is connected, and the feed roller 11 are changed to rollers which are freely rotated.

Accordingly, during a period in which the recording on the sheet is performed by the recording portion 3, the feed roller 11 is moved with the advance of the sheet subjected to recording and does not trail the gear train, so that the feed roller 11 does not impact an undesired resistive force to the sheet in the recording operation. Similarly, the separation roller 12 abutting the feed roller 11 also functions as the roller which is rotated by the rotation of the feed roller 11 as described above, so that it does not apply an undesired load on the sheet on recording.

Substantially simultaneous with the sheet discharge operation by the discharge roller 31 and the spur-shaped wheel 32, when the control gear 24 is rotated independently by an unshown driving means up to the angle θ8, the returning lever 13 enters again the sheet conveyance path to prevent the leading end of the sheets 20 from falling into the separation portion. Further, by the action of the unshown control cam, the release cam is rotated in a direction of an arrow L shown in FIG. 8(*d*) to fit the tip of the returning lever 13 into the gear portion of the clutch shaft 12*b*, thus placing all the mechanism portions in their standby positions in the initial states.

At that time, the feeding shaft gear 19 and the gears of the control gear 24 are again returned to a meshed state, so that they are in a state capable of starting the sheet feeding operation if they receives a next sheet feeding instruction. As described above, the operations of the sheet feeding apparatus of the present invention are performed.

The sheet feeding apparatus of the present invention are, as described above, provided with the feed roller 11 as a feeding means, the separation roller 12 as a separating means, the returning lever 13 as a returning means, and the release cam and the lock lever as a separating force switching means. Further, in the sheet feeding apparatus, a separating state in which a separating force for separating the sheets is generated by the separating means and a conveying state in which the separating force is removed, are switcheable. More specifically, the separating force is removed from the separation roller 12 without moving the separation roller 12 away from the feed roller 11, and the separation roller 12 is driven by rotation of the feed roller 11 to allow the conveying state in which conveyance by the feed roller 11 is performed. As a result, it becomes possible to impart a required minimum sheet separating force to the sheets, thus reducing feeding failure or frictional flaw of the sheets.

The above-mentioned separating and conveying states may also mean generation and removal states, respectively, of the separating force of the separation roller 12. On the other hand, the feeding operation by the sheet feeding apparatus as a whole may be classified into two operations including the separating operation and the conveying operation as described above. In this regard, the separating operation means an operation such that the separation roller 12 is placed in the conveyance state, moved away from the feed roller 11 and the operation of the returning lever 13 as the returning means is completed. Accordingly, in the above explanation, although the separating means is capable of switching between the separating state and the conveying state during the feeding operation, it is also possible to say that the separating and conveying states are switchable during the separating operation.

Further, in the case of adopting a separation roller provided with a torque limiter-type separation scheme, it becomes possible to suppress wear of the clutch shaft incorporated in the torque limiter, so that the metal shaft is not required to reduce production costs. Further, it is also possible to reduce a conveyance load applied on the sheet on recording to improve a conveyance accuracy.

When the sheet feeding apparatus is provided with the separation roller holder 21 as the separating means support member and the preliminary regulation portion 22*a* as the preregulation member, and the returning means is achieved, the separating means and the preregulation member held by the separation means support member are moved away from the feeding means to reduce an operating force at the time of returning the sheets to the sheet stacking (holding) portion by the returning means.

Further, when the separating means support member and the preregulation member are designed to be independently actuated and then the returning means is actuated, by moving the preregulation member away from the feeding means before the separating means held by the separating means support member is moved away from the feeding means, it becomes possible to reduce the operating force at the time of returning the sheets to the sheet stacking portion by the returning means while preventing the double feeding of sheets with reliability.

Further, as described above, during the separating operation up to the completion of the returning operation by the returning lever 13, the spacing operation of the separating means and the preregulation member is performed, thus ensuring the reduction in operating force described above.

After the sheet reaches the recording portion, the driving force or the separating fore is removed from both the feeding means and the separating means, whereby an undesired resistive force is applied to the sheet on recording even when the feeding means is designed to have a full circular cross-section. Accordingly, it becomes possible to arbitrarily set a conveyance possible length from the separation/feeding portion to the recording portion irrespective of the outer shape of the feeding means, so that a size reduction of the sheet feeding apparatus is realized and the sheet feeding apparatus is also improved in versatility.

Further, the separating means is constituted by the separation roller provided with the torque limiter, whereby the separation of the sheets can be performed with high reliability and it becomes possible to set an arbitrary conveyance length without adopting a complicated structure. In addition, the shaft constituting the torque limiter of the separation roller is formed in a molded shaft, thus reducing costs of parts constituting the separating portion.

Further, it is possible to simplify the driving mechanism and control by designing the driving mechanism so as to allow switching between the separating operation and the conveying operation by unidirectional rotation of the driving power supply.

The sheet feeding apparatus of the present invention is provided with the rotatable pressure plate for pressing the sheets against the feeding means and the rotation center of the pressure plate is located at a position higher than almost half of the maximum sheet stacking surface of the pressure plate, whereby it becomes possible to set an optimum sheet conveyance angle even if the sheet feeding apparatus is provided with a shorter pressure plate. Further, a gap between the pressure plate and the sheet leading end alignment reference portion is kept appropriate.

On the sheet stacking potion, the sheets are obliquely stacked with respect to the apparatus horizontal surface, whereby the sheet feeding apparatus can be downsized.

2-3 (Driving Mechanism)

The driving mechanism 8 for driving the feeding portion (means) 4 will be described.

Figure 9:
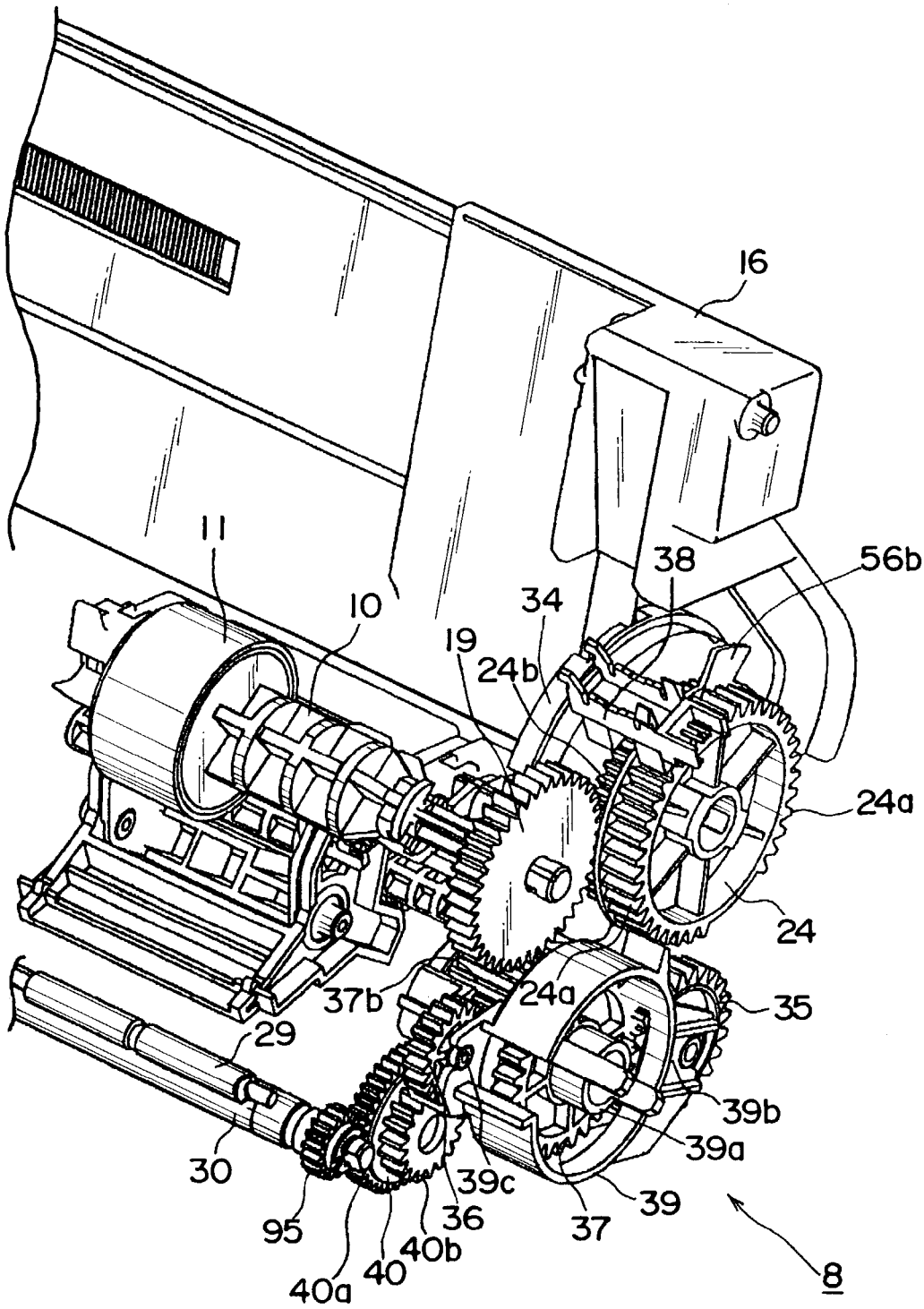
FIG. 9 is a partly exploded perspective view for illustrating a drive mechanism.
Figure 10:
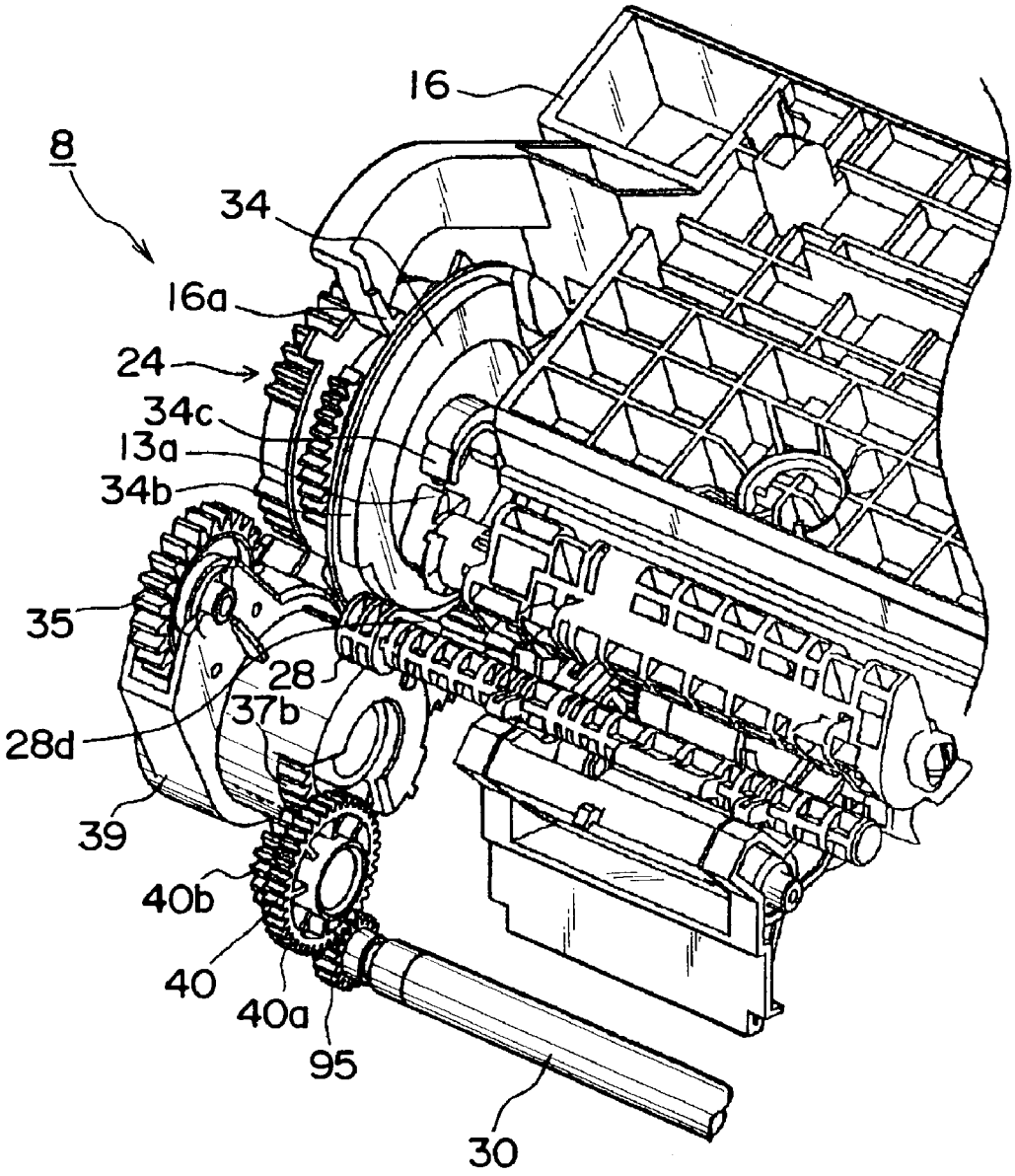
FIG. 10 is a partly exploded perspective view for illustrating the drive mechanism as viewed rom its rear side.
Figure 11:
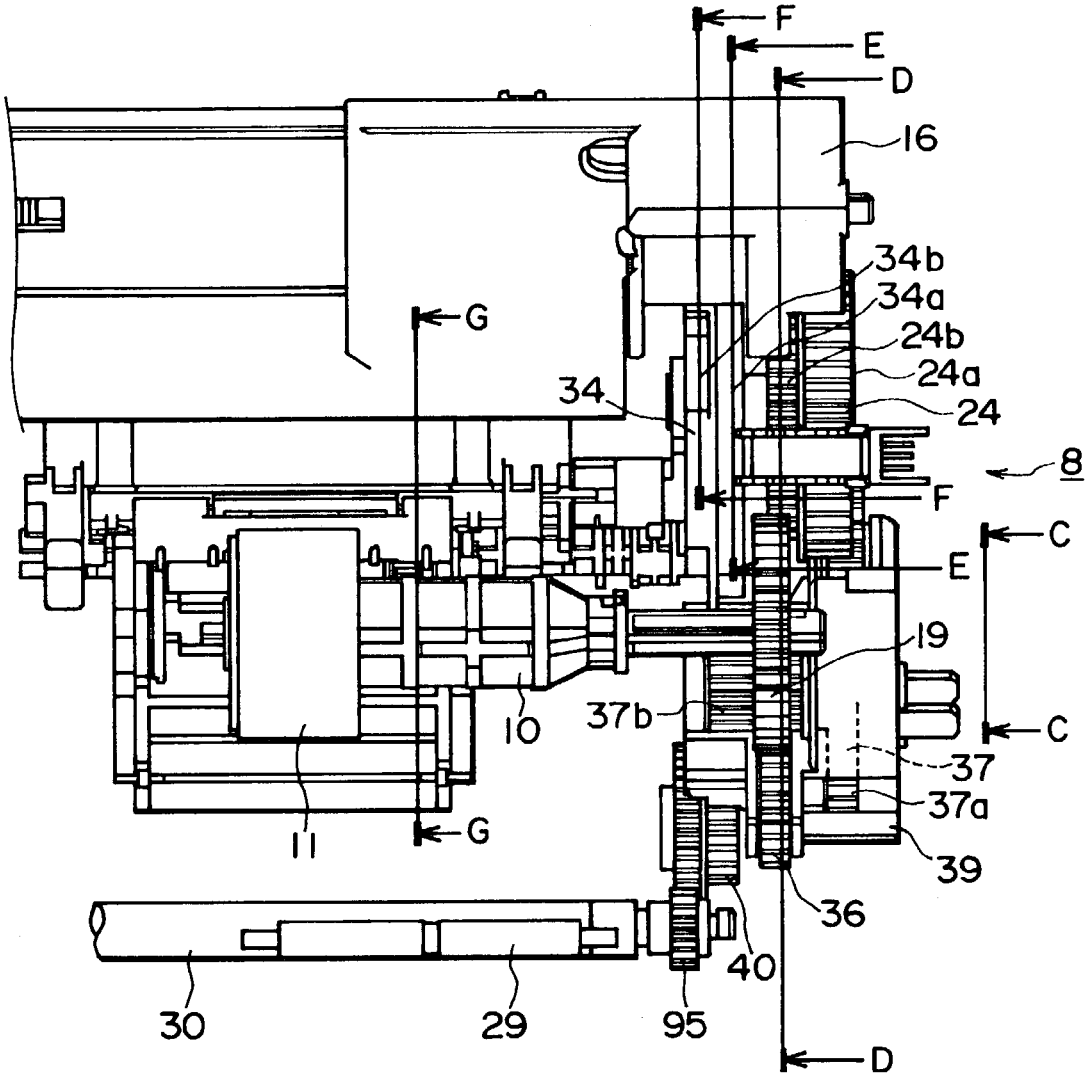
FIG. 11 is a plan view showing the drive mechanism.
Figure 12:
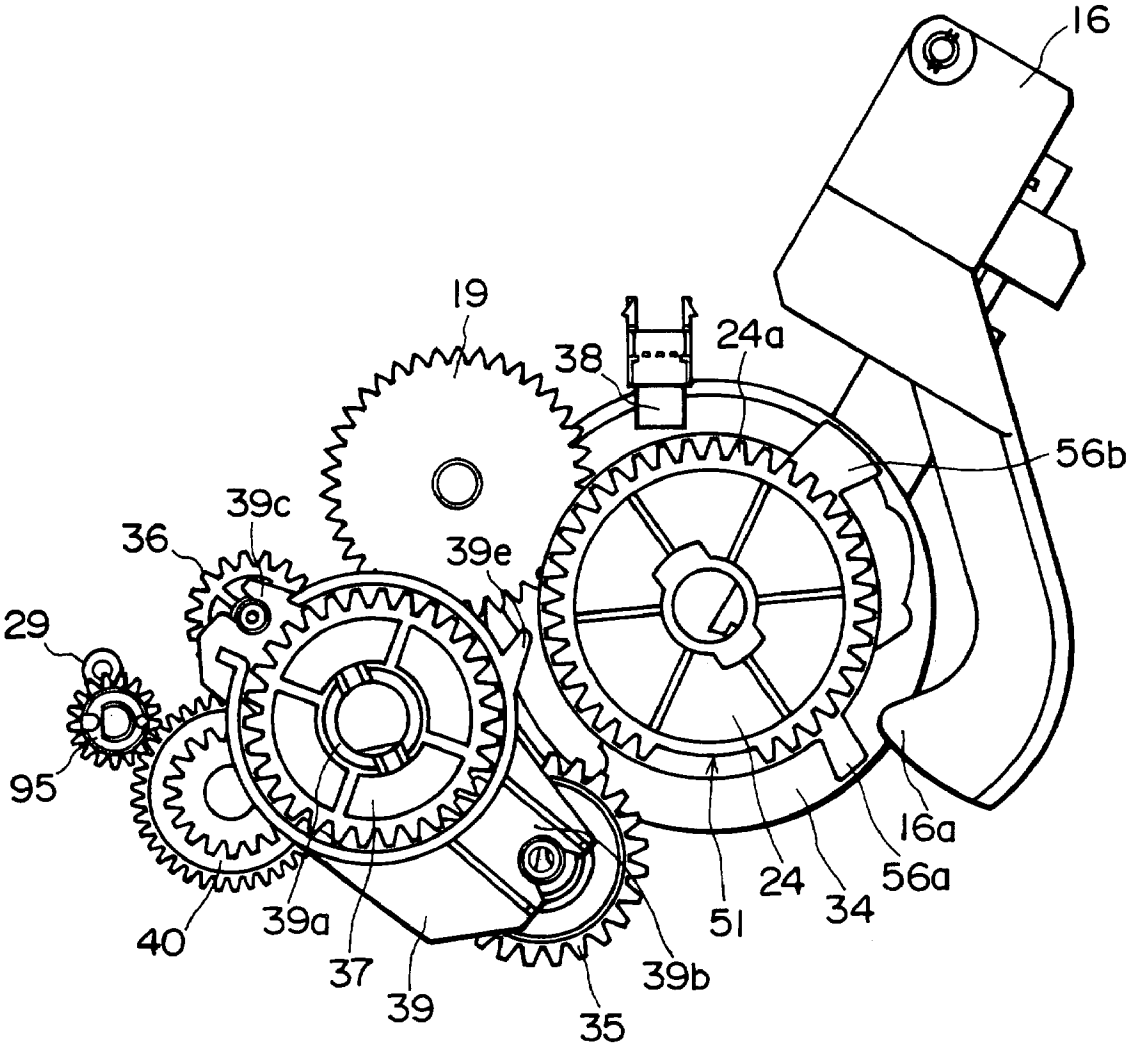
FIG. 12 is a side view showing the drive mechanism.
Figure 13:
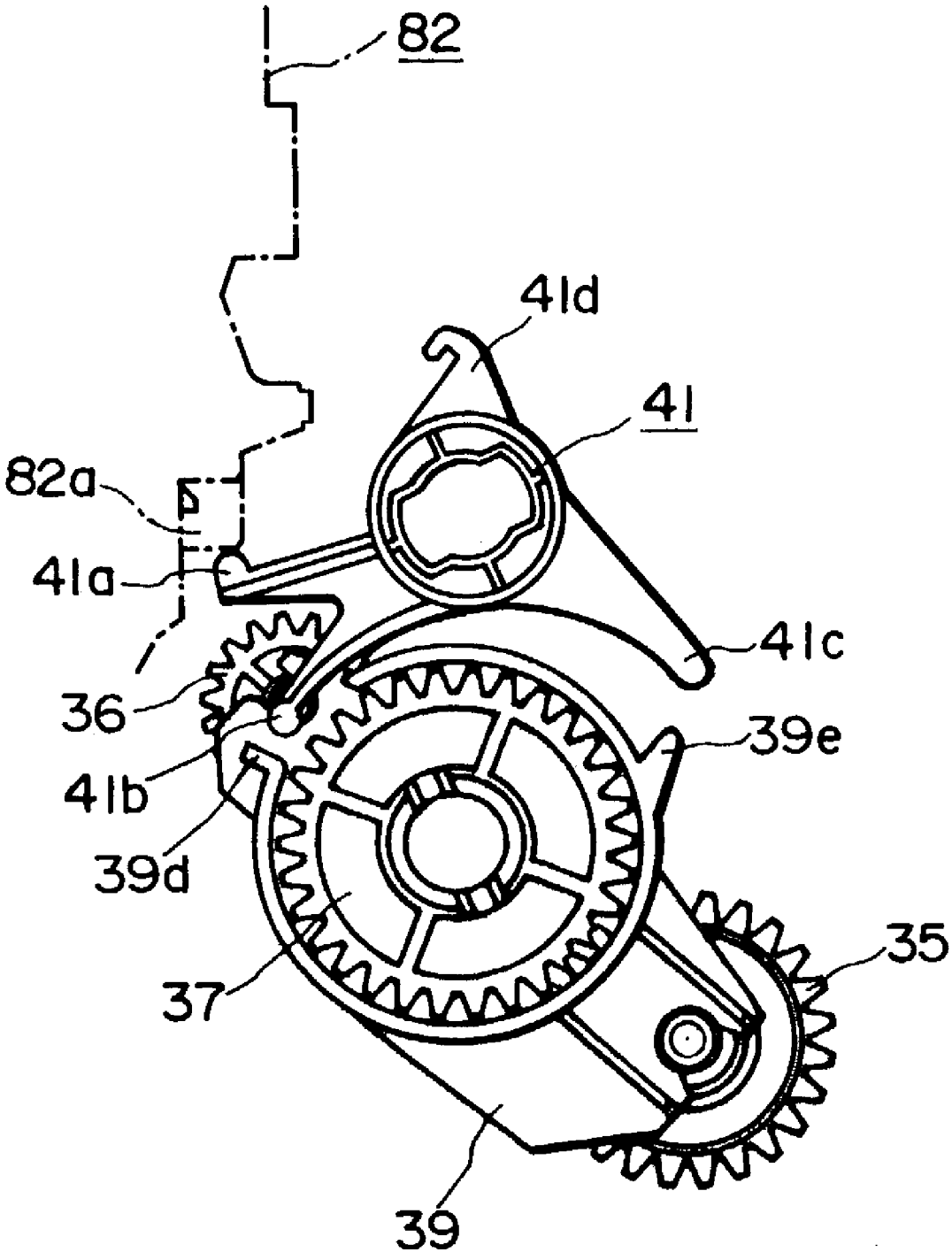
FIG. 13 is a side view showing a stopper incorporated in the drive mechanism.
Figure 14:
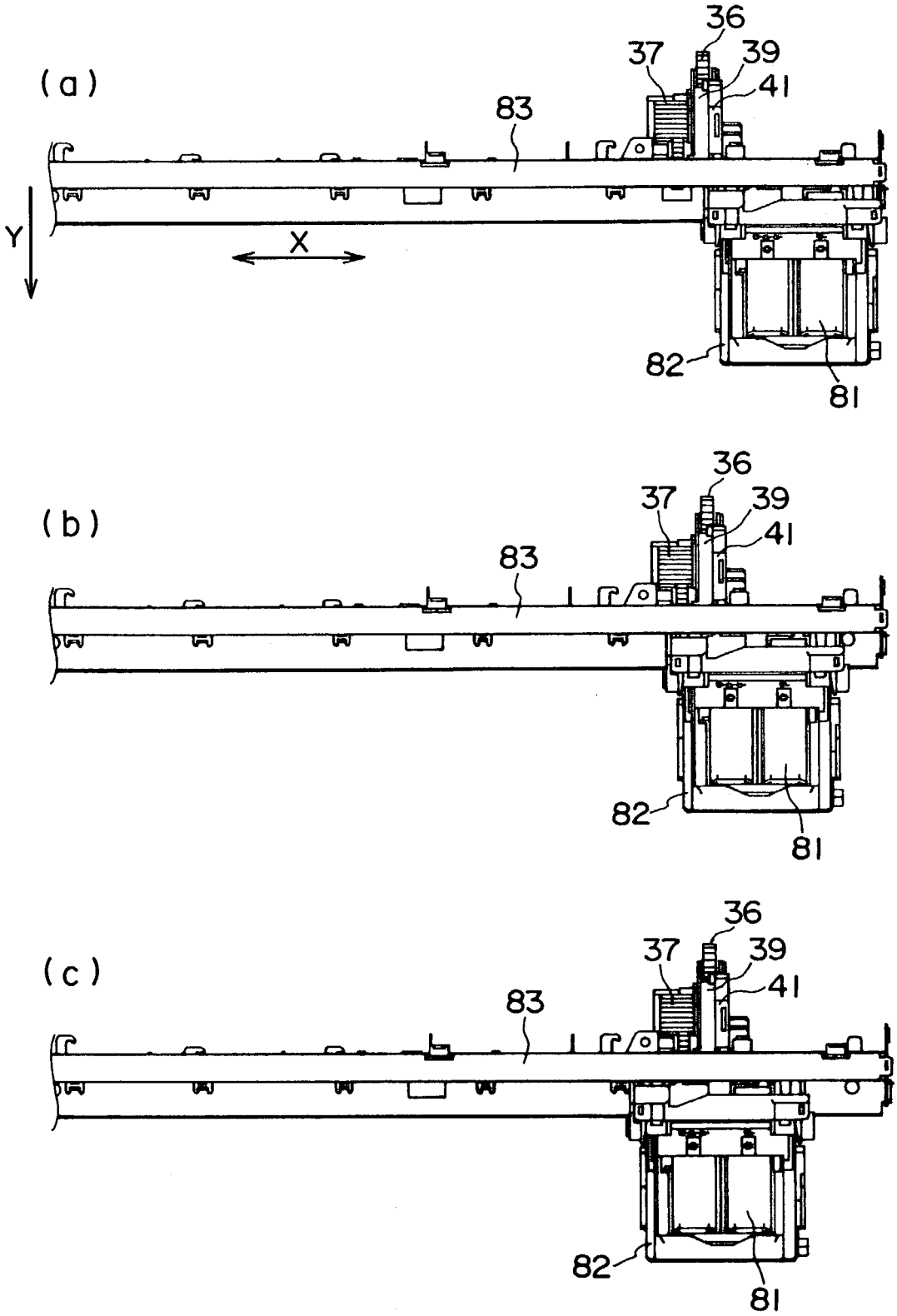
FIG. 14 includes plan views for illustrating some positions of a carriage.

FIG. 9 is a perspective view of the driving mechanism 8; FIG. 10 is a perspective view of the driving mechanism 8 viewed from the rear side FIG. 11 is a plan view of the driving mechanism; FIG. 12 is a side view of the driving mechanism 8; FIG. 13 is a side view of a stopper incorporated in the driving mechanism 8; FIGS. 14(*a*)–14(*c*) are views for illustrating several positions of a carriage; and FIGS. 15(*a*) and 15(*b*) are views each for illustrating a state in which the stopper is actuated by the carriage.

The driving mechanism 8 provided to the feeding portion 4 is, as shown in FIG. 1, constituted by mounting the respective parts on a supporting base 9.

As shown in FIGS. 9–12, the driving mechanism 8 includes a feed roller gar 19 for rotationally driving the feed roller 11, the control gear 24 and the control cam which are integrally driven rotationally, a forward rotation planet gear 35 and the backward rotation planet gear 36, an idler gear 40 for transmitting a driving force from the conveying portion 5, and a stopper 41 for regulating the wobbling of the pendulum 39.

The feed roller gar 19 is coaxially disposed with the feeding shaft 10 as described above, and rotates the feeding shaft 10 and the feed roller 11. The feed roller gear 19 is formed in a high-tooth for preventing tooth top abutment described hereinafter. In this embodiment, the feed roller gear 19 is designed to have an addendum, from a pitch circle to an addendum circle, 1.35 times the module.

The control gear 24 includes a first gear portion 24*a* to be engaged with the forward rotation planet gear 35 and a second gear portion 24*b* to be engaged with the feed roller gear 19. To the control gear 24, the driving force inputted into the feed roller gear 19 is transmitted and a driving force is independently transmitted through a driving force transmission path. The control gear 24 is further provided with a first shielding potion 56*a* and a second shielding portion 56*b*, which block a beam detected by the feeding sensor 38 and are disposed with a predetermined spacing. These first and second shielding portions 56*a* and 56*b* are rotationally moved integrally by the rotation of the control gear 24.

The control cam 34 is disposed coaxially with the control gear 24 and rotates in phase with the control gear 24. The control cam 34 includes a first am surface 34*a* to be engaged with a pressure plate boss 16*a*, a second cam surface 34*b* to be engaged with a boss 28*d* of the release cam 28, and a third surface 34*c* to be engaged with a protruding portion 13*a* of the returning lever 13.

The sum gear 37 includes a first gear portion 37*a* to be engaged with the forward rotation planet gear 35 and a second gear portion 37*b* to be engaged with the backward rotation planet gear 36.

The feeding sensor 38 includes a light source for emitting a detection beam and a photodetector for receiving the detection beam from the light source (not shown). The feeding sensor 38 detects the rotation position of the control gear 24 by interrupting the detection beam by the first and second shielding portions 56*a* and 56*b*.

The pendulum 39 includes a bearing portion 39*a* for supporting the sun gear 37 through the rotation shaft, a bearing portion 39*b* for supporting the forward rotation planet gear 35 through the rotation shaft, and a bearing portion 39*c* for supporting the backward rotation planet gar 36 through the rotation shaft. These bearing portions 39*a*, 39*b* and 39*c* are integrally formed. At a peripheral surface of the pendulum 39, a first engaging portion 39*d* and a second engaging portion 39*e*, for regulating the swinging position of the pendulum 39, are integrally formed to constitute protruding portions.

Between the sun gear 38 and the pendulum 39, a friction spring (not shown) is disposed to swing the pendulum 39 together with the rotation of the sun gear 37 in the same direction. More specifically, when the sun gear 37 is clockwise rotated, the pendulum is also swung clockwise similarly, whereby the backward rotation planet gear 36 is engaged with the feed roller gear 19. On the other hand, when the sun gear 37 is counterclockwise rotated, the pendulum 39 is also counterclockwise swung, whereby the forward rotation planet gear 35 is engaged with the first gear portion 24*a* of the control gear 24.

The idler gear 40 includes a first gear portion 40*a* to be engaged with a conveyance output gear 95 and a second gear portion 40*b* to be engaged with the second gear portion 37*b* of the sun gear 37, and transmit the driving force of the conveyance output gear 95 to the sun gear 37.

The stopper 41 is, as shown in FIG. 13, disposed rotatably at a position adjacent to the pendulum 39, and includes a working portion 41*a* to be abutted to the cam portion 92 of the carriage 82, a first regulating portion 41*b* to be engaged with the first engaging portion 39*d* of the pendulum 39, and a second regulating portion 41*c* to be engaged with the second engaging portion 39*e* of the pendulum.

The stopper 41 further includes a hook 41*d* to be engaged with one end of a tension coil spring (not shown) and is pressed so that the second regulating portion 41*c* is engaged with the second engaging portion 39*e* of the pendulum 39 by an elastic force of the tension coil spring, thus preventing the pendulum 39 to swing counterclockwise.

The stopper 41 is actuated by the carriage 82 by moving the carriage 82 of the above-mentioned recording portion 3, thus regulating the swing of the pendulum.

As shown in FIGS. 14(*a*) to 14(*c*), in an area in which the carriage 82 moves in a direction of arrow X, there are a home position, a feeding trigger position, and a feed position, respectively, in addition to a recording operation area to be scanned during the recording.

Figure 15:
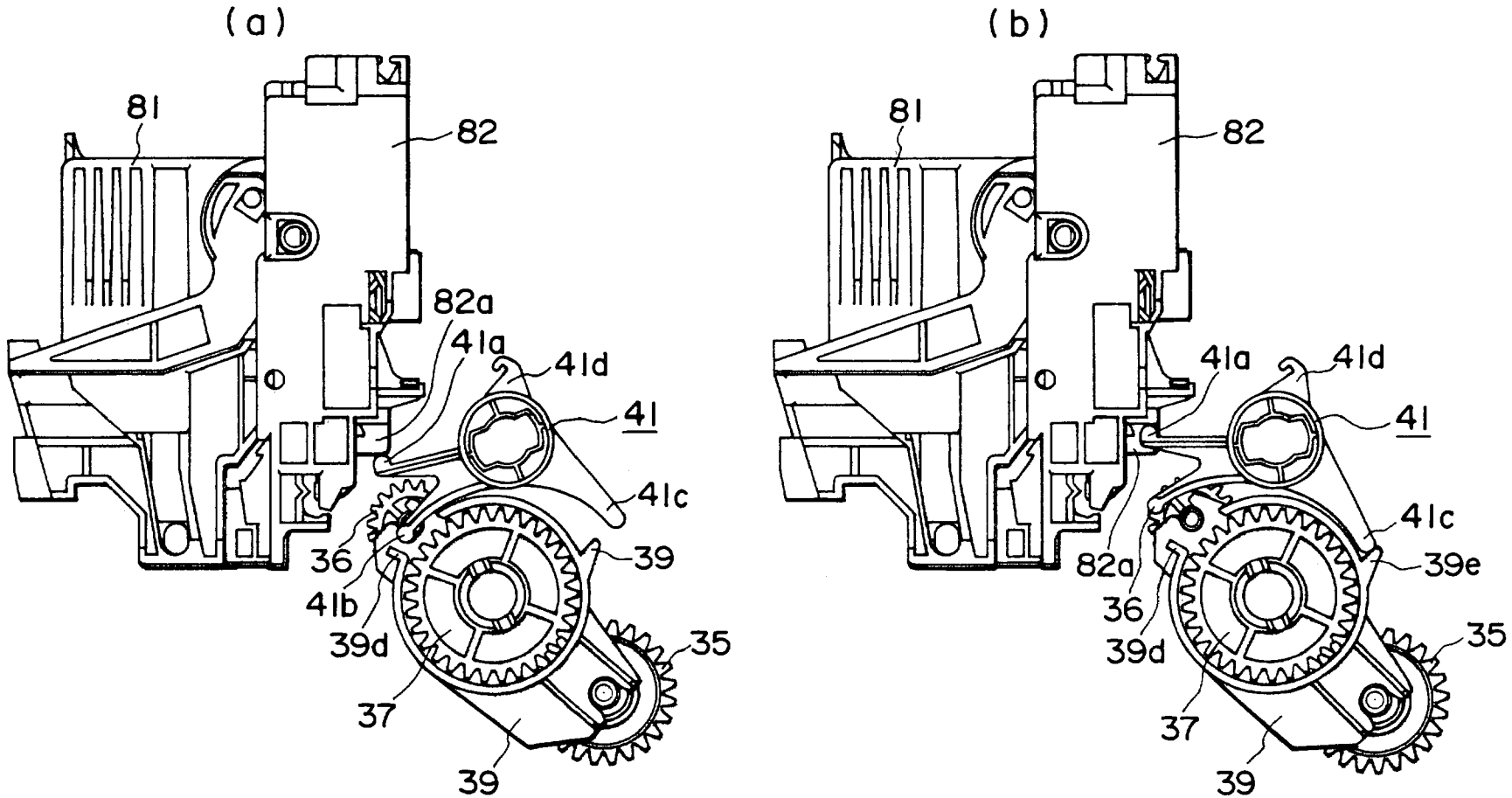
FIG. 15 includes side views for illustrating such a state that the stopper is actuated by the carriage.

Several positions of the carriage 82 and corresponding operations of the stopper 41 will be described with reference to FIGS. 14 and 15.

As shown in FIG. 14(*a*), the home position is a reference position of the carriage 82 and is located so that the carriage 82 is stopped while being struck against a side of the chassis 83.

As shown in FIG. 14(*b*), the feeding trigger position is a position to which the carriage 82 is moved, e.g., at the time of initialization operation for the feeding portion 4. As shown in FIG. 15(*a*), the cam portion 82*a* of the carriage 82 is abutted to the working portion 41*a* of the stopper 41 to push the working portion 41*a* downward. Accordingly, the carriage 82 is located at the feeding trigger position, whereby the first regulating portion 41*b* of the stopper 41 is engaged with the first engaging portion 39*d* of the pendulum 39 to regulate the clockwise swing of the pendulum 39 through the stopper 41.

As shown in FIG. 14(*c*), the feed position is a position to which the carriage 82 is moved at the time of feeding the sheets 2 by the feeding portion (means) 4. When the carriage 82 is located at the feed position, as shown in FIG. 15(*b*), the working portion 41*a* of the stopper 41 is not pressed downward by the cam portion 82*a* of the carriage 82. Accordingly, the carriage 82 is located at the feed position, whereby the second regulating portion 41*c* of the stopper 41 is engaged with the second engaging portion 56*e* of the pendulum 39 to regulate the counterclockwise swing of the pendulum 39 through the stopper 41.

3 (Conveying Portion)

The conveying portion (means) 5, as shown in FIGS. 1 and 2, is located at the upstream side in the conveyance direction of the sheets 2 being sub-scanning direction indicated by an arrow Y, shown in FIG. 2, perpendicular to the main scanning direction of the recording head 81. The conveying portion 5 includes a pair of a conveyance roller 30 and a roller 29 driven by the rotation of the conveyance roller 30, which are disposed for conveying the sheet 2 toward the recording head 81 side, and a pair of the discharge roller 31 and the spur-shaped wheel 32, which are located downstream from the recording head 81 and convey the sheet 2 from the recording head 81 side to discharge the sheet 2.

Figure 16:
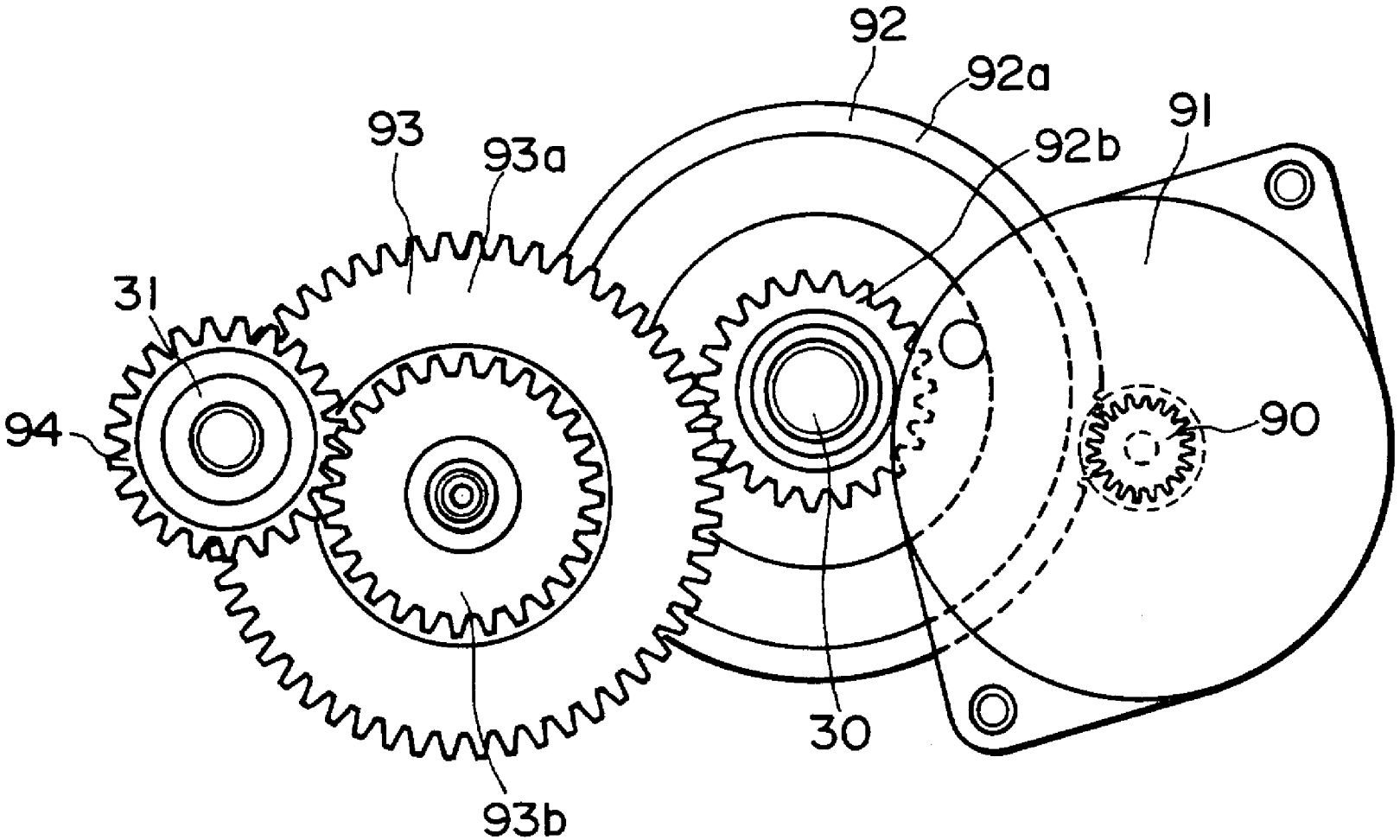
FIG. 16 is a side view for illustrating a conveyance portion.

Further, the conveyance portion 5 includes, as shown in FIGS. 1 and 16, a conveyance motor 91, a conveyance roller gear 92 for rotationally driving the conveyance roller 30 by transmitting a rotational driving force from the conveyance motor 91, a conveyance output gear 95 which is rotationally driven by the rotation of the conveyance roller 30, a discharge roller gear 93 for transmitting the driving force from the conveyance roller gear 92 to the discharge roller 31.

Figure 18:
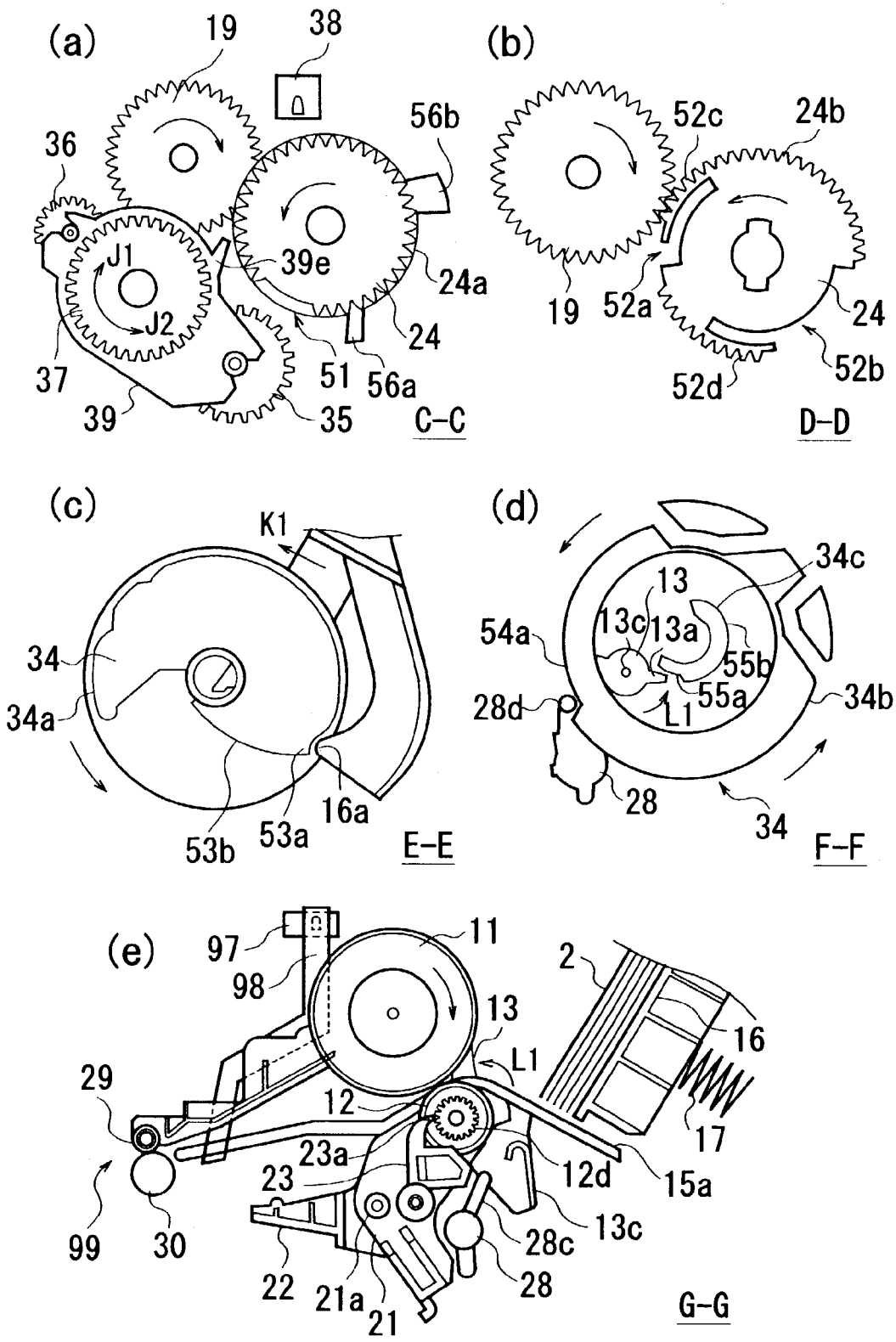
FIGS. 18–24 are sectional views for illustrating operating states of the drive mechanism at positions P1–P7 in FIG. 17, respectively.

The conveyance portion 5 further includes guide members 25*a* and 25*b* for guiding the sheet 2 to a nip portion 99 between the conveyance roller 30 and the roller 29, a sheet end detection sensor 97 for detecting a position of the leading end of the sheet 2 fed by the feed roller 11 and a position of the trailing end of the sheet 2 conveyed by the conveyance roller 30, and a sheet end detection lever 98 which is rotated by movement of the leading end or the trailing end of the sheet 2 (FIGS. 1 and 18(*e*)).

The pair of the conveyance roller 30 and the roller 29 and the pair of the discharge roller 31 and the spur-shaped wheel 32, are respectively fixed around a pair of rotation shafts which are rotatably supported on the base 15, and are respectively disposed opposite to each other. Further, at the conveyance portion 5, a frictional force is applied to the conveyance roller 30 and the sheet 2 by the roller 29, and is also applied to the discharge roller 30 and the sheet 2 by the spur-shaped wheel 32.

The conveyance motor 91 includes a pinion 90 provided to the rotation shaft as shown in FIG. 16 and the pinion 90 is engaged with the conveyance roller gear 92. The conveyance roller gear 92 includes a first gear portion 92*a* engaged with the pinion 90 and a second gear portion 92*b* engaged with the discharge idler gear 93. The discharge idler gear 93 includes a first gear portion 93*a* engaged with the second gear portion 92*b* of the conveyance roller gear 92 and a second gear portion 93*b* engaged with the discharge output gear 94.

The sheet end detection sensor 97 includes the light source for emitting a detection beam and the photodetector for receiving the detection beam from the light source (not shown), and detects the leading end and trailing end of the sheet by detecting the rotation of the sheet end detection lever 98. Incidentally, as the sheet end detection sensor 97, a mechanical detector having a member which is pressed downward by operation of the sheet end detection 98 may also be used.

The sheet end detection lever 98 is rotatably supported at one end thereof where the sheet end detection sensor 97 is located, and at the other end thereof, is located at a position, corresponding to a predetermined position of the sheet conveyance path, which is an intermediary position between the separating portion by the separation roller 12 and the nip portion 99 of the conveyance roller 30 with the roller 29. Accordingly, the sheet end detection lever 98 is rotated by the abutment of the leading end of the sheet 2 to its the other end when the leading end of the sheet 2 separated and fed by the separation roller 12 reaches the predetermined position of the sheet conveyance path. One end (not the other end) of the sheet end detection lever 98 is moved away from a detection area of the sheet end detection sensor 97 by the rotation of the sheet end detection lever 98 through the abutment with the sheet leading end, thus allowing the detection of the sheet leading end. Similarly, one end of the sheet end detection lever 98 blocks the detection area of the sheet end detection sensor 97 when the sheet end detection lever 98 is rotated by passage of the sheet trailing end through the predetermined position, thus allowing the detection of the sheet trailing end.

The above-structured conveyance portion 5 conveys the sheet 2 supplied from the feeding portion 4 to the recording head 81 side by the conveyance roller 30. On the conveyed sheet 2, e.g., a desired image is recorded by ejecting ink by the recording head 81 of the recording portion 3. Then, the conveyance portion 5 discharges the sheet 2 having thereon the recorded image by the discharge roller 31 and the spur-shaped wheel 32.

In the recording apparatus 1 of this embodiment, the conveyance roller 30 and the feed roller 11 are rotated by the driving force of the conveyance motor 91, i.e., have a common driving power supply, but may be designed to be separately driven by different driving power supplies.

4 (Operation of Driving Mechanism of Feeding Portion)

The driving mechanism 8 of the feeding portion 4 described above will be explained in detail with reference to FIGS. 18–24.

FIGS. 18–24 include respectively sectional views of the driving mechanism 8 shown in FIG. 11, wherein each (a) shows a C—C cross section, each (b) shows a D—D cross section, each (c) shows an E—E cross section each (d) shows an F—F cross section, and each (e) shows a G—G cross section. FIGS. 18–24 correspond to states P1–P7, respectively, shown in FIG. 17, depending on the rotation angle of the control cam 34.

4-1 (Standby State)

FIGS. 18(*a*)–18(*e*) show a standby state of the driving mechanism. The state P1 shown in FIG. 17 is the standby state.

As shown in FIG. 18(*c*), a first cam surface 34*a* of the control cam 34 is provided with a first recess 53*a* with which a pressure plate boss 16*a* is engaged in the standby state. More specifically, the pressure plate 16 is held in the standby state by the first cam surface 34*a* of the control cam 34 and at the same time, is urged toward the control cam 34 side by an elastic force of the pressure plate spring 17, so that a holding force engaged in the first recess 53*a*of the control cam 34 acts on the control cam 34, thus containing the rotational direction of the control cam 34.

As shown in FIG. 18(*a*), a first gear portion 24*a* of the control gar 24 is provided with a first tooth-less portion 51 which is located at a position facing the forward rotation planet gear 35 in the standby state. Accordingly, in the standby state, even if the pendulum is rotated in a counter-clockwise direction of an arrow J2 shown in the figure, the forward rotation planet gear 35 is not engaged with the first gear portion 24*a* of the control gear 24.

As shown in FIG. 18(*b*), a second gear portion 24*b* of the control gear 24 is provided with second and third tooth-less portions 52*a* and 52*b*, and also provided with elastically displaceable toothed portions 52*c* and 52*d* adjacent to the tooth-less portions 52*a* and 52*b*, respectively. By these elastic toothed portions 52*c* and 52*d*, a tooth top abutment between gears described hereinafter is prevented.

FIG. 18(*d*) shows second and third cam surfaces 34*b* and 34*c* of the control cam 34. As shown in the figure, a boss 28*d* of the release cam 28 is engaged with one end of the control cam surface 34*b* of the control cam 34. Further, a protrusion 13*a* of the returning lever 13 is engaged with a control cam surface 55*a* of the third cam surface 34*c*.

FIG. 18(*e*) shows a state of the separation/feeding mechanism 7 at that time. As shown in the figure, the pressure plate 16 is held at a position away from the feed roller 11 having a circular cross section. Between the feed roller 11 and the pressure plate 16, a sufficient space for stacking a plurality of sheets 2 is ensured. Further, the returning lever 13 enters the conveyance path of the sheets 2 to prevent leading ends of the sheets 2 stacked on the pressure plate 16 from being fallen toward the separation roller 12 side. The separation roller 12 is placed in an abutting state against the feed roller 11, thus being capable of generating a torque. This torque generable state of the separation roller 12 is created by engaging a protrusion 23*a* of the returning lever 13 with a gear portion 12*d* of a clutch shaft 12*b*. The sheets stacked on the sheet stacking portion 6 are in the standby state while being supported by the sheet leading end alignment reference portion 15*a* at the leading ends and by the pressure plate 16 at their rear surface, respectively.

4-2 (Separation State)

As shown in FIG. 12, by backwardly rotating the conveyance output gear 95 attached to the conveyance roller 30, the sun gear 37 is rotated in the clockwise direction of an arrow J1 shown in FIG. 18(*a*) through the idler gear 40. By this rotation, the pendulum 39 is also swung in the J1 direction,so that the backward rotation planet gear 36 is engaged with the feed roller gear 19 to rotate the feed roller gear 19 in the clockwise direction.

Further, as shown in FIG. 18(*b*), in the standby state, the feed roller gear 19 and the second gear portion 24*b* of the control gear 24 are engaged with each other, so that the control gear 24 is counterclockwise rotated. As a result, the control cam 34 also starts to rotate.

When the control gear 24 is rotated up to an angle θ1 shown in FIG. 17, as shown in FIG. 18(*d*), firstly the protrusion 13*a* of the returning lever 13 is moved out of the position of the cam surface 55*a* of the control cam 34, whereby, as shown in FIG. 18(*e*), the returning lever 13 is rotated in a direction of an arrow L1 by an urging force of an unshown elastic member. As a result, a conveyance path of the feed roller 11 is opened and in feedable state.

On the other hand, by the rotation of the feed roller gear 19, the feed roller 11 is also rotated, so that the feed roller 11 together rotates the separation roller 12 to result in an increase in torque of a clutch spring 12*c* within the separation roller 12 up to a predetermined level.

When the control gear 24 is further rotated up to an angle θ2 shown in FIG. 17, as shown in FIG. 18(*e*), the engaging state of the pressure plate boss 16*a* with the first recess 53*a* is released by the control cam surface 53*b* of the control cam 34 rotated together with the control gear 24, whereby the pressure plate 16 is abutted in a direction of an arrow K1 by a pressure plate spring 17.

Thereafter, the conveyance roller 30 is further rotated, i.e., the sun gear 37 is rotated in the arrow J1 direction, whereby the control cam 34 is rotated in a state P2 shown in FIG. 17.

Figure 19:
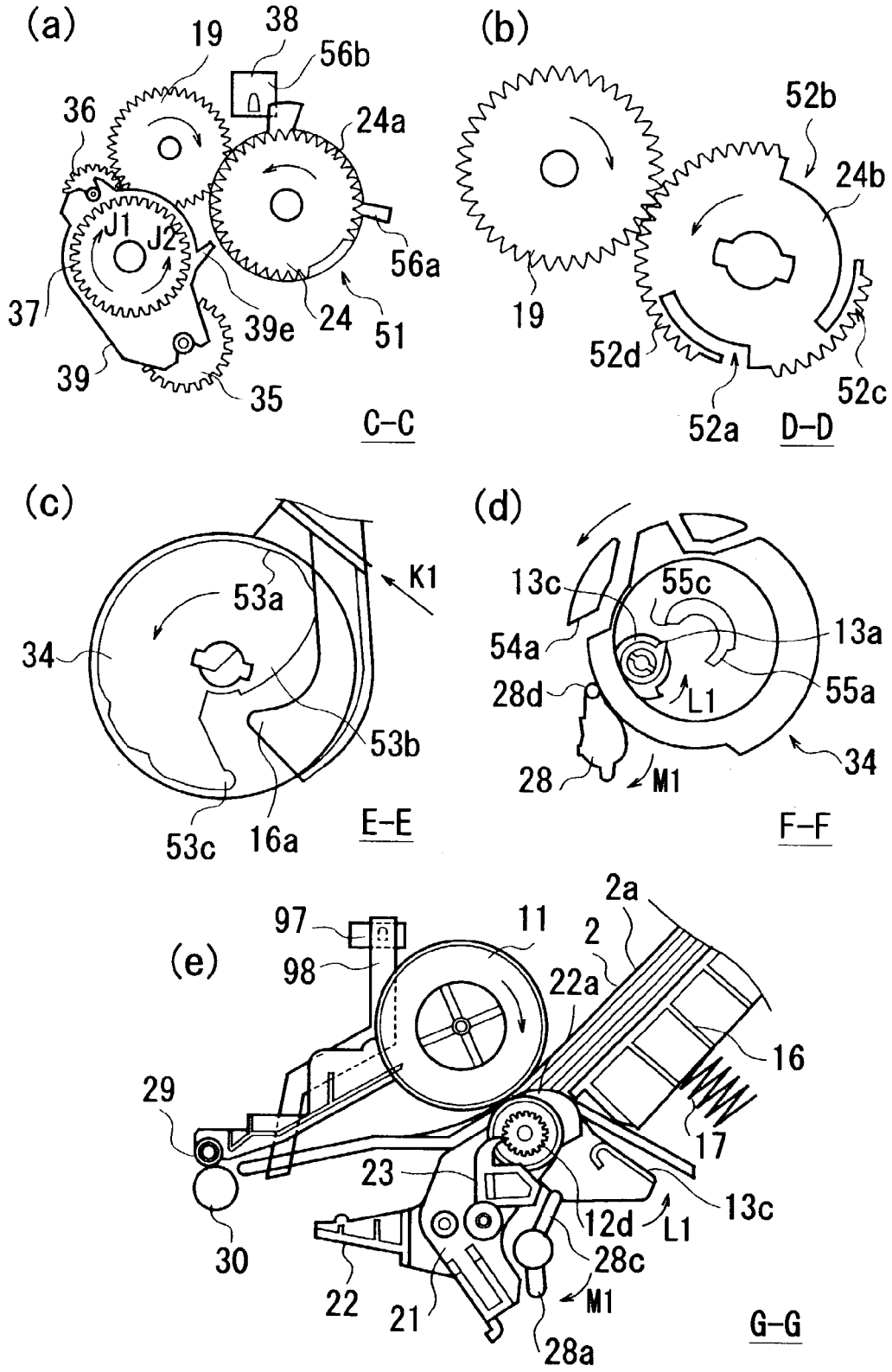

This state P2 is shown in FIGS. 19(*a*)–19(*e*).

As shown in FIG. 19(*a*), the sun gear 37 is further rotated, so that the feed roller gear 19 is rotated by the feed roller planet gear 36 to rotate the control gear 24 in the state shown in the figure.

As shown in FIG. 19(*b*), by the rotation of the feed roller gear 19, a second gear portion 24*b* of the control gear 24 engaged with the feed roller gear 19 is rotated up to the position shown in the figure.

As shown in FIG. 19(*c*), the pressure plate 16 is urged by the pressure plate spring 17 in an arrow K direction, so that a fixed state of the pressure plate 16 is removed by the action of the control cam surface 53*b* of the control cam 34. As a result, as shown in FIG. 19(*e*), the stacked sheets 2 are abutted toward the feed roller 11 side by the action of the pressure plate spring 17. Then, a topmost sheet 2*a* of the sheets 2 contacts the feed roller 11 and the feed roller 11 is rotated to start conveyance of the sheets 2.

At this time, by the friction between the sheets, a plurality of sheets including not only the topmost sheet 2*a* but also a second sheet 2*b* and subsequent sheets are feed at the same time (double feeding) in some cases. In this case, firstly, the number of sheets 2 passed is regulated by the action of a gap d1 created between the preliminary regulation portion 22*a* and the feed roller 11.

In addition, by continuing the feeding operation of the feeding portion 4, a plurality of sheets 2 reaches the separating portion comprising the nip between the feed roller 11 and the separation roller 12. The separation roller 12 receives a torque from the sheets in the counterclockwise direction in the figure by the advance of the sheets 2. However, as shown in FIG. 19(*e*), the state is a state in which the protrusion 23*a* of the returning lever 13 is engaged in the gear portion 12*d* of the clutch shaft 12*b*, so that the rotation of the clutch shaft 12*b* is interrupted. For this reason, by the action of the above-mentioned clutch spring 12*c*, a clockwise torque, which overcomes the counterclockwise torque by the sheets 2, is exerted on the separation roller 12. Accordingly, only the topmost sheet contacting the feed roller 11 is fed, and other sheets are prevented from advancing by the stopped separation roller 12, so that only the topmost sheet is separated.

Further, as shown in FIG. 19(*d*), by the rotation of the control cam 34 in the state shown in the figure, the protrusion 13*a* of the returning lever 13 is moved away from the cam surface 55*a* of the control cam 34. As a result, the returning lever 13 is rotated around the rotation center 13c in an arrow L1 direction by the urging force of an unshown elastic member. Accordingly, as shown in FIG. 19(*e*), the returning lever 13 is rotated around the rotation center 13*c* up to a state such that the sheet conveyance path is opened as in a feedable state.

From this state, when the sun gear 37 is rotated in the arrow J1 direction to rotate the control cam 34 up to an angle θ3 shown in FIG. 17, as shown in FIG. 19(*c*), the cam portion 53*c* of the control cam 34 is abutted against the cam surface 16*a* to press the pressure plate 16 downward in an arrow K2 direction opposite from the arrow K1 direction while resisting the urging force of the pressure plate spring 17. As a result, the stacked sheets are moved away from the feed roller 11 to be returned to the standby state.

Further, when the control cam 34 is rotated up to an angle θ3 shown in FIG. 17, as shown in FIG. 19(*d*), a protrusion 55*c* of the control cam 34 is engaged with the protrusion 13*a* of the returning lever 13, whereby the returning lever 13 is rotated in an arrow L2 direction opposite from the arrow L1 direction while resisting the unshown elastic member. As a result, a sheet 2, subsequent to the separated topmost sheet 2, located at the nip portion between the feed roller 11 and separation roller 12 is returned to the standby position by the returning lever 13 to prevent the double feeding.

When the control cam 34 is further rotated up to an angle θ4 shown in FIG. 17, as shown in FIG. 19(*d*), the control cam surface 54*a* is engaged with a boss 28*d* of the release cam 28 to rotate the release cam in an arrow M direction. As a result, a preregulation member holder working portion 28*a* of the release cam 28 rotates the separation roller holder 21 and the preregulation member holder 22 to move the separation roller 12 away from the feed roller 11 while further increasing the gap between the preliminary regulation portion 22*a* and the feed roller 11.

4-3 (Released State After Separation)

Figure 20:
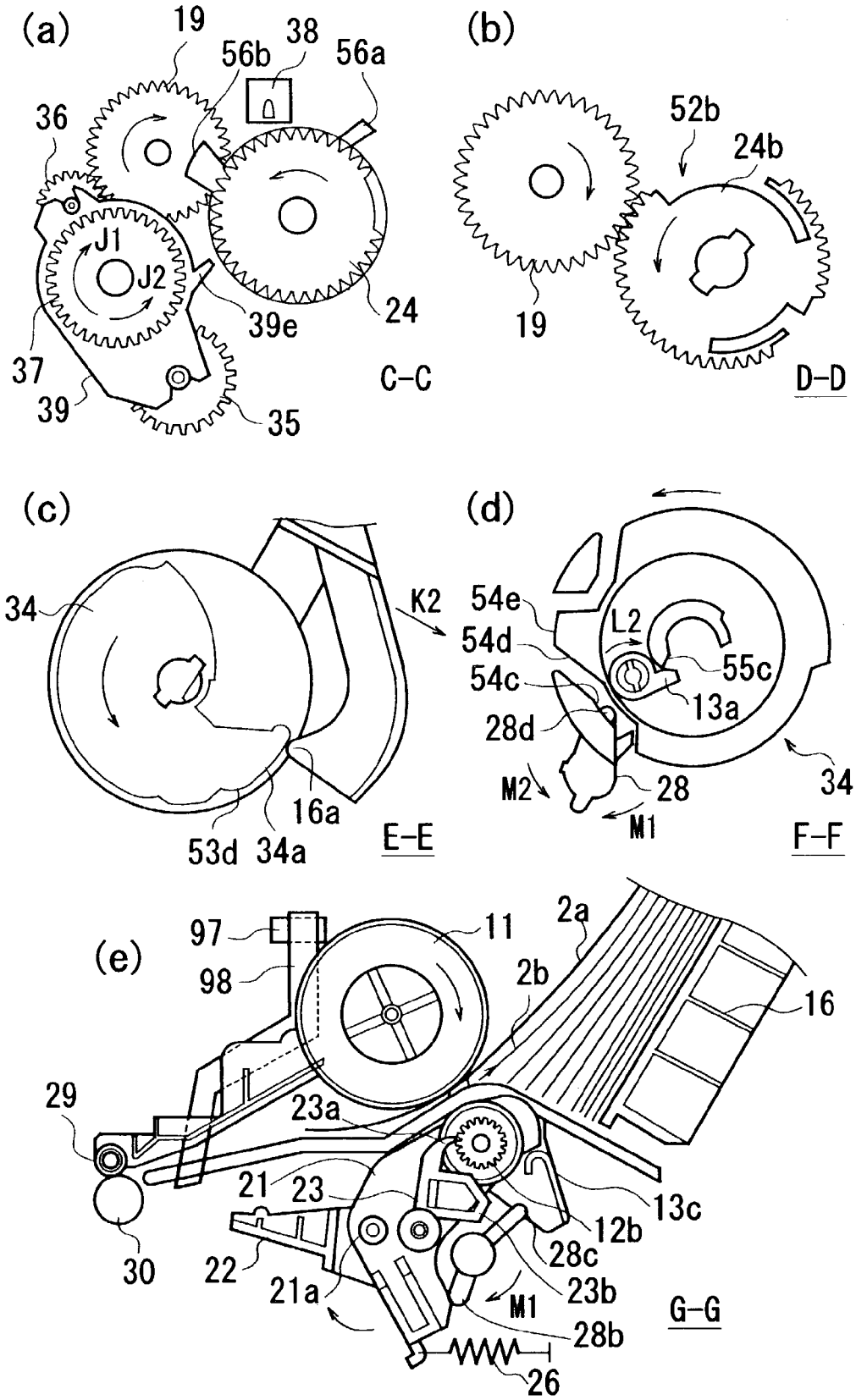

FIGS. 20(*a*)–20(*e*) show a state in which the conveyance roller 30 is further rotate backwardly to rotate the control cam 34 in a state P3 shown in FIG. 17.

As shown in FIG. 20(*a*), the sun gear 37 is rotated to rotate the feed roller gear 19.

As shown in FIG. 20(*b*), the second gear portion 24*b* of the control gear 24 is also rotated in the state shown in the figure by the rotation of the feed roller gear 19.

FIG. 20(*c*) shows a state of the first cam surface 34*a* of the control cam 34 and the pressure plate 16. Referring to FIG. 20(*c*), a control cam surface 53*d* and the pressure plate 16 in a depressed state.

As shown in FIG. 20(*d*), by the engagement of the control cam surface 54*c* with the boss 28*d* of the release cam 28, the release cam 28 is kept in the state shown in the figure. On the other hand, a third cam surface 55*c* is engaged with the protrusion 13*a* of the returning lever 13 to rotate the returning lever 13 in an arrow L2 direction in the figure.

As shown in FIG. 20(*e*), the sheet 2*a* located at the topmost position of a batch of (stacked) sheets is separated in accordance with the above-described separating operation and is moved to a position where the leading end of the topmost sheet is completely passed through the nip portion between the feed roller 11 and the separation roller 12. On the other and, the second sheet 2*b* and subsequent sheets 2 are substantially returned to the standby state by the returning lever 13. At this time, the separation roller 12, the separation roller holder 21 and the preregulation member holder 22 are located in the state shown in the figure by the separation roller holder working portion 28*b* of the release cam 28. For this reason, the sheets 2 sandwiched between the feed roller 11 and the separation roller 12 and also between the feed roller 11 and the preregulation member holder 22 are moved away therefrom to be substantially returned to the standby state with reliability.

4-4 (Conveyance State of Sheet After Torque Removal)

When the control cam 34 is further rotated up to an angle θ6 shown in FIG. 17, as shown in FIG. 20(*d*), by an oblique cam surface 54*d* of the control cam 34, the release cam 28 is rotated in the arrow M2 direction to abut again the separation roller 12, the separation roller holder 21 and the preregulation member holder 22 against the feed roller 11 side. Thereafter, the returning lever working portion 28*c* of the release cam 28 moves the cam surface 23*b* of the returning lever 23 upward.

As a result, the protrusion 23*a* of the returning lever 23 is moved out of the gear portion 12*d* of the clutch shaft 12 to place the clutch shaft 12 in a free state, so that the separation roller 12 becomes a roller which is rotated by and together with the feed roller 11 (torque-off state).

Figure 21:
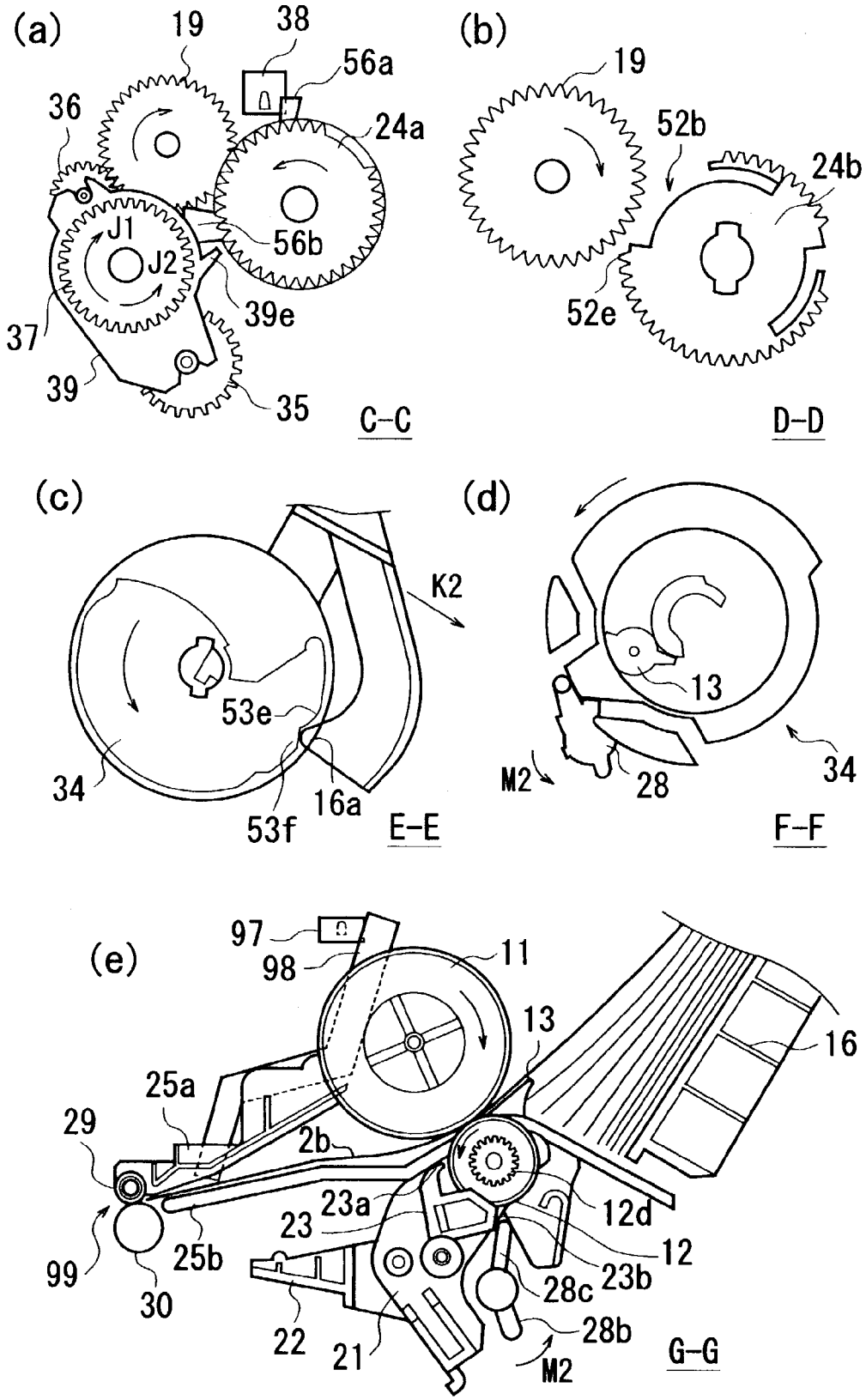

FIG. 21(*a*)–21(*e*) show an operating state of the driving mechanism 8 in a state P4 shown in FIG. 17.

As shown in FIG. 21(*a*), the sun gear 37 is rotated clockwise to rotate the feed roller gear 19 also clockwise through the backward rotation planet gear 36. More specifically, as shown in FIG. 21(*a*), in accordance with the rotation of the feed roller gear 19, the feed roller 11 is also in the same direction as the feed roller gear 19.

FIG. 21(*b*) shows a state of the feed roller gear 19 and the control gar 24. As shown in the figure, the feed roller gear 19 is rotated but is not engaged with the control gear 24 by the pressure of a third tooth-less portion 52*b* of the control gear 24, so that the control gear 24 is not rotated.

FIG. 21(*c*) shows a state of control cam 4 and the pressure plate 16. In this state, the pressure state boss 16*a* is engaged with a second recess 53*f* of the control cam 34, so that the control cam is held by the abutting force of the pressure plate spring 17. As shown in FIG. 21(*c*), immediately before this state, by the oblique surface of the control cam surface 53*e* of the control cam 34 and the urging force of the pressure plate spring 17, the control cam 34 generates a counter-clockwise rotating force (in the arrow direction shown in the figure), thus being held in the engagement state.

More specifically, as shown in FIG. 21(*b*), a gear 52*e* located immediately before the third tooth-less portion 52*b* of the control gear 24 is out of mesh with the feed roller gar 19 and at the same time, the control cam 34 and the control gear 24 are rotated by the control cam surface surface 53*e*.

As a result, as shown in FIG. 21(*b*), the mesh state of the feed roller gear 19 with the control gear 24 is removed to place the control gear 24, i.e., the control cam 34, in a state in which the control gear 24 is not rotated, even if the feed roller gear 19 is rotated.

FIG. 21(*d*) shows second and third cam surfaces 34*b* and 34*c* of the control gear 34 at that time. As shown in the figure, the release cam 28 is placed in the above-described torque-off state, and the returning lever 13 is in a completely returned state.

FIG. 21(*e*) shows a conveyance state of the sheet 2 after the separation in this state. As shown in FIG. 21(*e*), the returning lever working portion 28*c* of the release cam 28 pushes the cam surface 23*b* of the returning lever 23 upward to move the protrusion 23*a* of the returning lever 23 away from the gar portion 12*d* of the clutch shaft 12. As a result, the clutch shaft 12*b* is placed in a free state, whereby the separation roller 12 is rotated by the feed roller. More specifically, the pair of the feed roller 11 and the separation roller 12 can be regarded as a pair of a drive roller and a roller driven by the drive roller, thus functioning as the conveyance roller pair for the separated (one) sheet 2.

On the other hand, as described above, the transmission of the driving force from the feed roller gear 19 to the control gear 24 is interrupted by the third tooth-less portion 52*b*, so that the control gear 24 and the control cam 34 are held in this state. Further, the returning lever 13 is held in the completed returned state.

Accordingly, the sun gear 37 is rotated continuously in this state, whereby it is possible to feed the sheet 2 by an arbitrary length. In the feeding portion 4, the separation/feeding mechanism 7 can be freely disposed without being affected by the limitation of conveyance distance with respect to the conventional feed roller having the cut D-shape cross section. This means that it becomes possible to design the entire recording apparatus even when a large distance between the feed roller 11 and the separation roller 12 of the separation/feeding mechanism 7 is ensured. As a result, it becomes possible to reduce the entire size of the recording apparatus 1 and production costs.

Referring again to FIG. 21, the thus-conveyed sheet 2 is, after being guided by the guiding members 25*a* and 25*b*, carried to the nip portion 99 constituted between the conveyance roller 30 and the roller 29 rotated by the rotation of the conveyance roller 30.

The recording apparatus 1 of this embodiment employs a common driving power source for driving the conveyance roller 30 and the feed roller 11, so that the (registration) operation for truing up the leading end of the sheet 2 is performed in such a reverse registration manner that the registration is performed by backwardly rotating the conveyance roller 30. In a state in which the conveyance roller 30 is rotated clockwise, the leading end of the sheet 2 is struck against the nip portion 99 constituted by the conveyance roller 11 and the roller 29 and a predetermined amount of the sheet is conveyed by the feed roller 11, whereby the sheet 2 is curved between the feed roller 11 and the nip portion 99. The sheet leading end is pressed against the nip portion 99, whereby oblique advance of the sheet is corrected. In the recording apparatus 1, by this registration method, the conveyance roller is rotated forwardly after the registration of the sheet 2 is performed by striking the leading end of the sheet 2 against the nip portion 99, to convey the sheet 2 to the recording head 81, thus subjecting the sheet 2 to recording.

Figure 22:
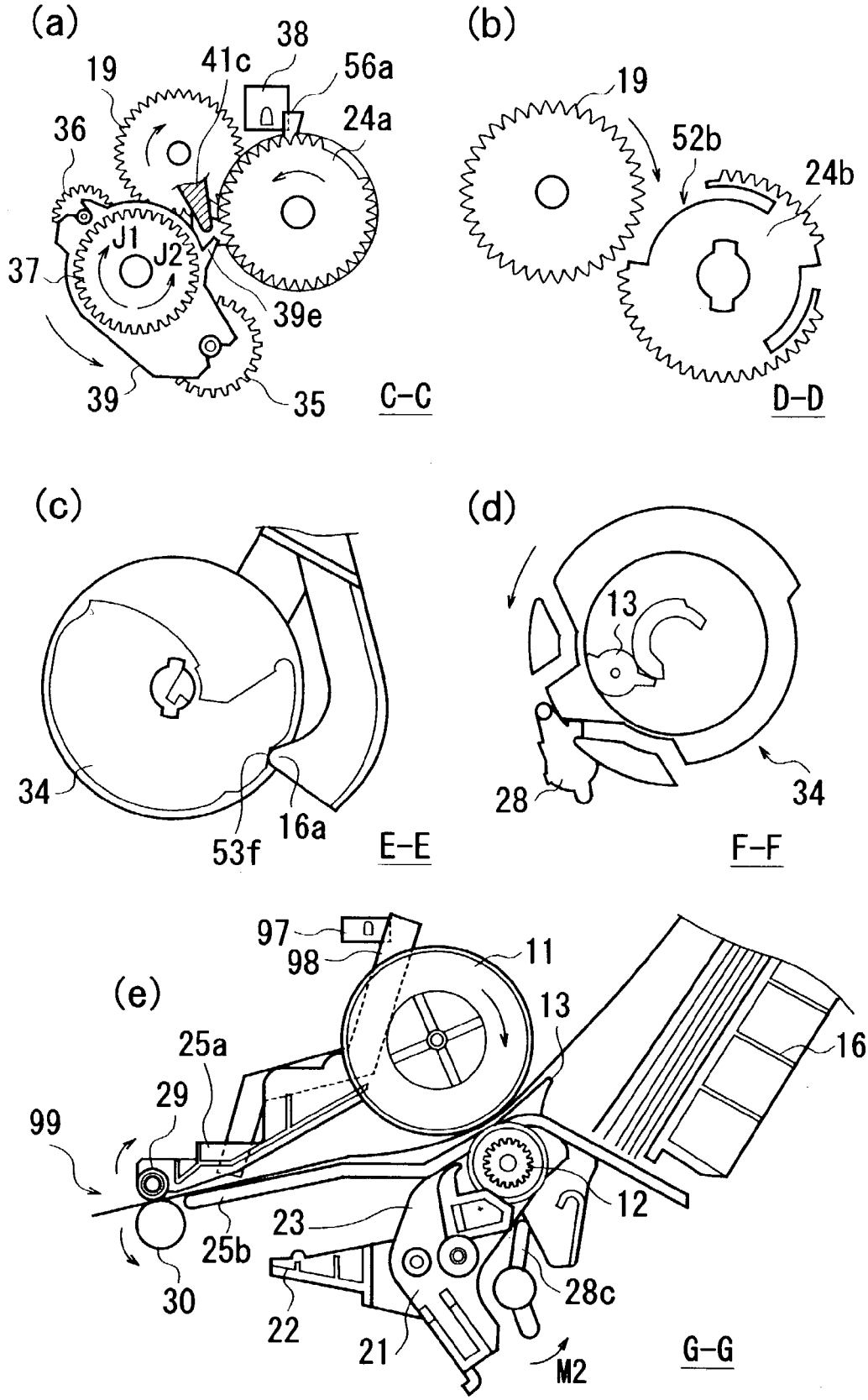

A state P5 shown in FIG. 17 of the driving mechanism 8 at this time is shown in FIGS. 22(*a*)–22(*e*).

As shown in FIG. 22(*a*), by forwardly rotating the conveyance roller 30, the sun gear 37 is rotated in an arrow J1 direction through the idler gar 40. At this time, the pendulum 39 is also tied to be rotated counterclockwise but the engaging portion 29*e* of the pendulum 39 abuts to the second regulation portion 41*c* of the stopper 41, so that the pendulum 39 is stopped in the state shown in the figure even if the sun gear 37 continues its rotation.

Incidentally, in the recording apparatus 1 of this embodiment, the conveyance motor as the driving power source of the conveyance roller 30 is used in common with the sun gear 37, but the sun gear 37 may be driven by a motor different from the drive motor 91 for the conveyance roller 30.

In the respective states shown in FIGS. 22(*b*), 22(*c*) and 22(*d*), as the control cam 34 is no rotated, all the operations are identical to those described with reference to FIGS. 21(*b*), 21(*c*) and 21(*d*) and explanation thereof is omitted.

Referring to FIG. 22(*e*), the sheet 2 conveyed by the conveyance roller 30 is sandwiched between the feed roller 11 and the separation roller 12, so that these rollers 11 and 12 are rotated together. Accordingly, as shown in FIGS. 22(*a*) and 22(*b*), the feed roller gear 19 is similarly rotated, but as described above, the pendulum 39 is in the state shown in FIG. 22(*a*), so that the feed roller gar 19 is not engaged with the backward rotation planet gear.

More specifically, at the time of sheet conveyance, as a load of the driving mechanism exerted on the sheet 2, only a rotational load by the feed roller 11, the feed roller gear 19 and the separation roller 12 is applied to the sheet 2.

In the conventional case where the conveyance roller is moved together with the sheet conveyance, it is also necessary to together move, e.g., the drive gear train, for driving the conveyance roller, similarly as in the conveyance roller, so that a load of the driving mechanism exerted on the sheet becomes large. As a result, there has arisen a problem such that a conveyance accuracy of the sheet becomes worse by a change in load at the time when the trailing end of the sheet passes through the nip portion between the feed roller and the separation roller. However, according to the recording apparatus 1 of this embodiment, the load of the driving mechanism is very small, so that a stable conveyance accuracy is ensured.

Further, in this embodiment, as an example, the common driving power source is used for the conveyance roller 30 and the feed roller. Even in this case, the driving power source is backwardly rotated at the time of sheet feeding and after the registration, is forwardly rotated. By such a simple sequence, it is possible to separate and convey the sheet 2.

For this reason, according to the recording apparatus 1, even in the case where a relatively high recording speed is required, it is unnecessary to switch many times the rotation direction of the drive power source. Further, it becomes possible to perform the operations of feeding, registration and conveyance in a very short time.

Further, in a sequence of feeding mode, separation mode and conveyance mode, by the respective tooth-less portions of the control gear 24 and amounts of rotation based on the tooth-less portions, required functions as fulfilled. As a result, a phase detection sensor required for detecting a phase of, e.g., the conventional feed roller having the D-shape cut portion can be omitted, so that reduction in production cost of the entire recording apparatus is also realized.

Next, a mechanism of restoring the sheet from the above-mentioned conveyance state to the standby state.

The carriage 82 is moved from the state shown in FIG. 22 to the feeding trigger portion, whereby the working portion 41*a* of the stopper 41 is pressed downward by the cam portion 82*a* of the carriage 82 to release the engage state of the second regulation portion 41*c* and the second engaging portion 39*e* of the pendulum 39. For this reason, by rotating the sung ear 37 in the arrow J2 direction, the forward rotation planet gear 35 is engaged with the first gear portion 24*a* of the control gar 24 to rotate counterclockwise the control gar 24. When the rotation is continued, the control gear 24 is stopped similarly as in the case of the operation shown in FIG. 18 by the first tooth-less portion 51 after passing through the phase position of the control cam 34 for a special paper mode and a registration less mode described below.

4-5 (Special Paper Mode)

Next, the special paper mode which further reduces the load of the driving mechanism 8 at the time of sheet feeding will be explained.

In recent years, in an ink jet recording apparatus, there has been in very increasing demand for high image quality such as so-called photographic quality, and various special papers for meeting the high image quality recording have also been provided. Such special papers require a further severe fluctuation value of load at the time of feeding the papers, so that it is necessary to further reduce the load by the driving mechanism 8 compared with the above-described conveyance mode.

For this reason, the recording apparatus 1 of this embodiment adopts thus special paper mode as a load reducing function for the driving mechanism 8 in addition to the normal (plain paper) mode.

In this special paper mode, the sequence of operations from the standby state (FIG. 18) to the registration operation (FIG. 21) via the separating operation are identical to those in the above-mentioned normal mode.

States P4 and P5 shown in FIG. 17 are conveyance states in the normal mode, and from these states P4 and P5, the operation mode is changed to the special paper mode shown by a state P6 by further rotating the control cam 34.

Figure 23:
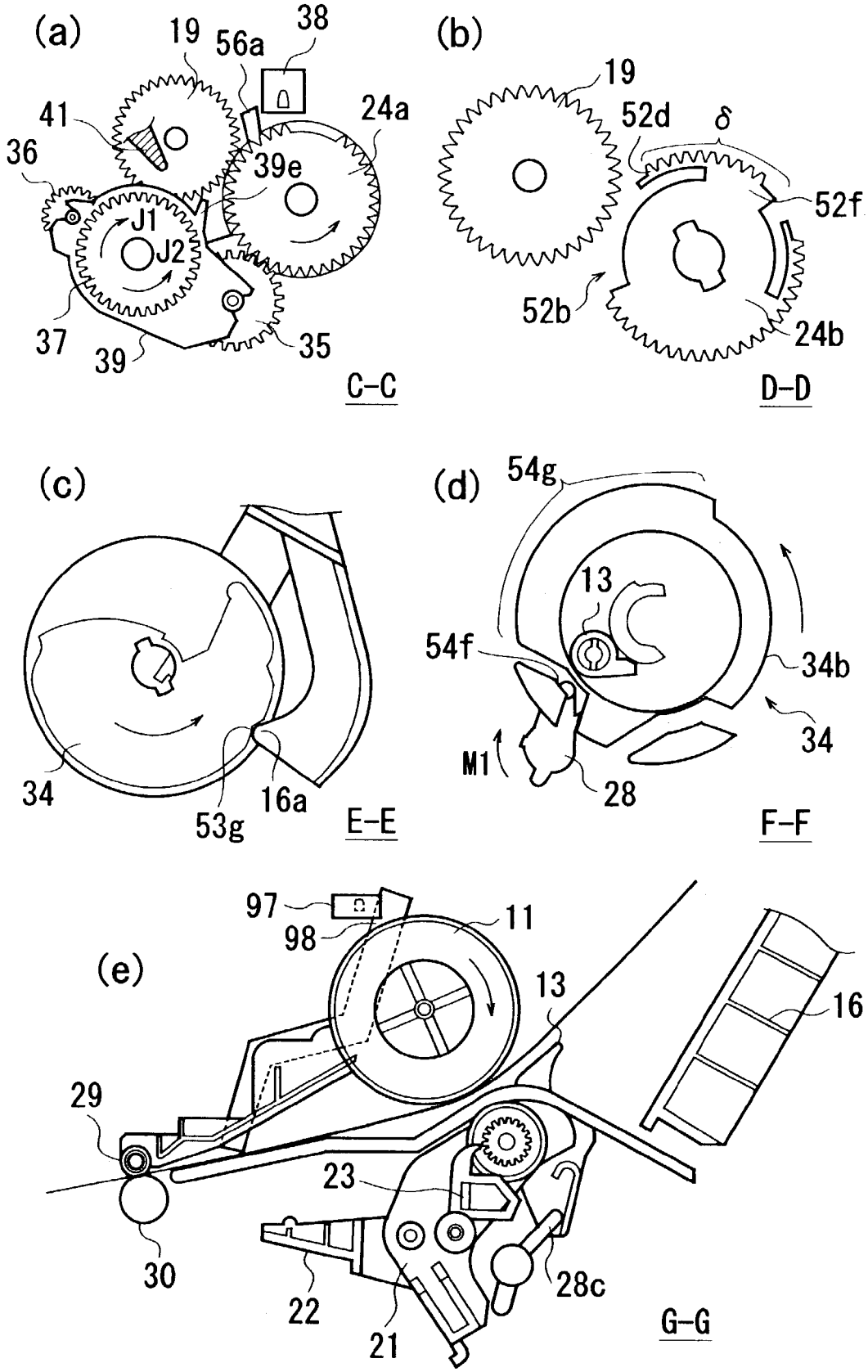

FIGS. 23(*a*)–23(*e*) show the state P6 shown in FIG. 17.

As shown in FIG. 23(*a*), after the registration operation shown in FIG. 21, the conveyance roller 30 is rotated forwardly to rotate the sun gear 37 in the arrow J2 direction via the idler gear 40. At this time, the carriage 82 is moved to the feeding trigger portion and the working portion 41*a* of the stopper 41 is pressed downward by the cam portion 82*a* to release the regulation of swing of the pendulum 39. The pendulum is swung counterclockwise to engage the forward rotation planet gear 35 with the first gear portion 24*a* of the control gear 24, whereby the control gear 24 and the control cam 34 start their counterclockwise rotations.

Further, at this time, the leading end of the sheet 2 reaches the nip portion, so that the leading end advance operation of the sheet 2 is also performed at the same time with the forward rotation of the conveyance roller 30.

From the time when the first shield portion 56*a* of the control gear 24 is detected by the feeding (detection) sensor, the conveyance motor 91 is driven by a predetermined pulse number to rotate the control gear 24, whereby the third recess portion 53*g* of the control cam 34 is engaged with the pressure plate boss 16*a* to hold the control cam 34 as shown in FIG. 23(*c*).

FIG. 23(*b*) shows the state of the second gear portion 24*a* of the control gear 24 and the feed roller gear 19 in the held state of the control cam 34. Referring to FIG. 23(*b*), even in this state, the control gear 24 is not engaged with the feed roller gear 19 by the third tooth-less portion 52*b* of the control gear 24.

FIG. 23(*d*) shows the second cam surface 34*b* of the control cam 34. Referring to the figure, the release cam 28 is placed in the same state as the released state after the separation operation by the cam surface 54*f*.

As a result, as shown in FIG. 23(*e*), similarly as in the state shown in FIG. 20, the separation roller 12, the separation roller holder 21 and the preregulation member holder 22 are moved away from the feed roller 11.

More specifically, in this state, the load of the driving mechanism exerted on the sheet is only the rotational load of the feed roller gar 19, so that it is possible to further reduce the load compared with that in the normal mode.

In order to place the sheet 2, from this state, in a recordable conveyance state, referring to FIG. 23(*a*), the pendulum 39 is swung in the clockwise direction (the arrow J1 direction) by once rotating backwardly the conveyance roller 30. In that state, the carriage 82 is moved to the feeding position to release the downward pressing of the working portion 41*a* of the stopper 41 by the carriage 82. As a result, the second regulation portion 41*c* is placed in an engageable state with the second engaging portion 39*e* of the pendulum 39. Thereafter the conveyance roller 30 is forwardly rotated to regulate the swing of the pendulum 39 even if the sun gear 38 is rotated in the arrow J2 direction. As a result, the forward rotation planet gar is not engaged with the control gear 24, thus allowing the conveyance of the sheet 2.

By the drag by the sheet 2, the feed roller gear 19 is rotated but by the third tooth-less portion 52*b*, the feed roller gear 19 and the control gear 24 are out of mesh, so that the control gear 24 is not rotated.

Further, in the case where the apparatus is returned to the standby state after the recording operation by the recording portion 3 is completed.

4-6 (Registration-Less Mode)

Next, the registration-less mode will be described.

For example, a thick sheet, such as cardboard or envelope, is not readily nipped in the nip portion between the conveyance roller 30 and the roller 29, which is rotated by the rotation of the conveyance roller 30, in many cases. Further, in this embodiment, the driving power source is common to the conveyance roller 30 and the feed roller 11, so that the conveyance roller 30 is rotated and, in that state, the sheet is conveyed from the conveyance portion 4. The registration-less mode is effective with respect to the sheet which is not readily nipped in the portion.

More specifically, after the separation operation, in a state such that the control cam 34 is in the state shown in FIG. 21, the rotation direction of the conveyance roller 30 is switched to the counterclockwise direction before the leading end of the sheet 2 reaches the nip portion between the conveyance roller 30 and the roller 29. Incidentally, the leading end of the sheet 2 may be identified by detecting it by the sheet end detection sensor or on the basis of the number of revolutions of the feed roller 11 in advance.

At this time, similarly as in the state shown in FIG. 23, by releasing the stopper 41, the sun gear 37 is rotated, whereby the control gear 24 starts to rotate.

Referring to FIG. 23, although the control gar 24 is rotated similarly as in the special paper mode, the sheet 2 has not yet reached the nip portion even if the conveyance roller 30 is rotated counterclockwise (forwardly or normally) thus being not moved. In other words, the sheet 2 is not conveyed by the conveyance roller 30. The backward rotation planet gear is moved away from the feed roller gear 19. The control gear 24 rotated by the forward rotation planet gear 19. The control gar 24 rotated by the forward rotation planet gear 35 is disposed so that the third tooth-less portion 52*b* thereof is opposite to the feed roller gear 19. Accordingly, the feed roller gear 19 remains at rest.

Referring to FIG. 23(*b*), when the control gar 24 is further rotated, to the contrary, the feed roller gear 19 is rotated by the toothed portion 52*f* subsequent to the third tooth-less portion 52*b*.

In this state, as shown in FIG. 23(*d*), the release cam 28 is already located at the position of cam surface 53*g*, i.e., the torque-off position, so that the separation roller 12 becomes a roller rotated by the rotation of the feed roller 11. In other words, in the state in which the conveyance roller 30 is forwardly rotated, the feed roller 11 is rotated to allow the sheet 2 to be conveyed in the nip portion (registration-less feeding). Further, at this time, a feedable distance by the feed roller 11 is a feed which corresponds to a toothed portion δ of the control gear 24.

Figure 24:
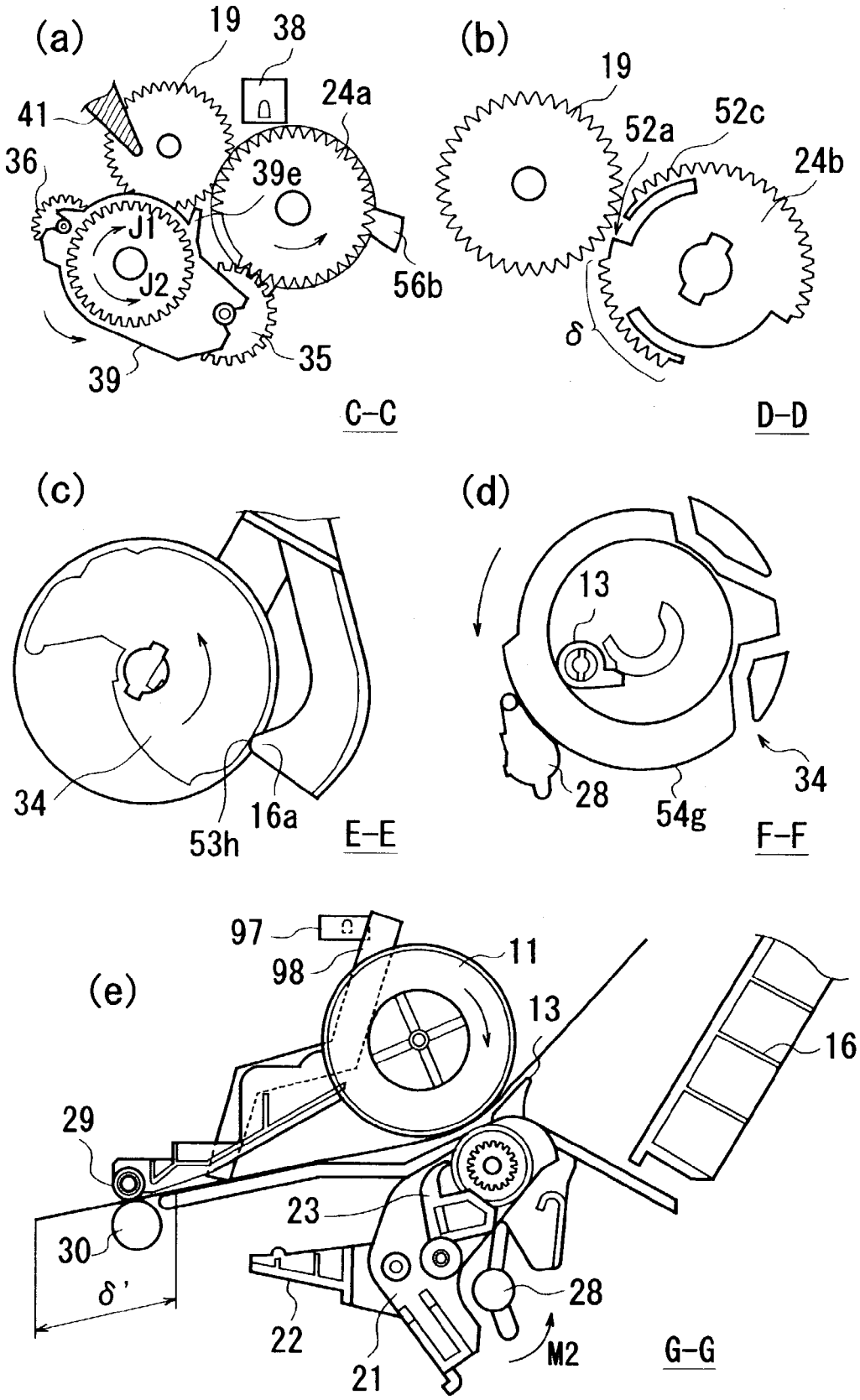

A state in which the control gear 34 is further rotated up to a state P6 shown in FIG. 17 is shown in FIGS. 24(*a*)–24(*e*).

As shown in FIG. 24(*c*), a fourth recess portion 53*h* of the first cam surface 34*a* of the control cam 34 is engaged with the pressure plate boss 16*a* to hold the control cam 34. As shown in FIG. 24(*b*), the control gear 24 is out of mesh with the feed roller gear 19 by the presence of the second tooth-less portion 52*a*. As shown in FIG. 24(*d*), the returning lever 13 is in a state in which the returning lever 13 is completely kept out of the returning operation area, and the release cam 28 is in the torque-off state.

FIG. 24(*e*) shows a state of the sheet 2. Referring to the figure, when the leading end of the sheet 2 is located immediately before the nip portion 99 of the conveyance roller 30, the rotation direction of the conveyance roller 30 is switched. A length δ' of the sheet 2 conveyed by the conveyance roller 3 in the registration-less mode corresponds to the toothed portion δ of the control gear 24. In this state, the conveyance roller 30 is once rotated backwardly, whereby the stopper 41 is engaged with the pendulum 39 to allow the recording operation and the conveyance operation.

4-7 (Measures to Prevent Tooth Top Abutment)

During the above-described sequence of feeding operations, as measures to prevent tooth top abutment at the time of engaging the second and third tooth-less portions 52 and 52*b* with the feed roller gear 19, not only the gear portion of the feed roller gear 19 is formed as a high-tooth portion (in this embodiment, an addendum (value) from a pitch circle to an addendum circle is set to be about 1.35 times a module) but also the second gear portion 24*b* of the control gear 24 is provided with elastic toothed portions 52*c* and 52*d* at sections thereof, respectively.

Effects of these elastic toothed portions 52*c* and 52*d* will be explained with reference to FIGS. 25 and 26.

Figure 25:
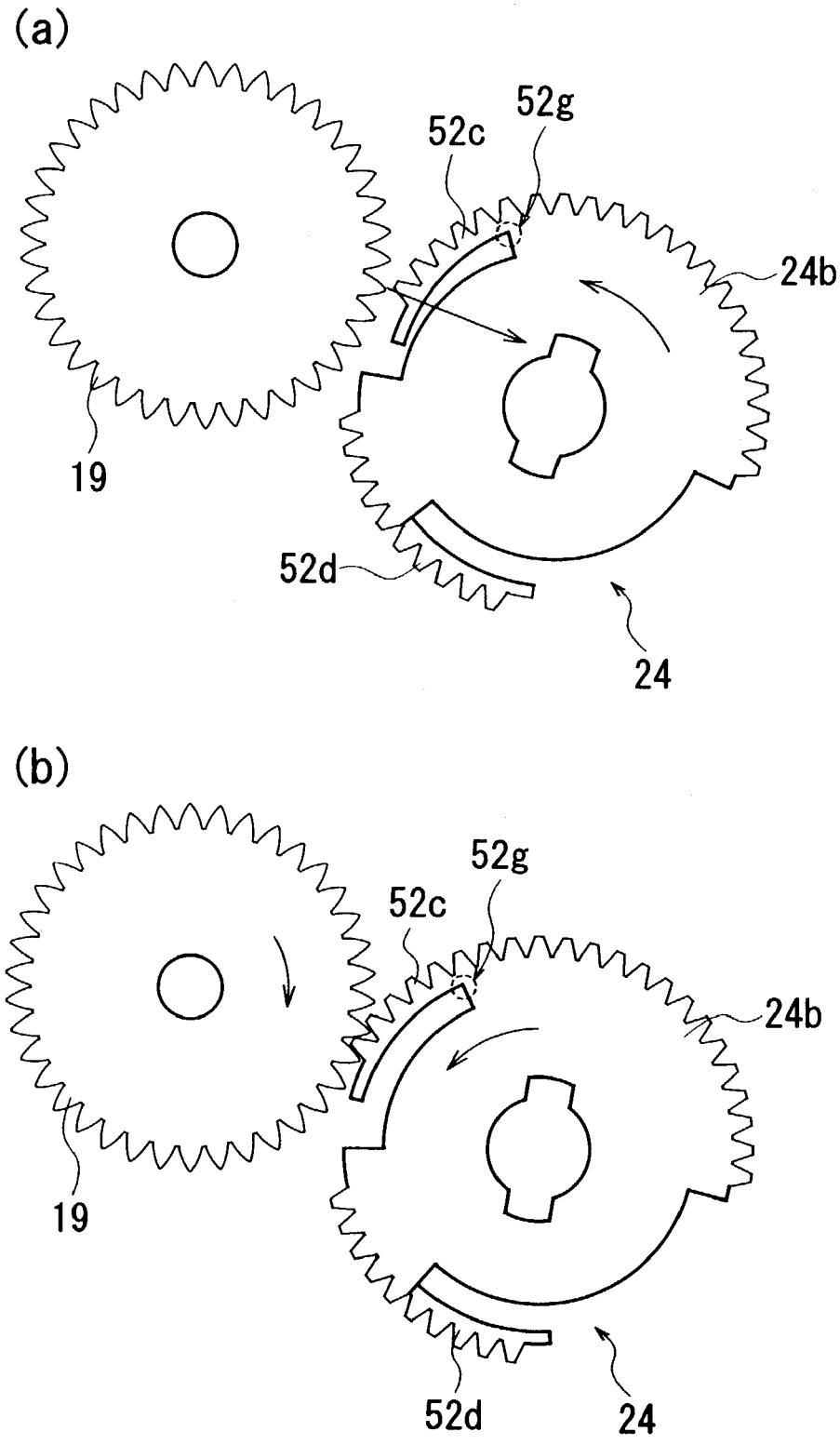
FIGS. 25 and 26 are views for illustrating countermeasures to tooth top abutment.

As shown in FIG. 25(*a*), the control gear 24 is rotated counterclockwise, whereby the elastic toothed portion 52*c* is tried to be engaged with the feed roller gear 19. At this time, in some cases, a tooth top of the elastic toothed portion 52*c* and a tooth top of the feed roller gear 19 interfere with each other to cause such a phenomenon that pitch circle of the gears 52*c* and 19 do not intermesh with each other. In such a case, the elastic toothed portion 52*c* is elastically deformed at its rear anchor position 52*g* substantially as its rotation center. Thereafter, when the rotation of the control gear 24 is further continued, as shown in FIG. 25(*b*), the gears 52*c* and 19 are placed in an ordinary intermeshing state at a position with no gear interference.

In the case where such a tooth top abutment is caused to occur, in this embodiment, the elastic toothed portion 52*c* is escaped from the tooth top abutment position to suppress an increase in load, thus realizing a stable engagement between the gears. Further, at this time, the feed roller gear 19 is formed in high-tooth so as to minimize the possibility of occurrence of the tooth top abutment.

Figure 26:
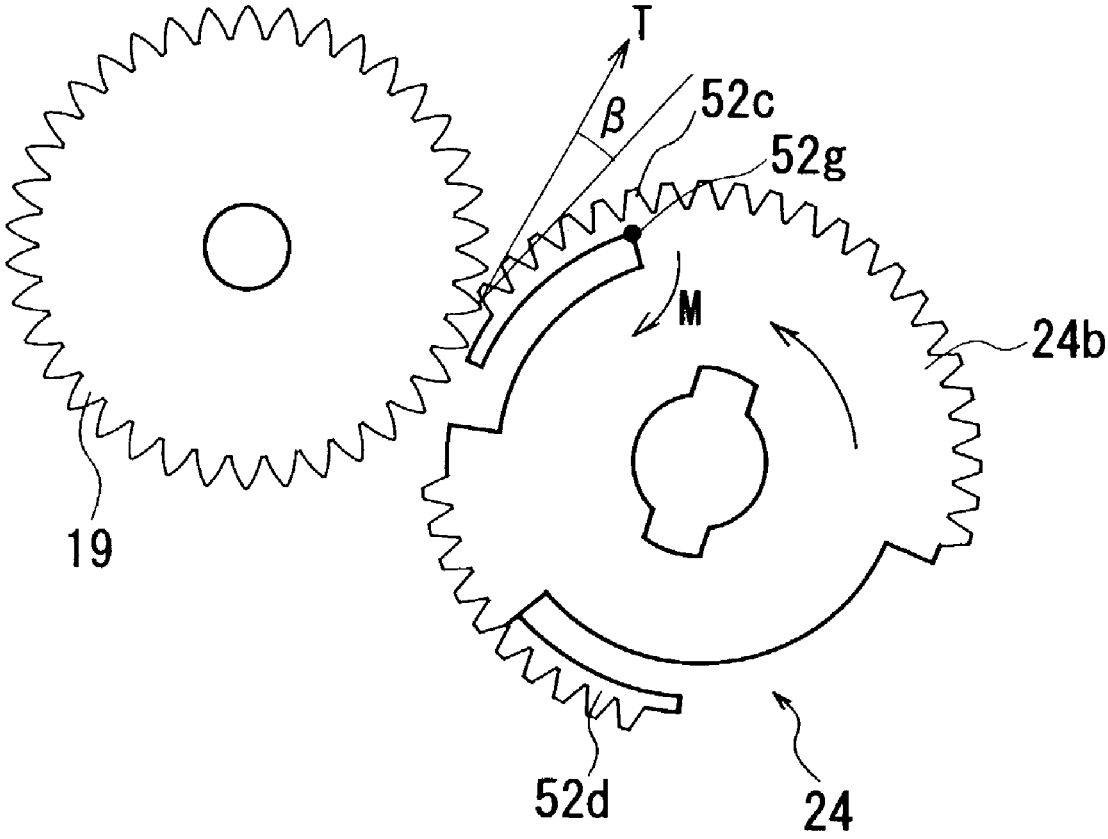

FIG. 26 shows a state in which the tooth top abutment between the control gar 24 and the feed roller gear 19 is not caused to occur and an ordinary intermeshing state therebetween is created. As shown in FIG. 26, a first tooth of the elastic toothed portion 52*c* of the control gear 24 is abutted to a tooth of the feed roller gear 19, so that a pressing force T in a direction forming an angle β is exerted from the feed roller gear onto the elastic toothed portion 52*c*.

As a result, a moment M is generated in the control gear 24 around the rear anchor position 52*g* of the elastic toothed portion 52*c* as the rotation center, whereby the elastic toothed portion 52*c* is urged against the feed roller gear 19 side. Accordingly, at the time of the ordinary intermeshing, the elastic toothed portion 52*c* is deflected in a direction providing a strong intermeshing state, so that it is possible to prevent an occurrence of tooth breakage, etc.

As described above, the control gear 24 has the elastic toothed portion 52*c* as measure to prevent the tooth top abutment and has the rear anchor position 52*g* which is a center of displacement of the elastic toothed portion 52*c*. The rear anchor position 52*g* is located on the side opposite from the rotational advance direction of the elastic toothed portion 52*c* of the control gar 24, whereby the elastic toothed portion 52*c* is deflected when the tooth top abutment occurs. As a result, it becomes possible to obviate the increase in load caused by the tooth top abutment. On the other hand, in the case of the ordinary intermeshing, the urging force is generated in the direction so that the elastic toothed portion 52*c* is pressed against the feed roller gear 19 as a gear rotated by the rotation of the control gear 24. As a result, the intermeshing state between the gears 19 and 24 are kept well, and tooth breakage of the gears is not caused to occur.

Then, operational sequences in this embodiment will be described in detail.

First of all, a sequence at the time of sheet feeding will be explained. The feeding sequence of the sheets 2, as described above, is classified into three types including plain paper feeding, special paper feeding and registration-less feeding, in view of various specifications of species of sheet materials used.

5-1 (Plain Paper Feeding)

A sequence at the time of normal feeding (of plain paper) will be described with reference to FIG. 27.

Figure 27:
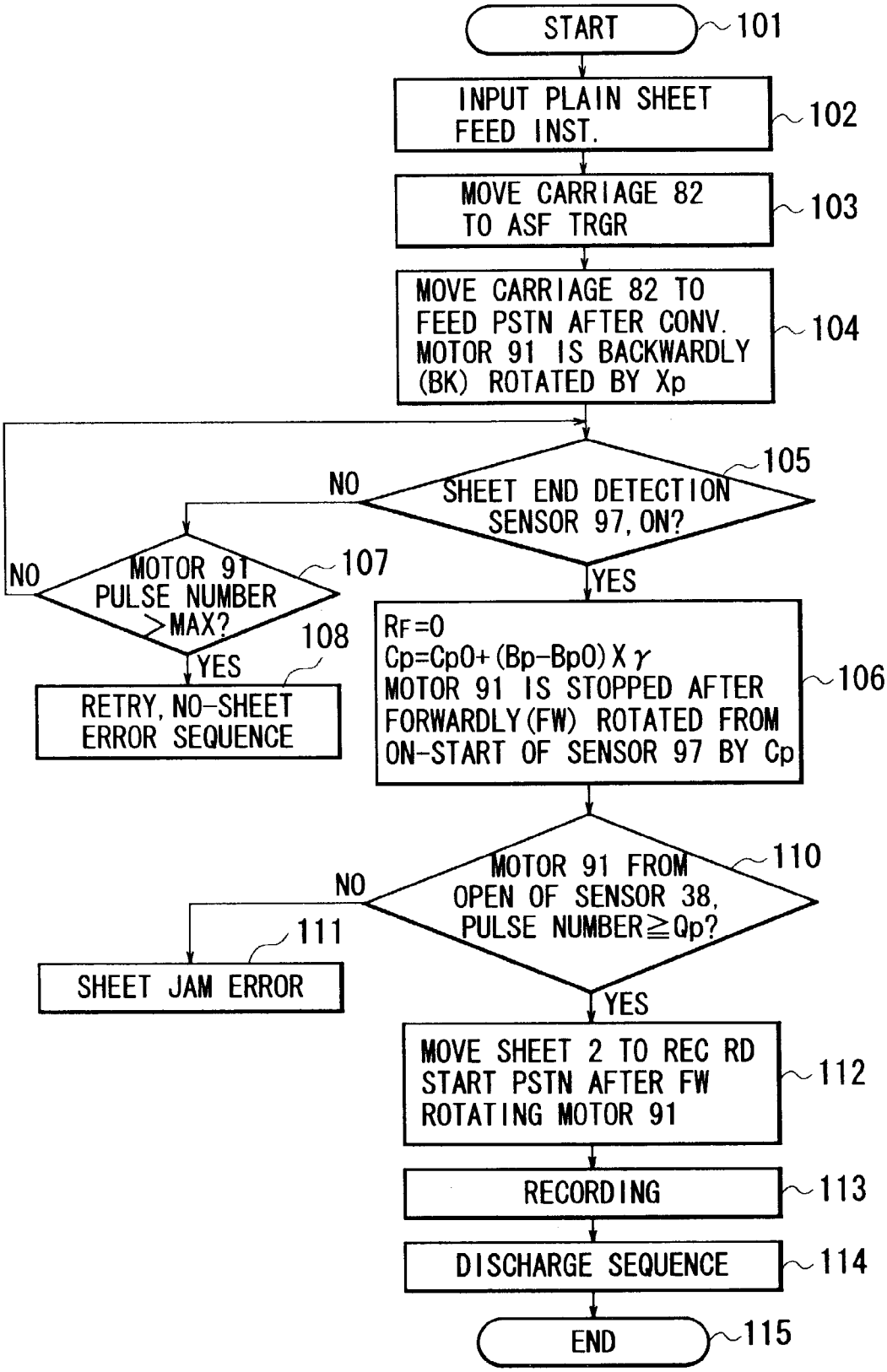
FIGS. 27 and 28 are flowcharts showing sequences at the time of feeding plain paper and special paper, respectively.

As shown in FIG. 27, the sequence is started from step 101, and when a recording instruction is inputted in Step 102, the carriage 82 is moved to the feeding trigger position in Step 103 in the case where the the carriage 82 is not located at the feeding trigger position.

In the state in which the carriage 82 is moved to the trigger position, in Step 104, backward rotation of the conveyance motor 91 is started and then the carriage 82 is moved to the feeding position at the time when the conveyance motor 91 is backwardly rotated by a pulse number XP. This step is performed in order to smoothly operate the stopper 41, which has been depressed, when it is rotated by swing the pendulum 39 using to a neutral position, where the regulation by the stopper is released, through the drive of the conveyance motor 91, thereby to move the carriage 82 from the feeding trigger position.

By the rotation of the stopper 41, the engagement state of the first regulation portion 41*b* of the stopper 41 with the first engagement portion 39*b* of the pendulum 39 is removed, i.e., the regulation by the pendulum 39 is removed. For this reason, the pendulum 39 is swung, whereby the feed roller roller gear 19 and the backward rotation planet gear 36 are engaged with each other to start the separation/feeding operation of the sheets 2.

The driving state of the driving mechanism 8 at this time is shifted in the order of FIGS. 19 to FIG. 22, and the sheets 2 are separated and fed one by one. After the separation/feeding, the leading end of the sheet 2 fed by the feed roller 11 in the feeding direction is abutted to the sheet end detection lever 98. The sheet end detection lever 98 is rotated, whereby the leading end of the sheet 2 is detected by the sheet end detection sensor 97 is placed in the ON state wherein it has detected the sheet leading end, the sheet 2 is sent to the nip portion 9 between the backwardly rotated conveyance roller 30 and the roller 29 driven by the rotation of the conveyance roller 30, so that the registration of the sheet 2 is performed. In other words, in Step 5, the sheet end detection sensor 97 is judged whether it is in the ON state or not. In the case of the ON state, the sequence is shifted to Step 106 and oh the other hand, is shifted to Step 107 in the case where the sheet end detection sensor 97 is not in the ON state.

When the registration is performed, the conveyance motor 91 is forwardly rotated in Step 106 by a pulse number CP after the sheet end detection sensor 97 detects the sheet 2 leading end, and then is stopped. The pulse number CP is calculated according to the following equation:

$$CP=CP0+(BP-BP0)\times\gamma,$$

wherein CP0 represents a calculatory pulse number of the conveyance roller 30 in a period from the detection position by the sheet end detection sensor 97 to the registration by forcedly conveying the sheet leading end in the nip portion 99; BP0 represents a calculatory pulse number of the conveyance roller 30 in period from an open state ("OPEN"), in which the feeding (state) sensor 38 is open without light-interrupted by the first and second light-interrupting portions (shield portions), to the sheet 2 leading end detection; BP represents an actual pulse number of the conveyance motor in a period from the OPEN of the feeding sensor 37 to the detection of the sheet 2 leading end; γ represents a ratio between a conveyance distance between the detection position of the sheet 2 and a conveyance distance after the detection position.

Accordingly, even if the slippery sheet 2 is fed, an amount of slippage is calculated from the difference between the pulse number BP0 (which are pulse numbers in a period up to the leading end detection of the sheet 2 by the sheet end detection sensor 97) and based on the slippage amount the pulse number of the conveyance motor 91 in the state after the sheet 2 leading end is detected is corrected. As a result, it becomes possible to stabilize an amount of the sheet 2 leading end which is forcedly conveyed into the nip portion 99 at the time of the registration, thus stabilizing a registration performance.

If, at this time, the pulse number (BP+CP) of the conveyance motor 91 from the light interrupted state ("CLOSE") of the feeding sensor 38 by the second shield portion 56*b* to the open state (i.e., CLOSE→OPEN), is smaller than a pulse number QP of the conveyance motor 91 required to rotate the control gear 24 so that its third tooth-less portion 52*b* to a position opposite to the feed roller gear 19 after the feeding sensor 38 is placed in the open state by the second shield portion 56*b*, the rotation positions of the control gear 24 and the control cam 34 are not their normal positions. As a result, there is a possibility that the sheet 2 is not normally fed in a subsequent feeding operation. For this reason, in such a case, a so-called sheet jam error message is displayed on a display portion (not shown) provided to the recording apparatus 1 in Step 111, and the recording operation is terminated.

When the sheet end detection sensor 97 is not placed in the ON state at the time of sheet feeding, the sequence is shifted from Step 105 to Step 107. In Step 107, the pulse number of the conveyance motor 91 is judged whether it is larger than a set maximum pulse number MAX or not.

In the case where the sheet end detection sensor 97 is not placed in the ON state even hen the pulse number of the conveyance motor 91 exceeds the set maximum pulse number MAX, the sequence is shifted to Step 108 in which retry and no-sheet error sequences are performed. If the pulse number of the conveyance motor 91 is smaller than the MAX, the sequence again goes into Step 105 in which the judgment on whether the sheet 2 leading end is detected or not is performed.

The sequence of retry and no-sheet error will be explained with reference to FIG. 30.

Figure 30:
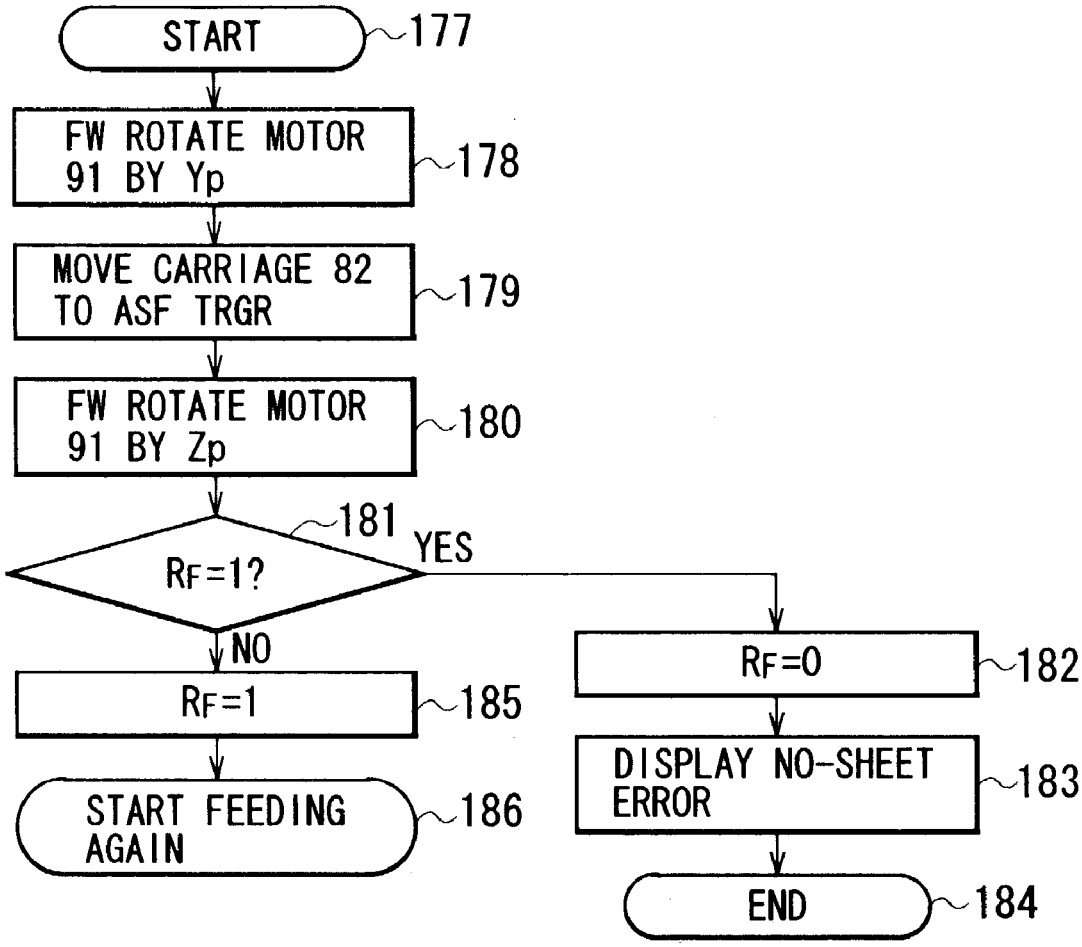
FIG. 30 is a flowchart showing a sequence at the time of retry and error about absence of paper.

As shown in FIG. 30, the retry and no-sheet error sequence is started from Step 176, and in Step 178, the conveyance motor 91 is forwardly rotated by a pulse number YP to swing the pendulum 39 to the neutral position, whereby the carriage 82 is moved to the feeding trigger position to allow the counterclockwise rotation of the stopper 41.

Next, in Step 179, by the movement of the carriage 82 to the feeding trigger position, the cam portion 82*a* of the carriage 82 depresses the working portion 41*a* of the stopper 41. In this state, the conveyance motor 91 is forwardly rotated by a pulse number ZP in Step 180.

By the forward rotation of the conveyance motor 91 by the pulse number ZP, the pendulum is swung to engage the forward rotation planet gear 35 with the first gear portion 24*a* of the control gear 24, so that the control cam 24. The control cam 34 is rotated until the driving force from the conveyance motor 91 is interrupted by the first tooth-less portion 51 of the control gear 24, and is stopped at the standby state of the feeding mechanism 8.

Thereafter, in Step 108, judgment on whether retry flag RF=0 or not is performed. If the retry flag RF is "0", the retry flag RF is set to "1" in Step 185, and then the feeding operation is started again in Step 186.

If the retry flag RF is "1", the retry flag RF is set to "0" in Step 182, and in Step 183, a so-called no-sheet error message is displayed at the display portion of the recording apparatus 1 or a host computer. The retry and no-sheet error sequence is completed in Step 184.

After the leading end of the sheet 2 is detected and the registration is performed by the sequence up to the above-mentioned Step 110, the driving mechanism is placed in the driving state shown in FIG. 22. In Step 112 shown in FIG. 27, the conveyance motor 91 is forwardly rotated to move the sheet 2 to a recording start position. After the recording is performed by the recording portion 3 in Step 113, a discharge sequence described later is performed in Step 114, followed by completion of the recording operation in Step 115.

5-2 (Special Paper Feeding)

A sequence of special paper feeding will be described with reference to FIG. 28.

Figure 28B:
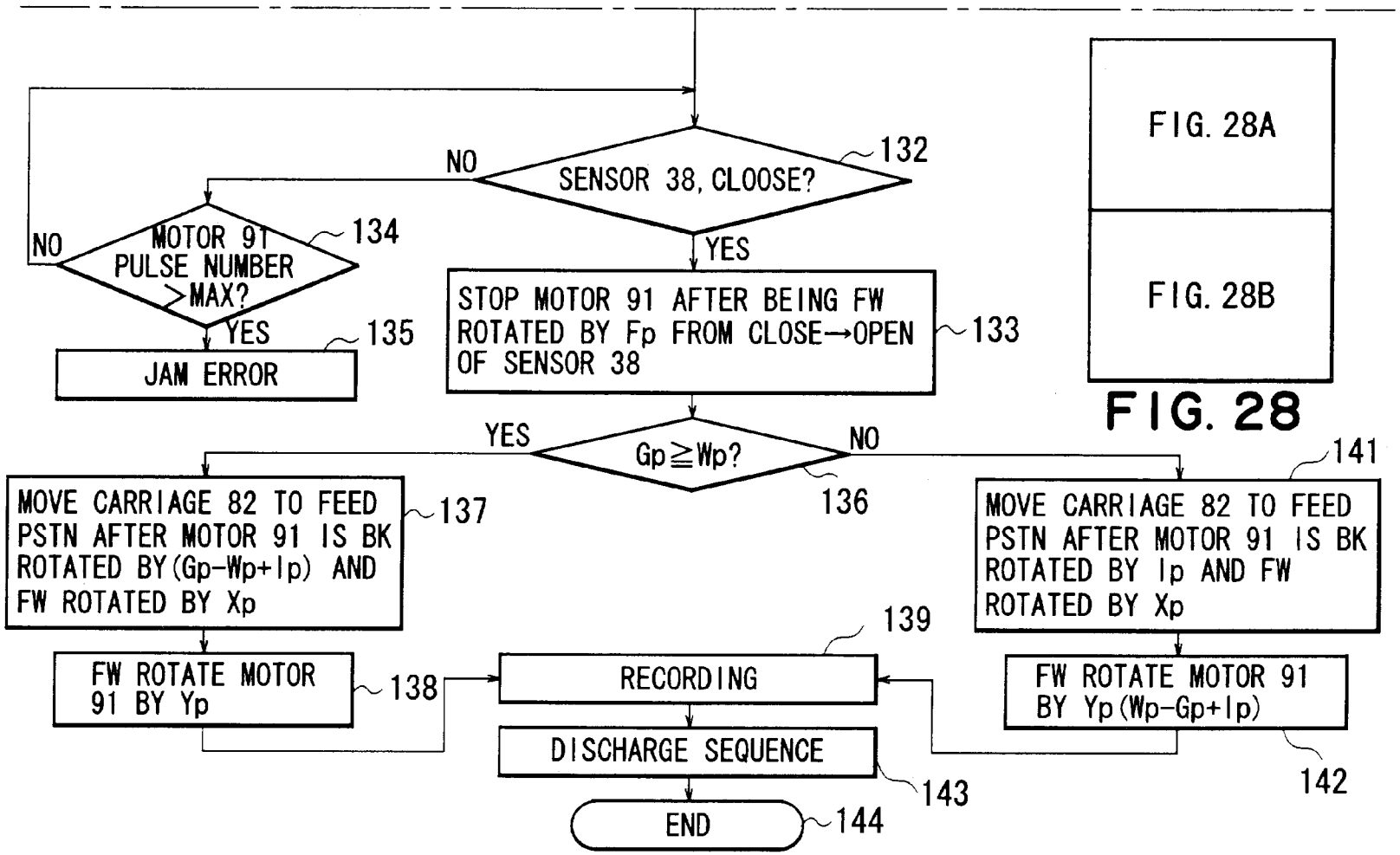
Figure 28A:
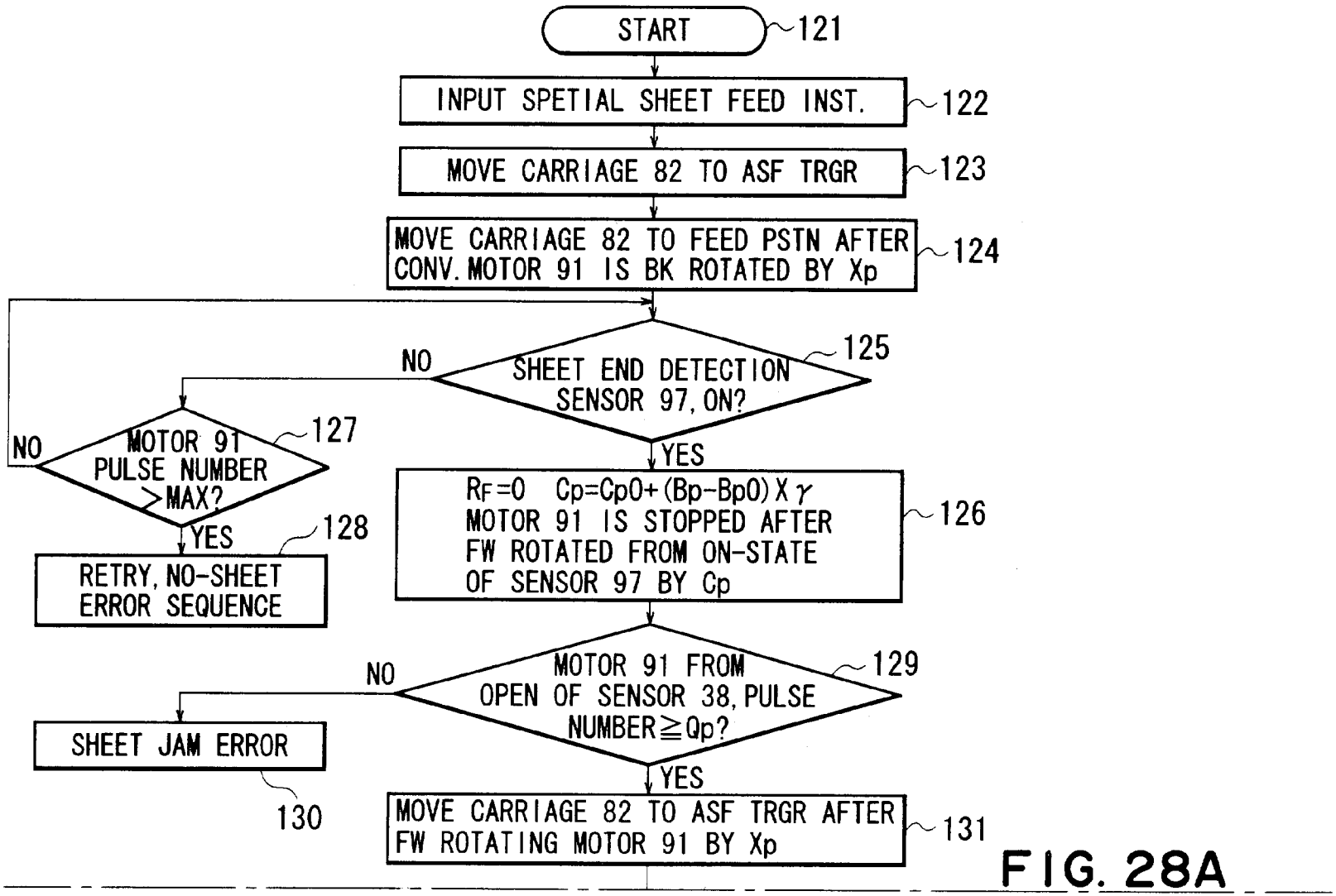

As shown in FIG. 28, the special paper feeding sequence is started from Step 121, and Step 122, a feeding instruction of special paper is inputted. In the special paper feeding sequence, the sequence up to the registration in Steps 123 to 129 is performed in the same manner as in the above described Steps 103–110 for the plain paper feeding, thus omitting explanation thereof.

After the registration of the sheet 2 is performed, in Step 131, the forward rotation of the conveyance motor 91 is started and after the conveyance motor 91 is forwardly rotated by the pulse number XP in order to move the pendulum 39 to the neutral position, the carriage 82 is moved to the feeding trigger position.

The ca portion 82*a* of the carriage 82 moved to the feeding trigger position presses the working portion 41*a* of the stopper downwardly to remove the engagement state of the second regulation portion 41*c* of the stopper 41 with the second engaging portion 39*e* of the pendulum 39, i.e., the regulation on the pendulum 39. For this reason, the pendulum 39 is swung, whereby the forward rotation planet gear 35 is engaged with the first gear portion 24*a* of the control gear 24 to rotationally drive the control cam 34 through the rotation of the control gar 24.

Next, in Step 132, the feeding sensor 38 is judged whether it is light-interrupted (i.e., CLOSE) by the first shield portion 56*a* of the control gear 24 or not. In the case where the feeding sensor 38 detects CLOSE, the sequence goes into Step 133, but if CLOSE is not detected by the feeding sensor 38, the sequence goes into Step 134. Steps 134 and 135 are performed in the same manner as the above-described Steps 107 and 111, respectively.

In Step 133, after the feeding sensor 38 detects CLOSE→OPEN due to the presence and absence of the first shield portion 56*a* of the control gear, the conveyance motor 91 is driven by a pulse number FP and stopped (the driving state shown in FIG. 23 described above).

Thereafter, as described in the operation explanation, the conveyance motor 91 is backwardly rotated to move the pendulum 39 to the neutral position, and the driving force transmission to the control gear 24 is interrupted. Then, the carriage 82 is moved to the feeding position, and the conveyance motor 91 is forwardly rotated to convey the sheet 2 to the recording start position. At this time, a pulse numbers for rotating the conveyance motor 91 forwardly and backwardly is determined on the basis of a pulse number GP for forwardly rotating the conveyance motor 91 after the registration and a pulse number WP of the conveyance motor 91 for conveying the sheet 2 to the recording start position.

Accordingly, in Step 136, judgment on whether GP≧WP or not is made. If GP≧WP, the sheet 2 is conveyed ahead of the recording start position, so that the sequence is shifted to Steps 137 and 138 wherein the conveyance motor 91 is forwardly rotated by a pulse number IP after rotated backwardly by a pulse number (GP−WP+IP). The forward rotation of the conveyance motor 91 by the pulse number IP is performed in order to remove backlash of the gear. The conveyance motor 91 is rotated forwardly by the pulse number IP after backwardly rotated excessively by the pulse number IP. If GP<WP, the sequence goes into Steps 141 and 142 in which, in order to move the pendulum 39 to the neutral position, the conveyance motor 91 is forwardly rotated by the pulse number (WP−GP+IP) after backwardly rotated by a pulse number IP.

The sheet 2 is conveyed to the recording start position by the forward rotation of the conveyance motor 91 in Steps 138 and 142. After the recording is effected in Step 139, the discharge sequence described hereinafter is performed in Step 143, and then in Step 144, the recording operation is completed.

5-3 (Registration-less Feeding)

A sequence of registration-less feeding will be described with reference to FIG. 29.

Figures 29, 29B:
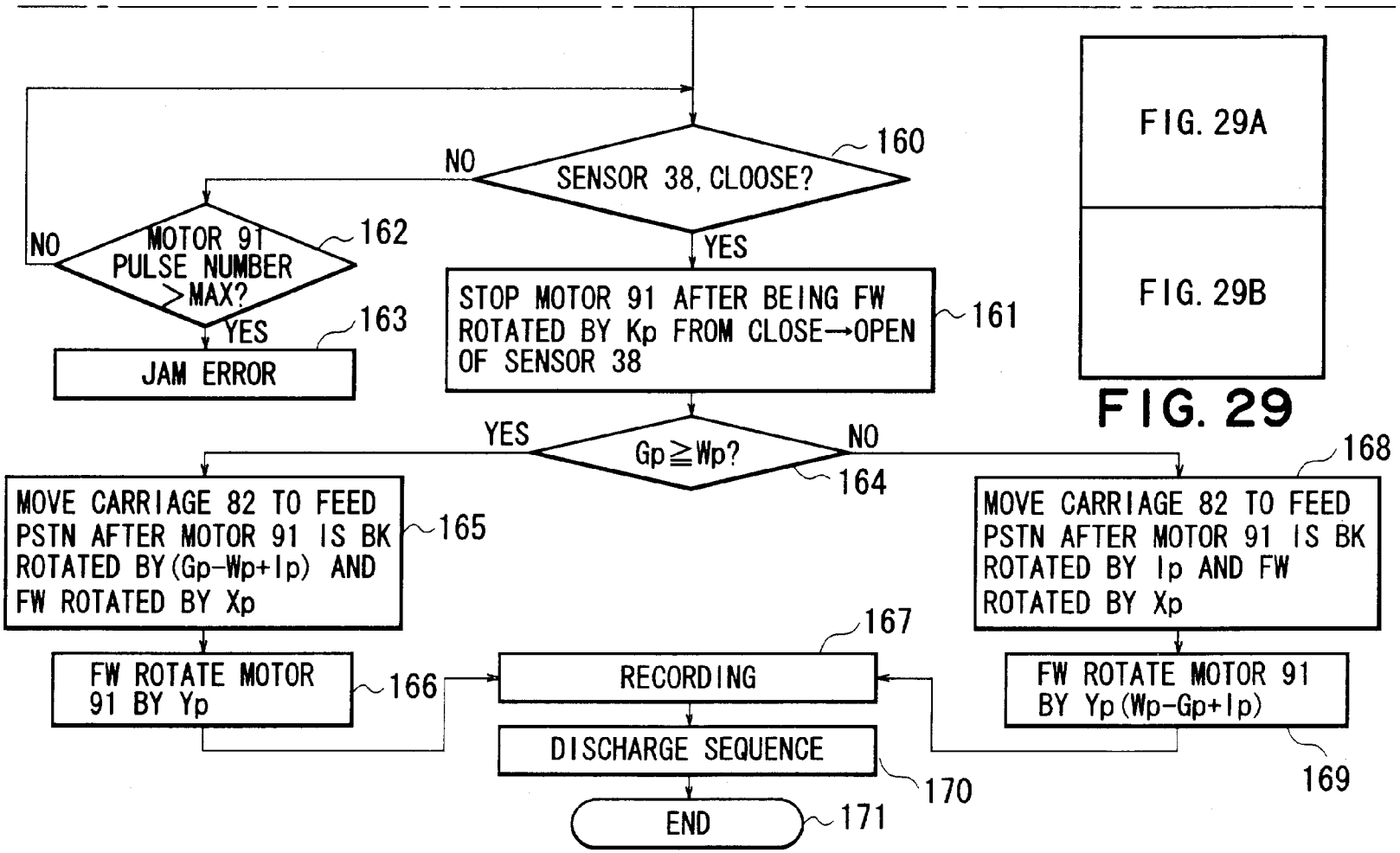
FIG. 29 is a flowchart showing a sequence at the time of sheet feeding with no registration.
Figure 29A:
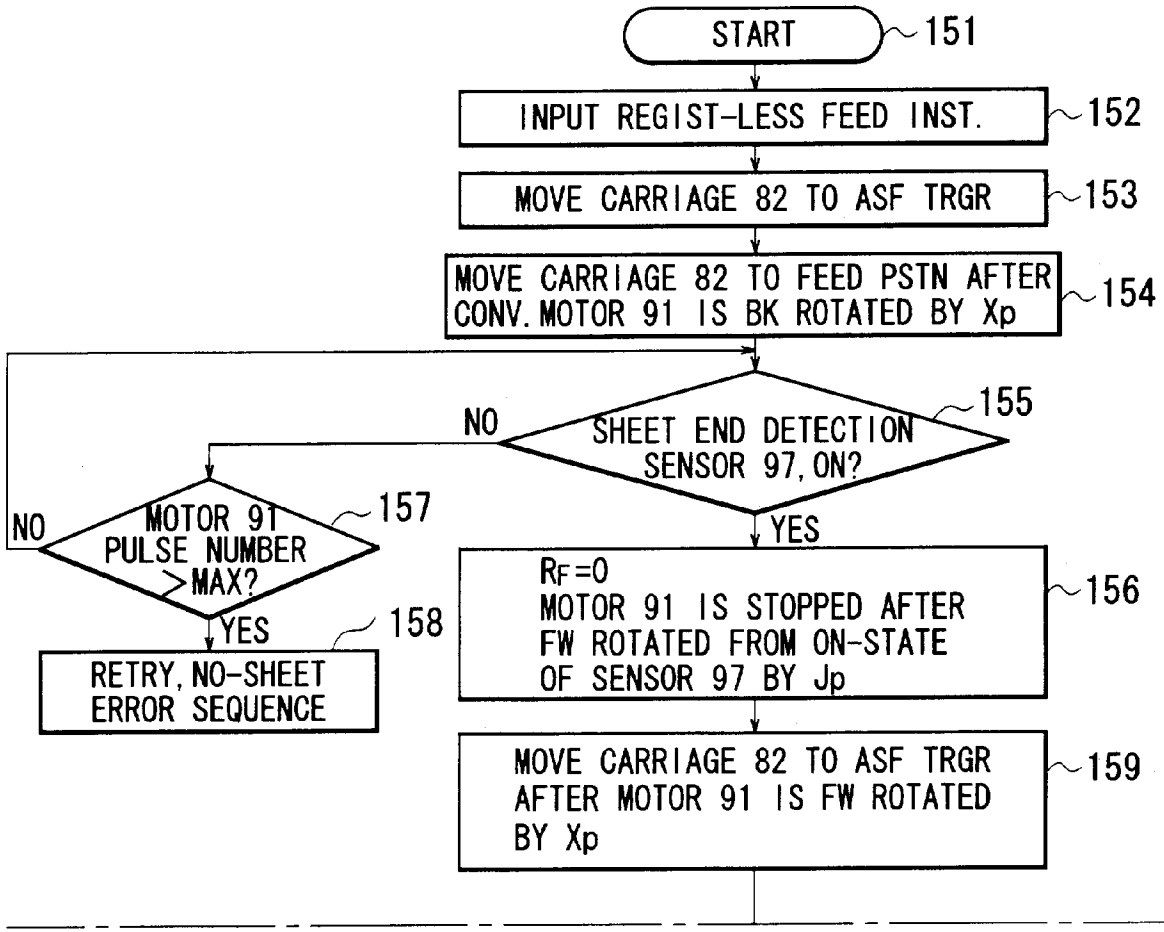

As shown in FIG. 29, the sequence of registration-less feeding is started from Step 151, and in Step 152, a registration-less feeding instruction is inputted. In this feeding sequence, the sequence from the detection of the sheet 2 leading end by the sheet end detection sensor 97 to the ON state of the sheet end detection sensor 97 in Steps 153–155 are performed in the same manner as in the Steps 103–110 for the plain paper feeding, thus omitting explanation thereof.

In the case where the sheet end detection sensor 97 is judged that it is in the ON state in Step 155, the conveyance motor 91 is once stopped by rotating forwardly it by a pulse number JP after the detection of the sheet 2 leading end. The pulse number JP is set to be smaller than a pulse number for conveying the leading end of the sheet 2 from the detected position to the nip portion 99, so that the sheet 2 leading end is stopped before the nip portion 99. Further, in Step 155, if the sheet end detection sensor 97 is judged that it is not in the ON state, the sequence goes into Steps 157 and 158 which are performed in the same manner as in the Steps 107 and 108 described above.

Thereafter, as described in the operation explanation, the conveyance motor 91 is backwardly rotated to move the pendulum 39 to the neutral position, and the driving force transmission to the control gear 24 is interrupted. Then, the carriage 82 is moved to the feeding position, and the conveyance motor 91 is forwardly rotated to convey the sheet 2 to the recording start position. At this time, a pulse numbers for rotating the conveyance motor 91 forwardly and backwardly is determined on the basis of a predetermined pulse number JP and a pulse number WP of the conveyance motor 91 for conveying the sheet 2 to the recording start position.

Accordingly, in Step 164, judgment on whether G≧WP or not is made. If JP≧WP, the sheet 2 is conveyed ahead of the recording start position (i.e., the recording start position is located upstream from the leading end position of the sheet 2 in the conveyance direction), so that the sequence is shifted to Steps 165 and 166 wherein the conveyance motor 91 is forwardly rotated by a pulse number IP after rotated backwardly by a pulse number (JP−WP+IP). If JP<WP, the sequence goes into Steps 168 and 169 in which, in order to move the pendulum 39 to the neutral position, the conveyance motor 91 is forwardly rotated by the pulse number (WP−JP+IP) after backwardly rotated by a pulse number IP.

The sheet 2 is conveyed to the recording start position by the forward rotation of the conveyance motor 91 in Steps 166 and 169. After the recording is effected in Step 167, the discharge of the sheet fed depending on its material is performed toward outside the recording apparatus 1 by the discharge sequence described below is performed in Step 170, and then in Step 171, the recording operation is completed.

Next, the discharge sequence will be described with reference to FIG. 31.

Figure 31:
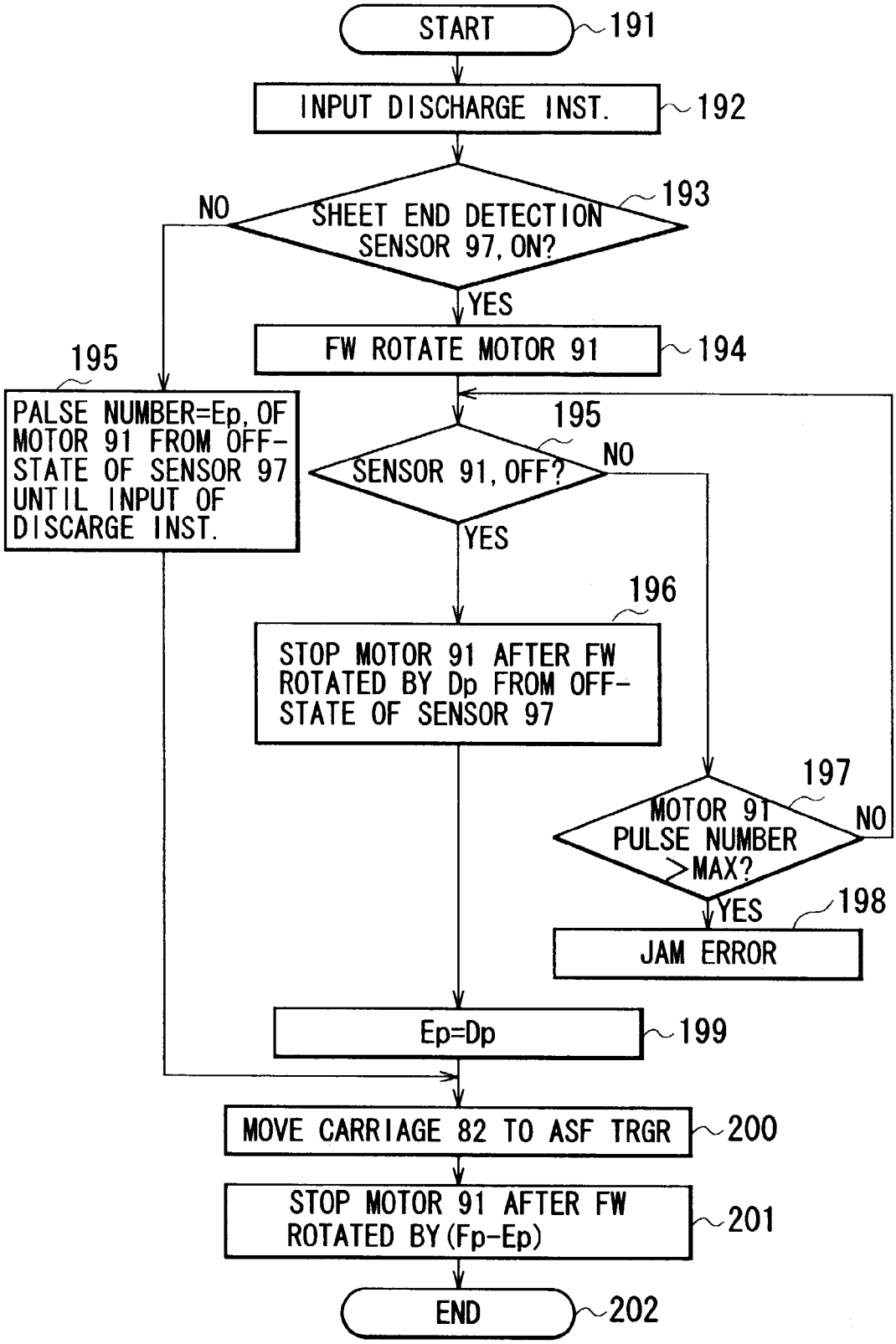
FIG. 31 is a flowchart showing a sequence at the time of sheet discharge.

As shown in FIG. 31, the discharge sequence is started from Step 191 after the recording operation is completed, and in Step 192, the discharge instruction is inputted. At the time of the input of the discharge instruction, the sequence goes into Step 193, the sheet end detection sensor 97 is judged on whether it is in the ON state or not.

In the case where the sheet end detection sensor 97 is in the ON state, the sequence goes into Steps 194 and 195, the sheet 2 is conveyed by rotating the conveyance motor 91 forwardly to wait a state that the sheet end detection sensor 97 is placed in the OFF state.

At the time of input of the discharge instruction, in the case where the sheet end detection sensor 97 is judged that it is not in the ON state but is already in the OFF state, the sequence goes into Step 195 in which a pulse number of the conveyance motor 91 from the OFF state of the sheet end detection sensor 97 is set to EP.

After the sheet end detection sensor 97 is judged on whether it is in the OFF state or not in Step 195 and the sheet end detection sensor 97 is placed in the OFF state, the sequence goes into Steps 196 and 199, wherein the conveyance motor 91 is stopped after driving it by a pulse number DP which is equal to the pulse number EP (EP=DP). In the case where the sheet end detection sensor 97 is not in the OFF state, the sequence is shifted into Steps 197 and 198 which are performed in the same manner as in the Steps 107 and 111 described above.

Thereafter, the sequence is goes from the Steps 195 and 199 into Step 200 in which the carriage 82 is moved to the feeding trigger position. In Step 201, the conveyance motor 91 is forwardly rotated by a pulse number (FP−EP) to effect discharge of the sheet 2, and the sequence is completed in Step 202.

At that time, the working portion 41*a* of the stopper 41 is depressed by the cam portion 82*a* of the carriage 82 moved to the feeding trigger position, so that the driving force of the conveyance motor 91 is transmitted to the control gear 24. Further, the control cam 34 is rotated until the transmission of the driving force from the conveyance motor 91 is interrupted by the first tooth-less portion 51 of the control gar 24, and is stopped after being further rotated up to the standby state.

Finally, a sequence at the time of power-on of the recording apparatus 1 will be explained with reference to FIG. 32.

Figure 32:
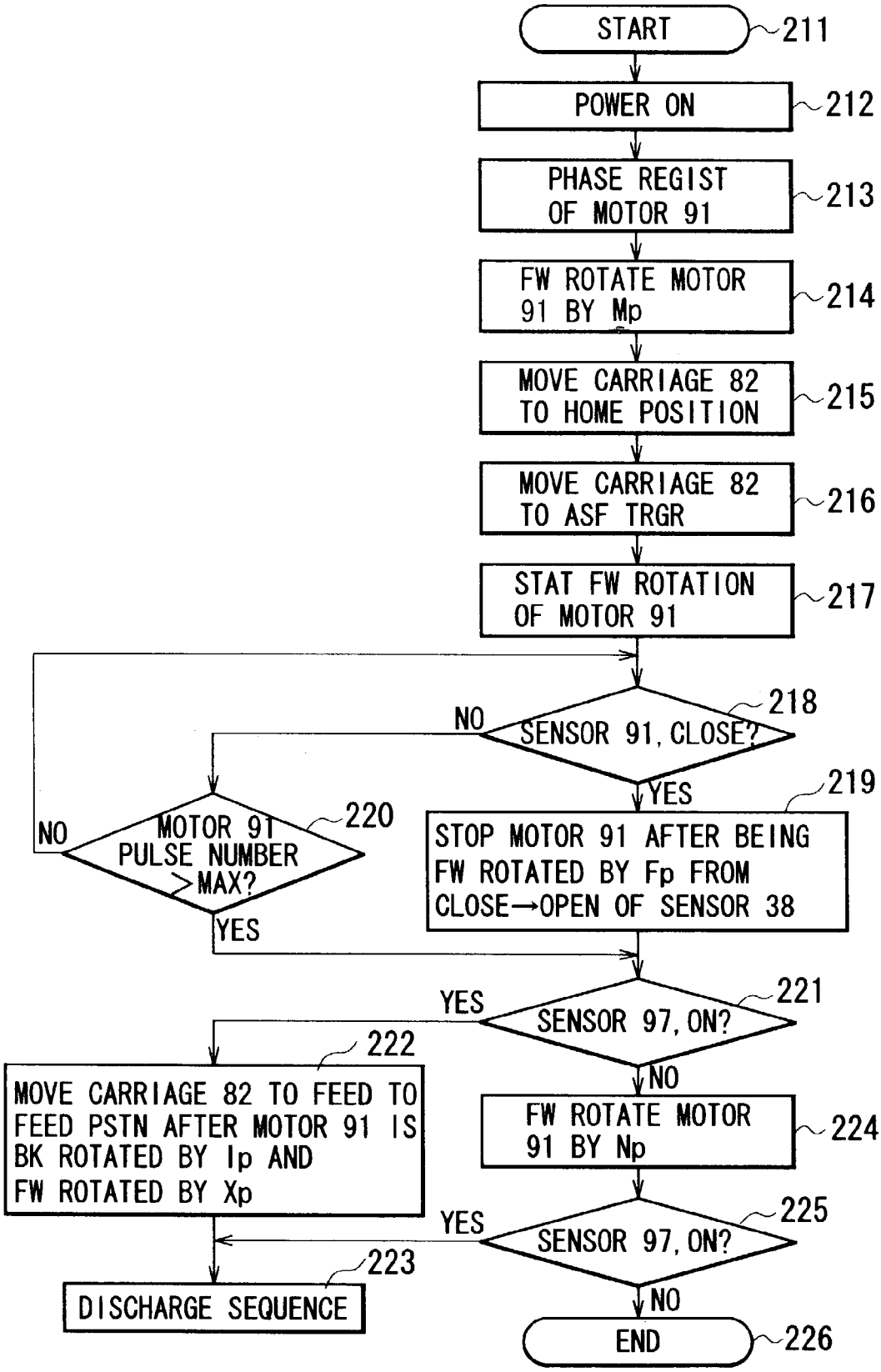

As shown in FIG. 32, the sequence at the time of power-on is started from Step 211. In Step 212, when the power source of the recording apparatus 1 is turned on, phase alignment of the conveyance motor 91 is first performed in Step 213.

After performing the phase alignment of the conveyance motor 91, in order to prevent the pendulum to hinder the rotation of the stopper 41 thereby to place the carriage in an immovable state, in Step 214, the conveyance motor 91 is forwardly rotated by a pulse number MP to move the pendulum 39 to the neutral position and then in Step 215, the carriage motor is driven to move the carriage to the home position.

Thereafter in Step 216, the carriage 82 is moved to the feeding trigger position and in Step 217, the conveyance motor 91 is rotated forwardly. In the case where the driving mechanism 8 is not in the standby state during the forward rotation of the conveyance motor 91, the driving force is transmitted to the control gear 24 to actuate the control cam 34.

In Step 218, the feeding sensor 38 is judged on whether it is CLOSE or not. If the feeding sensor is not CLOSE, the sequence is shifted into Step 220. In Step 220, a pulse number of the conveyance motor 91 is judged whether it is larger than a set maximum pulse number MAX or not. If the pulse number of the conveyance motor 91 is larger than MAX, the sequence goes into Step 221. If the pules number of the conveyance motor 91 is smaller than MAX, the sequence is returned to Step 218 again.

In the case where the movement of the first shield portion 56*a* of the control gar 24 is started from the position before the feeding sensor 38, in Step 219, the conveyance motor 91 is driven by a pulse number KP after the detection of CLOSE→OPEN of the feeding sensor 38, whereby the second tooth-less portion 52*a* of the control gear 24 is stopped at a position opposite to the feed roller gear 19. This operation is performed in order not to rotate the control gear 24 when the feed roller gear 19 is rotated together with the feed roller 11 for conveying the sheet 2 in the case where the sheet 2 is located at the nip portion 99 between the conveyance roller 30 and the roller 29 driven by the rotation of the conveyance roller 30.

In the case where the movement of the first and second shield portions 56*a* and 56*b* of the control gear 24 is started or where the driving mechanism 8 is in the standby state, the transmission of the driving force to the control gear 24 is interrupted at a position, at which the forward rotation planet gear 35 is opposite to the first tooth-less portion 51 of the control gear 24, unless the sheet 2 is located at the nip portion 99. Thus, the initializing operation of the driving mechanism 8 is performed.

If the sheet 2 is located at the nip portion 99, the control gear 24 which is stopped at the standby position of the driving mechanism 8 by dragging the feed roller 11 by the sheet 2, is rotated by the feed roller gear 19. However, thereafter, the control gear 24 is moved similarly as in the case where the movement of the first shield portion 56*a* is started from the position before the feeding sensor 38.

At the time when the conveyance motor 91 is stopped, the sheet end detection sensor 97 is confirmed. If the sheet end detection sensor 97 is in the ON state in Step 221, the sequence goes into Steps 222 and 223, in which the conveyance motor 91 is backwardly rotated by a pulse number IP to move the pendulum 39 to the neutral position and, the carriage is moved to the feeding position after the conveyance motor 91 is forwardly rotated by the pulse number XP, thus performing the discharge sequence.

In the case where the sheet end detection sensor 97 is in the OFF state in Step 221, the sequence goes into Step 224, in which the conveyance motor 91 is rotated forwardly by the pulse number NP, whereby the first tooth-less portion 51 of the control gear 24 is rotated up to the position opposite to the forward rotation planet gear 35 to effect the initializing operation of the driving mechanism 8. Thereafter, the sheet end detection sensor 37 is in the OFF state, the sequence goes into Step 226 and is completed. If the sheet end detection sensor 97 is in the ON state, the sequence goes into 223, in which the discharge sequence is effected.

As described hereinabove, according to the recording apparatus 1 of this embodiment, the driving mechanism 8 includes the control gear 24 provided with the first and second shield portions 56*a* and 56*b* to be detected by the feeding sensor 38, thus allowing the detection of the control gear 24 with reliability.

Further, according to the recording apparatus 1, by including therein the feeding portion (means) 4 provided with the driving mechanism 8, the separating operation and the conveying operation is switched during the feeding operation while ensuring a stability of the separating/feeding operation, whereby the recording apparatus 1 is capable of conforming to various sheet specifications and reducing an undesired resistive force imparted to the sheet.

Further, according to the recording apparatus 1, it becomes possible to arbitrarily set a possible conveyance length of the sheet 2, thus improving a latitude in design of the entire recording apparatus 1. Further, the recording apparatus 1 can reduce its size as a whole and is capable of switching between the registration mode and the registration-less mode by a simple and inexpensive mechanism. It is also possible to reduce the load on the conveyance roller at the time of conveying the special paper.

As described hereinabove, according to the recording apparatus of the present invention, while ensuring the stability of the separating/feeding operation, the undesirable resisting force imparted to the sheet can be reduced by switching between the separating operation and the conveying operation. Further, it becomes possible to arbitrarily set the possible conveyance length and to reduce the entire apparatus size.

Further, according to the recording apparatus of the present invention, by a simple and inexpensive structure, it becomes possible to switch between the registration mode and the registration-less mode. Further, it is possible to realize compatibly the ordinary (plain paper) feeding mode and the special paper mode for further reducing the load on drive.

What is claimed is:

1. A sheet feeding apparatus for separating and feeding a plurality of sheets stacked on a sheet stacking portion one by one, comprising:

feeding means for feeding the plurality of sheets stacked on the sheet stacking portion, separation means for separating the sheets one by one by contacting to the sheets, returning means for returning the sheets to the sheet stacking portion, and separation force switching means for switching a state of said separation means between a sheet separation force generating state and a sheet separation force non-generating state, wherein said separation means is in the sheet separation force generating state when said feeding means starts feeding of sheet and said separation force switching means switches the sheet separation force generating state to the sheet separation force non-generating state after a sheet is sandwiched between said feeding means and said separation means during the feeding of the sheet by said feeding means, wherein during a feeding operation in a state in which a sheet is fed while being sandwiched between said feeding means and said separation means, the feeding operation is switchable, by said separation force switching means, between a separating mode in which the separation force for a sheet is generated by said separation means and a conveying mode in which the separation force is released.

2. An apparatus according to claim 1, further comprising a separation means support member for holding said separation means and a preliminary regulation member for regulating the number of sheets which have reached a separation portion, wherein when said returning means is operated, said separation means held by said separation means support member and said preliminary regulation member are moved away from said feeding means.

3. An apparatus according to claim 2, wherein said separation means support member and said preliminary regulation member are independently operated, and when said returning means is operated, said preliminary regulation member is moved away from said feeding means before said separation means held by said separation means support member.

4. An apparatus according to claim 1, wherein said feeding means starts feeding of a sheet in such a state that a sheet is sandwiched between said feeding means and said separation means and a sheet separation force is generated by said separation means, and after said separation means is moved away from said feeding means, said feeding means again effects the feeding of a sheet in such a state that the sheet is sandwiched between said feeding means and said separation means and the sheet separation force is not generated by said separation means.

5. An apparatus according to claim 1, wherein said feeding means has a circular cross section.

6. An apparatus according to claim 1, wherein said separation means is a separation roller provided with a torque limiter.

7. An apparatus according to claim 6, wherein the torque limiter has a molded shaft.

8. An apparatus according to claim 1, further comprising a driving power source, wherein a separating operation and a conveying operation is switched by rotation of the driving power source in one direction.

9. An apparatus according to claim 1, wherein said sheet feeding apparatus further comprises a thick plate for pressing the plurality of sheets stacked on the sheet stacking portion against said feeding means, and said thick plate moves the plurality of sheets stacked on the sheet stacking portion away from said feeding means before feeding of sheet by said feeding means is effected in such a state that a sheet is sandwiched between said feeding means and said separation means and a sheet separation force is not generated by said separation means.

10. An apparatus according to claim 1, wherein the sheets are obliquely stacked on the sheet stacking portion relative to a horizontal surface of the apparatus.

11. A recording apparatus, comprising:

a sheet feeding apparatus according to claim 1, sheet conveyance means for conveying sheets fed from the sheet feeding apparatus, and a recording portion for recording an image on the conveyed sheets.

12. An apparatus according to claim 1, wherein said separation force switching means switches the feeding operation from the separation mode to the conveying mode after said returning means returns the sheets to the sheet stacking portion.

13. A sheet feeding apparatus, comprising:

a support member for supporting sheets, a feed roller for feeding the sheet supported by said support member, a separation roller for sandwiching the sheets in cooperation with the feed roller, a torque limiter for permitting rotation of said separation roller by rotation of said feed roller or advance of a sheet which is in contact with said feed roller when the separation roller contacts the feed roller or the sheet which is in contact with said feed roller and for generating a rotation stopping force against said separation roller so as to stop the advance of the sheet when the separation roller contacts a sheet which is not in contact with the feed roller, and switching means for switching a state of said torque limiter from a rotation stopping force generating state to a rotation stopping force non-generating state in such a state that a sheet is sandwiched between said feed roller and said separation roller after said feed roller starts feeding of a sheet.

14. An apparatus according to claim 13, further including a lever member which is moved to a position where the lever member is capable of being engaged with a leading end of a sheet other than a sheet contacting the feed roller after sheet feeding by the feed roller is started.

15. An apparatus according to claim 14, wherein the lever member returns the sheet other than the sheet contacting the feed roller toward a side upstream from a position where the sheet is sandwiched between the feed roller and the separation roller in a sheet advance direction.

16. An apparatus according to claim 15, wherein the separation roller is moved away from the feed roller when the lever member returns the sheet or sheets.

17. An apparatus according to claim 16, wherein the support member is moved away from the feed roller when the lever member returns the sheet or sheets.

18. An apparatus according to claim 17, further comprising a guide member for guiding a sheet or sheets fed from the support member by the feed roller to a position between the feed roller and the separation roller, wherein the guide member is moved away from the feed roller when the lever member returns the sheet or sheets.

19. An apparatus according to claim 15, wherein after the lever member returns the sheet, a sheet or sheets which have not been returned are sandwiched between the feed roller and the separation roller which is switched by said switching means to the state in which the rotation stopping force of the torque limiter does not act on the separation roller and are fed by the feed roller.

20. An image forming apparatus, comprising:

a support member for supporting sheets, a feed roller for feeding the sheet supported by said support member, a separation roller for sandwiching the sheets in cooperation with the feed roller, a torque limiter for permitting rotation of said separation roller by rotation of said feed roller or advance of a sheet which is in contact with said feed roller when the separation roller contacts the feed roller or the sheet which is in contact with said feed roller and for generating a rotation stopping force against said separation roller so as to stop the advance of the sheet when the separation roller contact sheets which are not in contact with the feed roller, switching means for switching a state of said torque limiter from a rotation stopping force generating state to a rotation stopping force non-generating state in such a state that a sheet is sandwiched between said feed roller and said separation roller after said feed roller starts feeding of sheet, and image forming means for forming an image on the sheet fed by said feed roller.

* * * * *

UNITED STATES PATENT AND TRADEMARK OFFICE

CERTIFICATE OF CORRECTION

PATENT NO. : 7,165,765 B2
APPLICATION NO. : 10/449079
DATED : January 23, 2007
INVENTOR(S) : Shinya Sonoda et al.

It is certified that error appears in the above-identified patent and that said Letters Patent is hereby corrected as shown below:

ON THE TITLE PAGE:
At Item (56), References Cited, U.S. Patent Documents, page 2, "2001/0030763 10/2001 NIshiberi et al." should read --2001/0030763 10/2001 Nishiberi et al.--.

IN THE DRAWINGS:
Sheet No. 16, Figure 17, "SPETIAL" should read --SPECIAL--.
Sheet No. 28, Figure 28, "SPETIAL" should read --SPECIAL--.

COLUMN 2:
Line 1, "hen" should read --then--.
Line 43, "come" should read --some--.

COLUMN 4:
Line 24, "in" should read --is--.

COLUMN 5:
Line 9, "rom" should read --from--.

COLUMN 6:
Line 58, "by" should read --and--.

COLUMN 7:
Line 3, "further," should read --further,--.

COLUMN 8:
Line 28, "an" should read --and--.
Line 36, "move" should read --more--.

COLUMN 9:
Line 14, "an" should read --and--, and "that" should read --that of--.
Line 43, "above described" should read --above-described--.
Line 53, "above described" should read --above-described--.

COLUMN 11:
Line 63, "and" should be deleted.

COLUMN 13:
Line 1, "22aregulates" should read --22a regulates--.
Line 26, "thus rotating the separation roller holder 21" (second occurrence) should be deleted.

UNITED STATES PATENT AND TRADEMARK OFFICE

CERTIFICATE OF CORRECTION

PATENT NO. : 7,165,765 B2
APPLICATION NO. : 10/449079
DATED : January 23, 2007
INVENTOR(S) : Shinya Sonoda et al.

It is certified that error appears in the above-identified patent and that said Letters Patent is hereby corrected as shown below:

COLUMN 14:
Line 5, “When” should read --when--.

COLUMN 15:
Line 19, “receives” should read --receive--.

COLUMN 17:
Line 14, “gar” should read --gear--.
Line 35, “am” should read --can--.

COLUMN 19:
Line 61, “the” (fourth occurrence) should be deleted.

COLUMN 20:
Line 45, “53aof” should read --53a of--.

COLUMN 21:
Line 27, “direction,so” should read --direction, so--.

COLUMN 22:
Line 12, “feed” should read --fed--.

COLUMN 23:
Line 8, “rotate” should read --rotated--.

COLUMN 24:
Line 16, “gar” should read --gear--.

COLUMN 26:
Line 31, “registration less” should read --registration-less--.
Line 38, “in” should read --a--.
Line 39, “so-called” should be deleted.

COLUMN 27:
Line 45, “gar” should read --gear--.

COLUMN 29:
Line 45, “measure” should read --a measure--.

UNITED STATES PATENT AND TRADEMARK OFFICE

CERTIFICATE OF CORRECTION

PATENT NO. : 7,165,765 B2
APPLICATION NO. : 10/449079
DATED : January 23, 2007
INVENTOR(S) : Shinya Sonoda et al.

It is certified that error appears in the above-identified patent and that said Letters Patent is hereby corrected as shown below:

COLUMN 30:
Line 16, "swing the" should read --the swing--.
Line 45, "oh" should read --on--.

COLUMN 31:
Line 37, "hen" should read --then--.

COLUMN 32:
Line 27, "above" should read --above- --.
Line 46, "gar" should read --gear--.

COLUMN 33:
Line 41, "forwardly it" should read --it forwardly--.

COLUMN 34:
Line 12, "fed" should read --feed--.
Line 26, "is" should be deleted.

Signed and Sealed this

Thirty-first Day of July, 2007

JON W. DUDAS
*Director of the United States Patent and Trademark Office*